US010085600B2

(12) United States Patent
Shiinoki et al.

(10) Patent No.: US 10,085,600 B2
(45) Date of Patent: Oct. 2, 2018

(54) METHOD OF MANUFACTURING SECONDARY PAPER ROLL FOR TISSUE PAPER PRODUCTS

(71) Applicant: Diao Paper Corporation, Ehime (JP)

(72) Inventors: Yusuke Shiinoki, Shizuoka (JP); Takuya Okuoka, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 13/949,711

(22) Filed: Jul. 24, 2013

(65) Prior Publication Data

US 2013/0340925 A1 Dec. 26, 2013

Related U.S. Application Data

(63) Continuation of application No. 13/519,517, filed as application No. PCT/JP2010/062939 on Jul. 30, 2010.

(30) Foreign Application Priority Data

Dec. 28, 2009 (JP) ..... 2009-298281
Apr. 16, 2010 (JP) ..... 2010-095133

(51) Int. Cl.
*A47K 10/22* (2006.01)
*D21H 27/00* (2006.01)
(Continued)

(52) U.S. Cl.
CPC ..... *A47K 10/22* (2013.01); *D21H 27/002* (2013.01); *D21H 27/005* (2013.01); *D21H 27/30* (2013.01);
(Continued)

(58) Field of Classification Search
CPC ..... D21H 27/002; D21H 7/32; A47K 10/22
(Continued)

(56) References Cited

U.S. PATENT DOCUMENTS 3,424,643 A * 1/1969 Lewis, Jr. ..... B31F 1/12 15/209.1
4,052,048 A 10/1977 Shirasaka
(Continued)

FOREIGN PATENT DOCUMENTS

EP 1849914 A1 10/2007
EP 2589324 A1 5/2013
(Continued)

OTHER PUBLICATIONS

Calender_process. Visualization of the calender process. Apr. 2007. Laurens van Lieshout. Retrivied from Internet on Jun. 28, 2015 [https://commons.wikimedia.org/wiki/File:Calender_process.png].*

(Continued)

*Primary Examiner* — Michael N Orlando
*Assistant Examiner* — Marta S Dulko
(74) *Attorney, Agent, or Firm* — Renner, Kenner; Arthur M. Reginelli

(57) ABSTRACT

The method of manufacturing the secondary paper roll for the tissue paper products including: a multi-ply forming step (51) of multi-ply forming single-sheets S11 and S12 from primary paper rolls, reeled out from the plural primary paper rolls JR in the continuous direction so as to form a multi-ply continuous sheet S2, a chemicals applying step (53) of applying chemicals to the multi-ply continuous sheet S2, a slitting step (55) of slitting the multi-ply continuous sheet S2 into each product width of the tissue paper products or several fold widths thereof, and a winding step (56) of coaxially winding the respective slit multi-ply continuous sheets S2 so as to form plural secondary paper rolls R of each product width of the tissue paper products or several fold widths thereof.

2 Claims, 28 Drawing Sheets

(51) Int. Cl.
*D21H 27/30* (2006.01)
*D21H 27/32* (2006.01)

(52) U.S. Cl.
CPC ..... *D21H 27/32* (2013.01); *Y10T 156/1057* (2015.01)

(58) Field of Classification Search
USPC ..... 156/253
See application file for complete search history.

(56) References Cited

U.S. PATENT DOCUMENTS

| | | | | |
|---|---|---|---|---|
| 6,136,422 | A * | 10/2000 | Lichtenberg et al. | 428/219 |
| 6,428,794 | B1 | 6/2002 | Klofta | |
| 7,517,433 | B2 | 4/2009 | Zwick | |
| 7,799,169 | B2 * | 9/2010 | Bhat | B32B 29/00 162/117 |
| 2003/0188841 | A1 * | 10/2003 | Buder | A61K 8/0208 162/179 |
| 2004/0112783 | A1 * | 6/2004 | Mukai et al. | 206/494 |
| 2006/0243405 | A1 * | 11/2006 | Zwick et al. | 162/135 |
| 2006/0278357 | A1 * | 12/2006 | Suzuki et al. | 162/117 |
| 2007/0092700 | A1 * | 4/2007 | Maddaleni et al. | 428/174 |
| 2008/0073046 | A1 * | 3/2008 | Dyer et al. | 162/112 |
| 2010/0319864 | A1 * | 12/2010 | Bhat et al. | 162/109 |
| 2011/0123578 | A1 * | 5/2011 | Wenzel et al. | 424/401 |

FOREIGN PATENT DOCUMENTS

| | | | |
|---|---|---|---|
| JP | 61-037668 | A | 2/1986 |
| JP | 05-124770 | A | 5/1993 |
| JP | 10-179441 | A | 7/1998 |
| JP | 2001-286414 | A | 10/2001 |
| JP | 2002-347146 | A | 12/2002 |
| JP | 2003-010064 | A | 1/2003 |
| JP | 2003-325372 | A | 11/2003 |
| JP | 2004-322034 | A | 11/2004 |
| JP | 2004-338415 | A | 12/2004 |
| JP | 2006-240750 | A | 9/2006 |
| JP | 2007-015379 | A | 1/2007 |
| JP | 2007-061256 | A | 3/2007 |
| JP | 2007-260161 | A | 11/2007 |
| JP | 2008-525103 | A | 7/2008 |
| JP | 2008-264564 | A | 11/2008 |
| JP | 2009-183411 | A | 8/2009 |
| WO | WO2006-025362 | A1 | 3/2006 |
| WO | WO 2006/071286 | A1 | 7/2006 |
| WO | WO2007-081244 | A1 | 7/2007 |
| WO | WO2007-116720 | A1 | 10/2007 |
| WO | WO2011-080938 | A1 | 7/2011 |
| WO | WO2011-080941 | A1 | 7/2011 |
| WO | WO2011-092880 | A1 | 8/2011 |
| WO | WO2011-118055 | A1 | 9/2011 |

OTHER PUBLICATIONS

Japanese language Pictorial Book, "How to Make Vol. 6 Commodities" Copyright Apr. 10, 1984.

Japanese language "Description of Evidence (4)" Copyright Dec. 17, 2012.

Nippon Paper Crecia Co., Ltd, "Description of Evidence (4)", Case of Claiming Injunction to Cease Infringing of Patent Right, Case No. Wa-6547, Tokyo District Court, Published Dec. 17, 2012, Japan Tokyo, p. 2-p. 3.

Alice Kan, "How to Make" Volume 6, Commodities 1, Evidence with Case of Claiming Injunction to Cease Infringing of Patent Right, Case No. Wa-6547, Tokyo District Court, Book Published Apr. 10, 1994, Japan, p. 16-19.

European search report, Application No. 10840796.6, dated Aug. 14, 2014, 7 Pages.

* cited by examiner (a)

(b)

METHOD OF MANUFACTURING SECONDARY PAPER ROLL FOR TISSUE PAPER PRODUCTS

This application is a continuation application of U.S. application Ser. No. 13/519,517, filed on Jun. 27, 2012, which is the national stage application of International Application Serial No. PCT/JP2010/062939, filed on Jul. 30, 2010, which claims priority from Japanese Application Serial No. 2010-095133, filed Apr. 16, 2010, and Japanese Application Serial NO. 2009-298281, filed Dec. 28, 2009, all of which are incorporated herein by reference.

TECHNICAL FIELD

The present invention relates to a method of manufacturing a secondary paper roll for tissue paper products provided for a multi-stand type interfolder.

BACKGROUND ART

A product in which tissue paper is packed in a box is generally manufactured in a manner such that plural continuous tissue paper overlap in a folded state by an interfolder (folding machine) and are cut into a predetermined length so as to obtain a tissue paper bundle and the tissue paper bundle is accommodated in a storage box (tissue carton).

As an example of the interfolder, there is known a multi-stand type interfolder disclosed in the following Patent Documents 1 and 2 or a rotary type interfolder disclosed in the following Patent Documents 3 and 4.

As a known example of a manufacturing method using the multi-stand type interfolder, the following method is known. That is, tissue paper is made in a paper making machine and is wound so as to manufacture a primary paper roll (which is generally called a jumbo roll). Subsequently, the primary paper roll is set on a ply machine, a single-sheet from a primary paper roll is wound so as to be multi-ply formed and slit (so as to be divided into each product width of the tissue paper products or several fold widths thereof in the width direction) so as to manufacture a secondary paper roll having plural plies.

The secondary paper roll manufactured in the ply machine is extracted from the ply machine, and is set on the multi-stand type interfolder as many as the necessary number. Subsequently, the multi-ply-sheet from the secondary paper roll is reeled out from the secondary paper roll and is sent to a folding mechanism unit so as to overlap in a folded state. Subsequently, the multi-ply-sheet from the secondary paper roll is cut into a predetermined length so as to form a tissue paper bundle, and the tissue bundle is accommodated in a storage box.

Since the manufacturing method using the multi-stand type interfolder includes plural (generally eighty to hundred) folding mechanisms compared to the other manufacturing method using a folding facility, there is a merit that the productivity is high.

Incidentally, in recent years, there has been an increasing demand for the application of chemicals such as a moisturizing agent or aroma chemicals to tissue paper products. For example, various manufacturing methods or facilities are proposed as disclosed in the following Patent Documents 5 to 7. In general, the tissue paper products are mainly manufactured by the rotary type interfolder (for example, the following Patent Document 5). However, since the rotary type interfolder performs both folding and cutting in a direction perpendicular to the processing direction, there is a demerit that the productivity is low.

CITATION LIST

Patent Document

Patent Document 1: U.S. Pat. No. 4,052,048 (Japanese Patent Application Publication No. 55-1215)

Patent Document 2: Japanese Patent Application Laid-Open No. 2006-240750

Patent Document 3: Japanese Patent Application Laid-Open No. S61-37668

Patent Document 4: Japanese Patent Application Laid-Open No. H5-124770

Patent Document 5: Japanese Patent Application Laid-Open No. 2004-322034

Patent Document 6: Japanese Patent Application National Laid-Open No. 2008-525103

Patent Document 7: Japanese Patent Application Laid-Open No. 2008-264564

DISCLOSURE OF INVENTION

Problem to be Solved by the Invention

Therefore, the inventors consider a manufacturing method in which tissue paper products coated with chemicals are manufactured by the multi-stand type interfolder having higher productivity compared to the rotary type interfolder. However, in a case of the manufacturing method using the multi-stand type interfolder, when a chemicals applying step is separately provided in addition to the ply machine or the multi-stand type interfolder, a problem arises in that it takes trouble for conveying a paper roll or considerable facility cost. Further, when the chemicals applying step is performed in the multi-stand type interfolder, there is a need to divide a line for manufacturing the tissue paper products coated with the chemicals and a line for manufacturing the tissue paper products coated with no chemicals.

Therefore, it is a main object of the invention to provide a method of manufacturing a secondary paper roll for tissue paper products used in a multi-stand type interfolder, the method of manufacturing the secondary paper roll for the tissue paper products being designed to apply chemicals at low cost and easily switch the execution of the application of the chemicals.

Means for Solving Problem

The means and the operation and effect thereof solving the above-described object are as below.

[Invention According to Claim 1]

A method of manufacturing a secondary paper roll for tissue paper products, the method continuously manufacturing a plurality of secondary paper rolls for tissue paper products from a primary paper roll, the method including: a multi-ply forming step of multi-ply forming single-sheets from primary paper rolls reeled out from a plurality of primary paper rolls along the continuous direction so as to form a multi-ply continuous sheet; chemicals applying step of applying chemicals to the multi-ply continuous sheet; a slitting step of slitting the multi-ply continuous sheet into each product width of the tissue paper products or several fold widths thereof; and a winding step of coaxially winding the respective slit multi-ply continuous sheets so as to form a plurality of secondary paper rolls of each product width of the tissue paper products or several fold widths thereof.

[Invention According to Claim 2]

The method of manufacturing the secondary paper roll for the tissue paper products according to claim 1, wherein the chemicals applying step is performed after the multi-ply forming step and before the slitting step.

[Invention According to Claim 3]

The method of manufacturing the secondary paper roll for the tissue paper products according to claim 2, wherein a calendering step of performing a calendering process using a calender is performed between the multi-ply forming step and the chemicals applying step.

[Invention According to Claim 4]

The method of manufacturing the secondary paper roll for the tissue paper products according to claim 2, wherein a ply bonding step of performing linear ply bonding for preventing interlayer peeling on the multi-ply continuous sheet is performed between the chemicals applying step and the slitting step.

[Invention According to Claim 5]

The method of manufacturing the secondary paper roll for the tissue paper products according to claim 1, wherein the application of the chemicals is performed by flexographic printing.

[Invention According to Claim 6]

The method of manufacturing the secondary paper roll for the tissue paper products according to claim 5, wherein the conveying speed of the multi-ply continuous sheet when applying the chemicals using the flexographic printing is set to 700 m/minute or more.

Effect of the Invention

Plural secondary paper rolls for the tissue paper products which are manufactured so as to have each product width of the tissue paper products or several fold widths thereof in the slitting step in the manufacturing method according to the invention are set on the multi-stand type interfolder at the rear stage. Subsequently, the multi-ply-sheet from the secondary paper roll, reeled out from the secondary paper roll set on the multi-stand type interfolder, is sent to the folding mechanism unit so as to overlap in a folded state, is cut into a predetermined length so as to obtain the tissue paper bundle, and is accommodated in a storage box.

In the invention, according to the method of manufacturing the secondary paper roll for the tissue paper products, the chemicals are applied to the multi-ply continuous sheet. For this reason, it is possible to suppress facility cost so as to be low compared to the case where the chemicals applying step is separately provided in addition to the ply machine or the multi-stand type interfolder. Further, in a case where the tissue paper products coated with no chemicals are manufactured, only the chemicals applying step may be removed from the process of manufacturing the secondary paper roll for the tissue paper products, whereby the facility may be easily switched.

In the method of manufacturing the secondary paper roll for the tissue paper products according to the invention, it is desirable to perform the chemicals applying step after the multi-ply forming step and before the slitting step. In this case, when the chemicals applying step is performed before the multi-ply forming step, there is a need to provide a facility for applying the chemicals to each single-sheet from the primary paper roll. On the other hand, when the chemicals applying step is performed after the slitting step, the chemicals are applied to the multi-ply continuous sheet divided into plural sheets by the slitting step. For this reason, the chemicals leak from the slit, which contaminates the roll or chips the tissue paper. When the chemicals applying step is performed between the multi-ply forming step and the slitting step, a facility may be provided only to apply the chemicals to the multi-ply continuous sheet which is not divided by the slitting step. Accordingly, the loss of the chemicals is small, the chipped tissue paper less occurs, and the work is stabilized.

In the method of manufacturing the secondary paper roll for the tissue paper products according to the invention, it is desirable to provide the calendering step of performing the calendering process using the calender. Since the calendering step is provided, the secondary paper roll for the tissue paper products may be manufactured so as to have a smooth surface.

Furthermore, it is desirable to perform the calendering step between the multi-ply forming step and the chemicals applying step. In a case where the calendering step is provided before the multi-ply forming step, when there are not provided two facilities for calendering the outer surface of the outer sheet of at least the multi-ply formed sheet, the same effect as that of the calendering step performed once after the multi-ply forming step is not obtained. Further, when the same smoothness is obtained on the surfaces of two sheets as the outer layers by two calenders, the paper thickness is damaged.

In the method of manufacturing the secondary paper roll for the tissue paper products according to the invention, it is desirable to provide the ply bonding step of performing the linear ply bonding for preventing the interlayer peeling on the multi-ply continuous sheet.

It is desirable to perform the ply bonding step before the slitting step. When the ply bonding step is performed after the slitting step, the ply bonding is applied to the multi-ply continuous sheet which is slit in each product width, and the ply bonding is performed at two positions (two lines) at the end portions of the multi-ply continuous sheet in each product width. In this case, the tissue paper is easily chipped compared to the case of the ply bonding in the entire width.

In the method of manufacturing the secondary paper roll for the tissue paper products according to the invention, the chemicals application method may use all known application methods according to dipping, spray-coating, flexographic printing, and gravure printing. However, among these, the flexographic printing is desirable, and the flexographic printing using a doctor chamber is particularly desirable. In the flexographic printing, a flexographic press plate roll is formed of a resin, and even when the processing speed is high, the application amount may be stabilized so as to correspond to the unevenness of the crepe paper. Further, when the lines per inch or the cell capacity of the anilox roll and the lines per inch or the peak area ratio of flexographic press plate roll are changed, the application amount may be easily stabilized so as to correspond to the wide range of viscosity of the chemicals. In the doctor chamber type, chemicals are directly applied to the surface of an anilox roll (transfer concave roll) so as to form a coating thereon. In this case, paper dust or air is not easily mixed with the chemicals and the property of the chemicals is easily stabilized. Furthermore, the chemicals transferred from the anilox roll are uniform, and a small amount of lotion may be optimally applied to the crepe paper.

BRIEF DESCRIPTION OF DRAWINGS

FIG. 6(*b*) is a partially cutaway diagram illustrating a state where the tissue paper received in the storage box is taken out.

FIG. 18(A) illustrates a structure having two introduction portions and one guide portion, FIG. 18(B) illustrates a structure having three introduction portions and two guide portions, and FIG. 18(C) illustrates a structure in which the introduction portions are present as many as the number of the guide portions.

FIG. 24(A) is a cross-sectional view in the direction MD before the application of chemicals, FIG. 24(B) is a top view before a chemicals permeating step, and FIG. 24(C) is a diagram when seen along the line I-I.

FIG. 25(A) illustrates a state before the application of the chemicals and FIG. 25(B) illustrates a state after the application of the chemicals.

BEST MODE(S) FOR CARRYING OUT THE INVENTION

Figure 1:
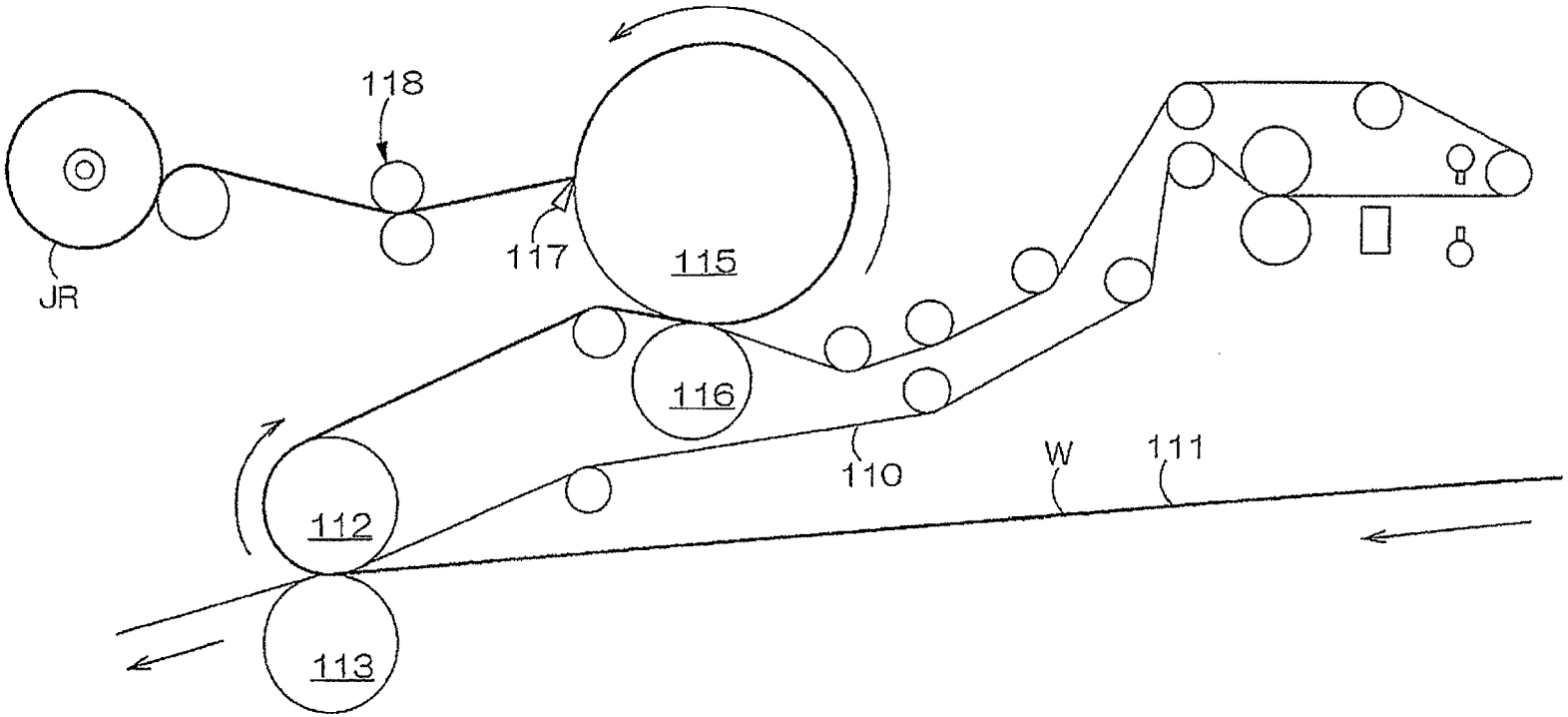
FIG. 1 is a schematic diagram illustrating a facility and a method of manufacturing a primary paper roll.

Next, embodiments of the invention will be described. Furthermore, the arrow HD of the drawing indicates the horizontal direction, and the arrow LD indicates the vertical direction.

[Method of Manufacturing Primary Paper Roll]

An example of a method of manufacturing a primary paper roll will be described by referring to FIG. 1.

As illustrated in FIG. 1, a wet paper W which undergoes a wire part is conveyed on a bottom felt 111, and passes between a top roll 112 and a bottom roll 113 while being nipped between the top felt 110 and the bottom felt 111 so as to squeeze water therefrom. Subsequently, the wet paper W from which water is squeezed is attached onto the surface of the Yankee dryer 115 through a touch roll 116 while being loaded on the top felt 110. Then, the wet paper W is dried by the Yankee dryer 115, is pulled away therefrom by a doctor blade 117, and is wound, thereby forming a primary paper roll JR.

When making paper, for example, appropriate chemicals such as a dispersing agent, a dry paper strengthening agent, a wet paper strengthening agent, a softening agent, a separating agent, an adhesive agent, a pH adjuster such as caustic soda, an antifoaming agent, an antiseptic agent, a slime control agent, and a dye may be added.

Furthermore, in the method of manufacturing the primary paper roll, the paper which is pulled away by the doctor blade 117 may be calendered by a calender unit 118.

[Facility for Manufacturing Secondary Paper Roll for Tissue Paper Products]

Figure 11:
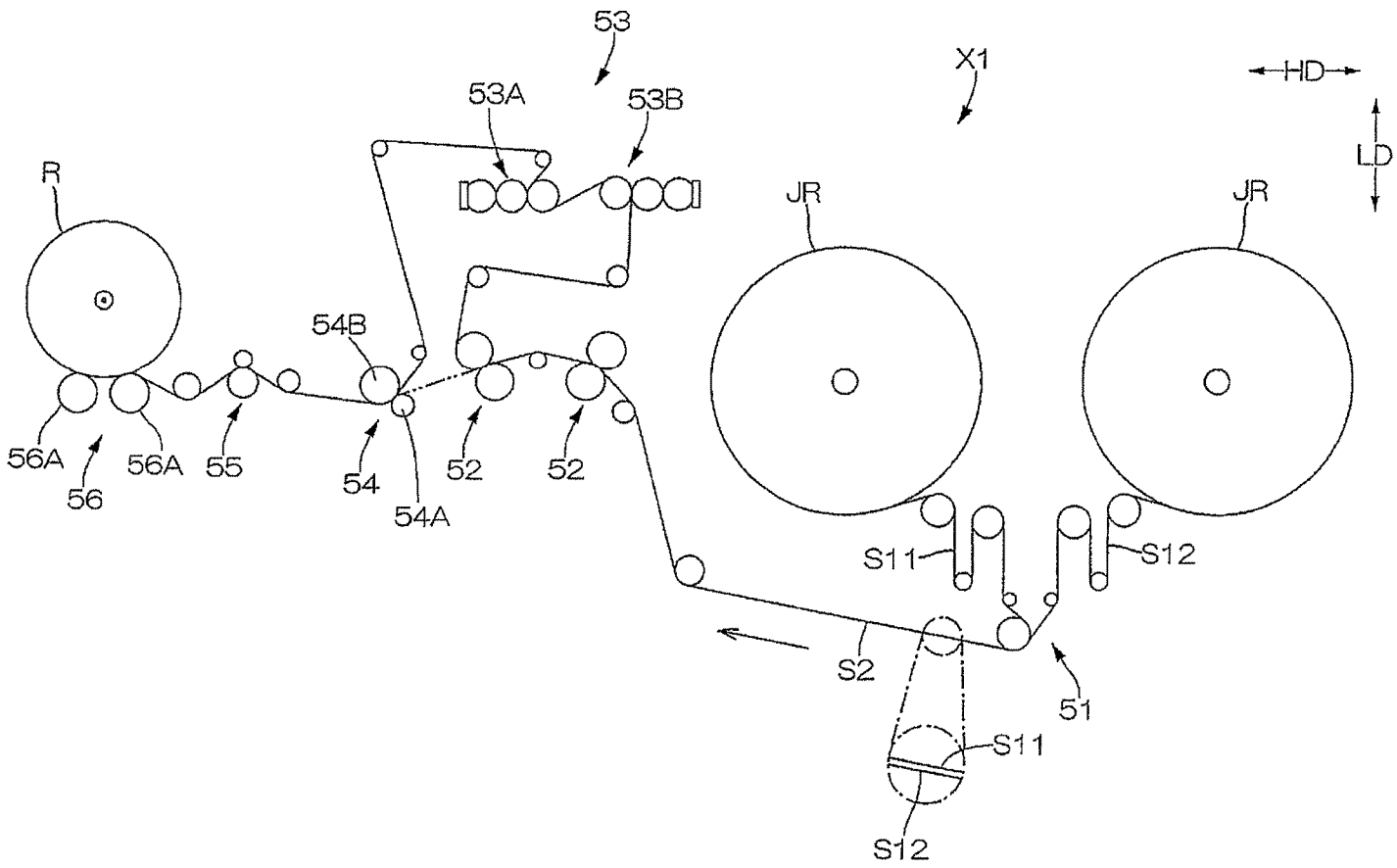
FIG. 11 is a schematic diagram illustrating a facility and a method of manufacturing a secondary paper roll.

As illustrated in FIG. 11, a facility X1 (ply machine X1) for manufacturing a secondary paper roll for tissue paper products according to the invention includes a ply unit 51 which sets at least two primary paper rolls JR manufactured by the above-described manufacture method and multi-ply forms single-sheets (S11 and S12 in the example illustrated in the drawing) from primary paper rolls reeled out from the primary paper rolls JR in the continuous direction so as to form a multi-ply continuous sheet S2.

The rear stage of the ply unit 51 is provided with a pair of chemicals applying units 53 which applies chemicals to the multi-ply continuous sheet S2 flowing from the ply unit 51, and the rear stage of the chemicals applying units 53 is provided with a slitting unit 55 which includes plural cutters arranged in parallel and slits the multi-ply continuous sheet S2 conveyed from a chemicals applying unit 53 into each product width of the tissue paper products or several fold widths thereof. Then, the rear stage of the slitting unit 55 is provided with a winding unit 56 which coaxially winds the multi-ply continuous sheets S2 slit by the slitting unit 55 so as to form plural secondary paper rolls R of each product width or the several fold widths of the tissue paper products. Here, the winding unit 56 includes two winding drums 56A which guide the respective slit multi-ply continuous sheets S2 to the secondary paper roll R, and the two winding drums 56A guide the multi-ply continuous sheets S2 while coming into contact with the outer peripheral surface of the secondary paper roll R.

(Calender Unit)

The facility X1 for manufacturing the secondary paper roll for the tissue paper products may be provided with one or more calender units 52 which perform a calender process on the multi-ply continuous sheets S2.

The type of the calender in the calender unit 52 is not particularly limited, but it is desirable to adopt a soft calender or a cooling calender due to the improvement in smoothness of the surface and the adjustment of the paper thickness. The soft calender is a calender which uses a roll coated with an elastic material such as urethane rubber, and the cooling calender is a calender which is configured as a metal roll.

The number of the calender units 52 may be appropriately changed. There is a merit that the smoothness is sufficiently obtained even at a high processing speed when plural calender units are installed. On the other hand, there is a merit that the calender unit may be installed even at a narrow space when one calender unit is installed.

In a case where two or more calender units 52 are installed, the calender units may be installed in parallel along the horizontal direction, the vertical direction, or the inclined direction, and may be arranged by the combination of the installation directions. When the calender units are installed in parallel along the horizontal direction, the holding angle decreases, so that the process may be performed at a high speed. When the calender units are installed in parallel along the vertical direction, the installation space may be decreased. Furthermore, the holding angle which is mentioned herein indicates an angle at which the sheet contacts the roll when seen from the axis of the roll (a part of a circular arc of the cross section direct to the axis) (the same applies to the following description).

The paper making is performed based on control factors such as a calender type, a nip line pressure, and the number of nips in a calender process condition, and it is desirable to appropriately change the control factors depending on the quality of the demanded tissue paper, that is, a paper thickness or a surface nature.

Further, the installation position of the calender unit 52 is not particularly limited, but may be the rear stage of the ply unit 51 and the front stage of the chemicals applying unit 53 or the rear stage of the chemicals applying unit 53 and the front stage of a ply bonding unit 54.

(Chemicals Applying Unit)

In the facility or the method of manufacturing the secondary paper roll for the tissue paper products according to the embodiment, in a case where chemicals are applied to both surfaces of the multi-ply continuous sheet S2, the total chemicals application amount of both surfaces is 1.5 to 5.0 g/m$^2$, desirably 2.0 to 4.5 g/m$^2$, and more desirably 2.5 to 4.0 g/m$^2$. When the amount is more than 5.0 g/m$^2$, degradation in paper strength, stretching, or the like occurs, which makes a chipped tissue paper, causes a winding deviation when winding the tissue paper on the winding drum, or an excessive sticky sensation in quality. When the amount is less than 1.5 g/m$^2$, there is no difference in quality with respect to non-coated products in the sensation of smoothness or wetness.

Furthermore, in a case where there is a difference in the application amount between both coated surfaces, the chemicals amount between both coated surfaces gradually becomes equal to each other and a difference between front and rear surfaces gradually decreases on the ground that the tissue paper coated with the chemicals is received in the ply web and both coated surfaces come into contact with the ply web until the folding process is performed (for eight hours or more).

In a case where the chemicals are applied to only one surface of the multi-ply continuous sheet S2, the surface coated with the chemicals may be the surface positioned on the inside of the secondary paper roll R in the multi-ply continuous sheet S2 (the surface on the side of the single-sheet S11 from the primary paper roll). In this configuration, there is a difference between the front and rear surfaces, but the winding deviation does not easily occur. In this case, the application amount is 1.5 to 5.0 g/m$^2$, desirably 2.0 to 4.5 g/m$^2$, and more desirably 2.5 to 4.0 g/m$^2$.

Figure 24:
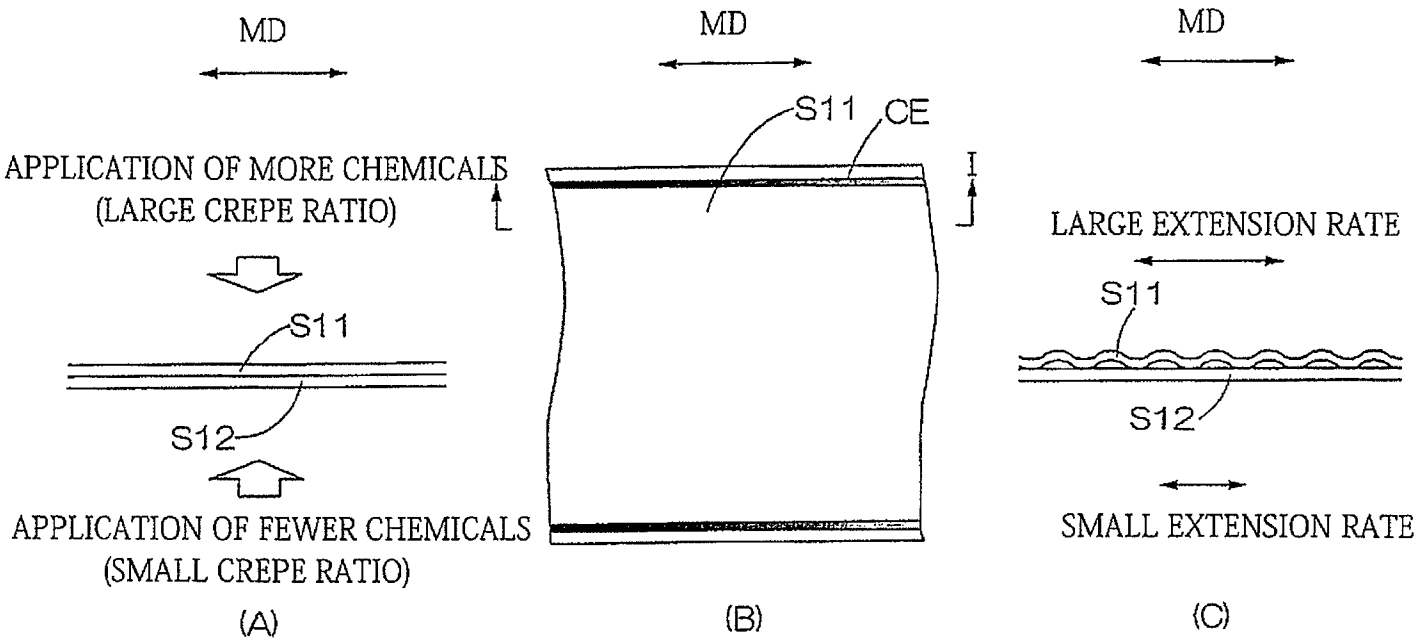
FIG. 24 is a schematic diagram illustrating a structure of a multi-ply continuous sheet (tissue paper).

Further, in a case where there is a difference in the crepe ratio between the respective single-sheets from primary paper rolls forming the multi-ply continuous sheet S2, it is proposed that the more chemicals are applied to the single-sheet S11 from the primary paper roll having a high crepe ratio (the single-sheet S11 from the primary paper roll in the example illustrated in the drawing). For example, in the example illustrated in FIGS. 11 and 24, two chemicals applying units 53 are configured so that the chemicals applying unit 53B directly applying the chemicals to the single-sheet S11 from the primary paper roll, applies the larger amount of the chemicals than that of the other chemicals applying unit 53A. In this case, the ratio of the chemicals application amount between both surfaces is set to 100:0 to 60:40 and desirably 75:25 to 60:40.

FIG. 24(A) is a cross-sectional view of the multi-ply continuous sheet S2 which is multi-ply formed as two plies before the application of the chemicals (a cross-sectional view cut away in the direction parallel to the direction MD). When applying the chemicals to both surfaces of the multi-ply continuous sheet S2 formed in two plies, a difference in the chemicals amount is formed between both surfaces, and the more chemicals are applied to the single-sheet S11 from the primary paper roll in the drawing. Before the multi-ply continuous sheet S2 is stretched after the application of the chemicals, the multi-ply formed structure is integrated by ply bonding (contact emboss) CE, and is cut into each product width by a slitting unit 55 (FIG. 24(B)). Subsequently, the multi-ply continuous sheet S2 is wound by a winding unit 56, and is kept in a stopped state so that the chemicals permeate the multi-ply continuous sheet. The single-sheets S11 and S12 from the primary paper rolls, which constitute the multi-ply continuous sheet S2 to which the chemicals are applied from the chemicals applying unit 53 mainly extend in the direction MD. At this time, the extension rate of the single-sheet from the primary paper roll, coated with the more chemicals becomes larger than the extension rate of the other single-sheet from the primary paper roll. However, since the single-sheets S11 and S12 from the primary paper rolls, are fixed to each other by the ply bonding CE, wrinkles are formed on the surface of the more stretched single-sheet S11 from the primary paper roll (FIG. 24(C)). When a difference in the crepe ratio of the multi-ply continuous sheet S2 is provided and the base paper having a high crepe ratio is used in the single-sheet S11 from the primary paper roll, a difference in the extension rate between the single-sheet S11 from the primary paper roll and the single-sheet S12 from the primary paper roll may be further increased.

The crepe is formed by a difference in speed when a manner such that the base paper is dried in the Yankee dryer 115, is peeled from the Yankee dryer 115 by the doctor blade 117, and is wound at a dryer speed. The shape of the crepe is adjusted by the adhering of paper to the Yankee dryer 115, but since a slight variation in the adhering is present or a fibrous raw material is not evenly distributed, there is a sterically slight variation in the crepe shape from the microscopic viewpoint. The variation becomes more apparent as the crepe ratio becomes larger.

Here, the crepe ratio is defined by the following equation.

Crepe ratio:((circumferential speed of dryer during paper making)−(reel circumferential speed))/(circumferential speed of dryer during paper making)×100

A variation in the growth also occurs when applying the chemicals with a variation in the crepe, which is three-dimensionally formed as a minute ripple. The ripple is not visually observed due to the tension exerted when seasoning the paper roll, but is restored so as to be visually observed after processing and trimming the products. As the application amount of the chemicals to the sheet increases and the crepe increases, a variation in the crepe shape and the ripple of the sheet are large. In contrast, as the application amount of the chemicals to the sheet decreases and the crepe decreases, a variation in the crepe shape and the ripple of the sheet are small. For this reason, the bulking effect may be improved by changing not only the application amount but also the crepe ratio.

Figure 25:
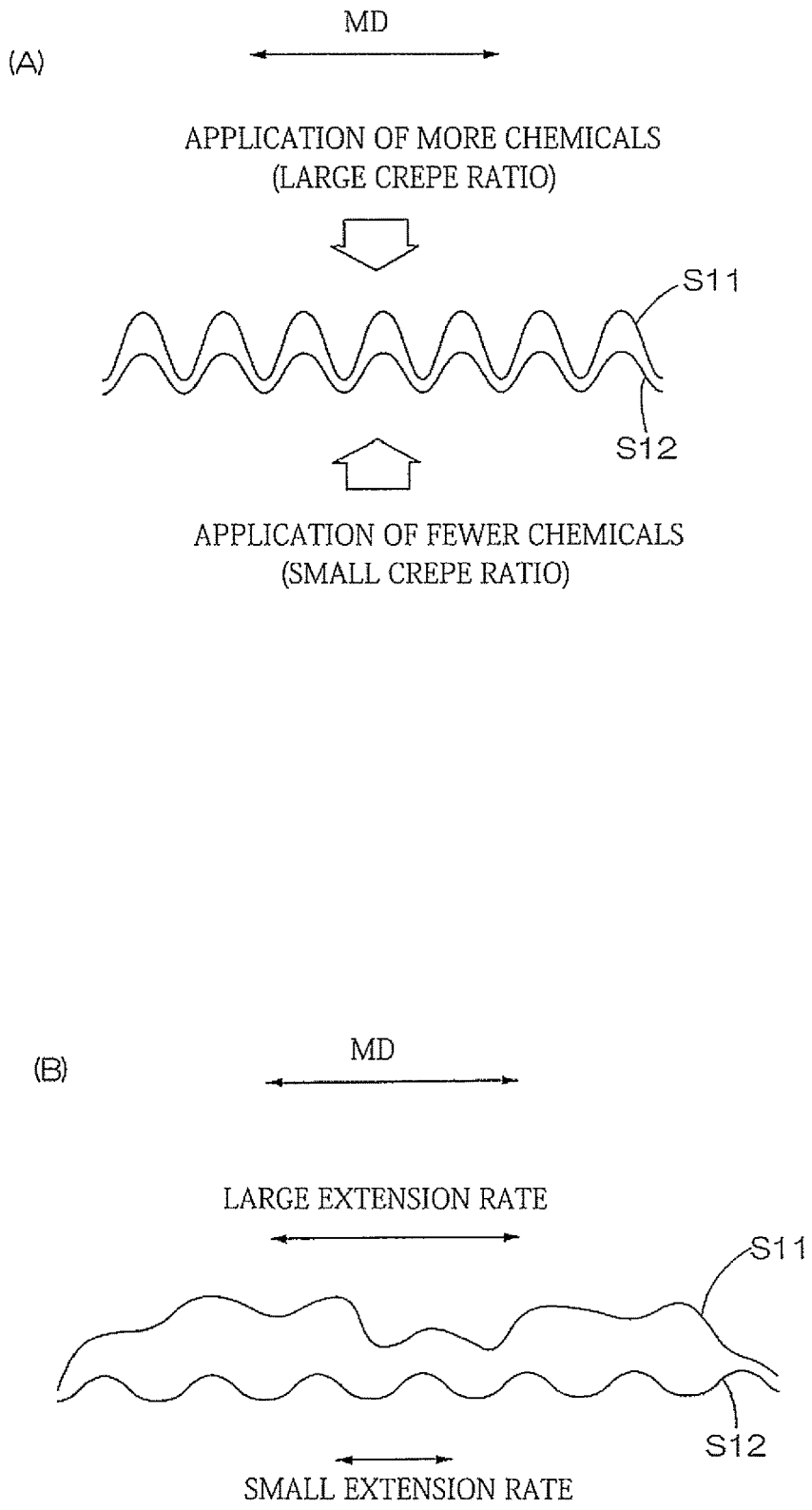
FIG. 25 is a schematic diagram illustrating a surface uneven structure of a multi-ply continuous sheet (tissue paper).

Further, with regard to the quality, in a case where products are formed by multi-ply forming the single-sheets S11 and S12 from the primary paper rolls, having different crepe ratios, when the application of the chemicals is not performed, the tissue paper as the products has a different sensation of bulk on both surfaces (FIG. 25(A)). However, when the more chemicals are applied by the single-sheet S11 from the primary paper roll, having the larger unevenness of the surface (the high crepe ratio), the single-sheet S11 from the primary paper roll, is stretched with the higher stretching rage than that of the single-sheet S12 from the primary paper roll. However, since the single-sheet from the primary paper roll is fixed to be parallel to the direction MD by ply bonding (not shown), the single-sheet S11 from the primary paper roll is rippled and the volume of the multi-ply formed sheet increases (FIG. 25(B)).

Figure 26:
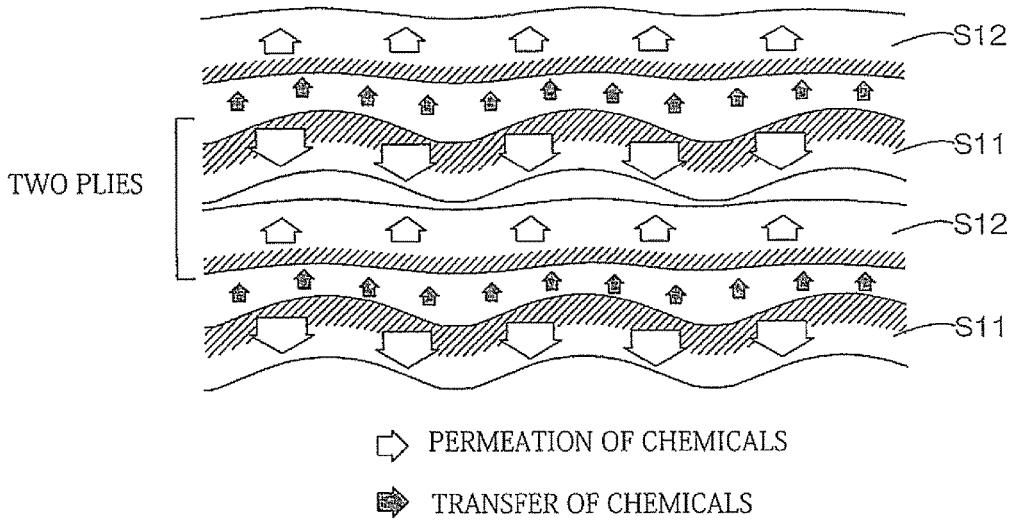
FIG. 26 is a schematic diagram illustrating a chemicals permeating step.

When a difference in the chemicals application amount is provided, there is a concern that the sensation of touch and the usability may be different between both surfaces. However, when the secondary paper roll R is kept in a roll state before it is provided for the next step (folding step or the like), the secondary paper roll is held so that the surfaces of the single-sheets S11 and S12 from the primary paper rolls, having different chemicals application amounts face each other (the chemicals permeating step in FIG. 26). Accordingly, the chemicals component between these single-sheets is slightly transferred (the gray arrow of the drawing), and the difference is reduced during the seasoning. Furthermore, the white arrow of FIG. 26 indicates the permeation direction of the chemicals component.

On the other hand, the type of chemicals applying unit 53 is not particularly limited, but printing such as gravure printing or flexographic printing may be used.

In the facility or the method of manufacturing the secondary paper roll for the tissue paper products, when the chemicals applying unit 53 of the gravure printing is used, the processing speed is set to 100 to 1000 m/minute, desirably 350 to 950 m/minute, and particularly desirably 450 to 950 m/minute. In a case of less than 100 m/minute, the productivity is low. In a case of more than 1000 m/minute, a variation in the application occurs, and the chemicals easily scatter. Further, the lines per inch of the gravure roll is set to 40 to 160 lines, desirably 60 to 140 lines, and particularly desirably 80 to 120 lines. In a case of less than 40 lines, the chemicals scattering amount increases. On the other hand, in a case of more than 160 lines, jamming may be easily caused by paper dust.

In the facility or the method of manufacturing the secondary paper roll for the tissue paper products, when the chemicals applying unit 53 of the flexographic printing is used, the processing speed is set to 100 to 1100 m/minutes, desirably 350 to 1050 m/minutes, and particularly desirably 450 to 1000 m/minutes. In a case of less than 100 m/minutes, the productivity is low. On the other hand, in a case of 1100 m/minute or more, a large variation in the application occurs, and the chemicals scattering amount increases. The lines per inch of the flexographic press plate roll is set to 10 to 60 lines, desirably 15 to 40 lines, and particularly desirably 20 to 35 lines. When the lines per inch are less than 10 lines, a large variation in the application occurs. On the other hand, when the lines per inch become more than 60 lines, a jamming may be easily caused by paper dust. The lines per inch of the anilox roll is set to 10 to 300 lines, desirably 25 to 200 lines, and particularly desirably 50 to 100 lines. When the lines per inch are less than 10 lines, a large variation in the application occurs. On the other hand, when the lines per inch become more than 300 lines, a jamming may be easily caused by paper dust. The cell capacity of the anilox roll is set to 10 to 100 cc, desirably 15 to 70 cc, and particularly desirably 30 to 60 cc. When the cell capacity is less than 10 cc, the desired application amount is not obtained. On the other hand, when the cell capacity becomes more than 100 cc, the scattering amount of the chemicals increases.

In the flexographic printing, the application amount may be stabilized even when the processing speed is high and the application may be stably performed in a wide range of viscosity of the chemicals using a single roll.

When the chemicals applying unit 53 of the gravure printing is used, a direct gravure coater or an offset gravure coater may be used. When the flexographic printing is used, the doctor chamber type (hereinafter, simply referred to as a doctor chamber type) or a single or double roll transfer type may be used.

Single or plural chemicals applying unit or units 53 using the printing such as the gravure printing or the flexographic printing may be provided. When plural chemicals applying units are provided, the chemicals applying units may be arranged in the horizontal direction, the vertical direction, or the inclined direction or may be arranged in the direction obtained by the combination of the installation directions including the horizontal direction. When the chemicals applying units are arranged in the horizontal direction, the holding angle may be decreased, so that the processing speed may be set to be high. When the chemicals applying units are arranged in the vertical direction, the installation space in the horizontal direction may be decreased.

It is desirable that the units disposed before and after the chemicals applying unit 53 (the calender unit 52 and the ply bonding unit 54 in the example of FIG. 11) be arranged so as to be adjacent to each other. In this case, in a case where the tissue paper products coated with no chemicals are manufactured, the multi-ply continuous sheet S2 may be directly conveyed from the front stage of the chemicals applying unit 53 to the rear stage thereof, so that the multi-ply continuous sheet S2 may flow without passing through the chemicals applying unit 53. Accordingly, it is possible to easily switch the execution of the application of the chemicals. For example, in the facility X1 for manufacturing the secondary paper roll for the tissue paper products illustrated in FIG. 11, in a case where the tissue paper products coated with no chemicals are manufactured, the multi-ply continuous sheet S2 may be directly conveyed from the calender unit 52 to the ply bonding unit 54 as depicted by the two-dotted chain line of FIG. 11, so that the multi-ply continuous sheet S2 may flow without passing through the chemicals applying unit 53.

<First Embodiment of Doctor Chamber>

Here, an example of a doctor chamber type of flexographic printing will be described.

Figure 12:
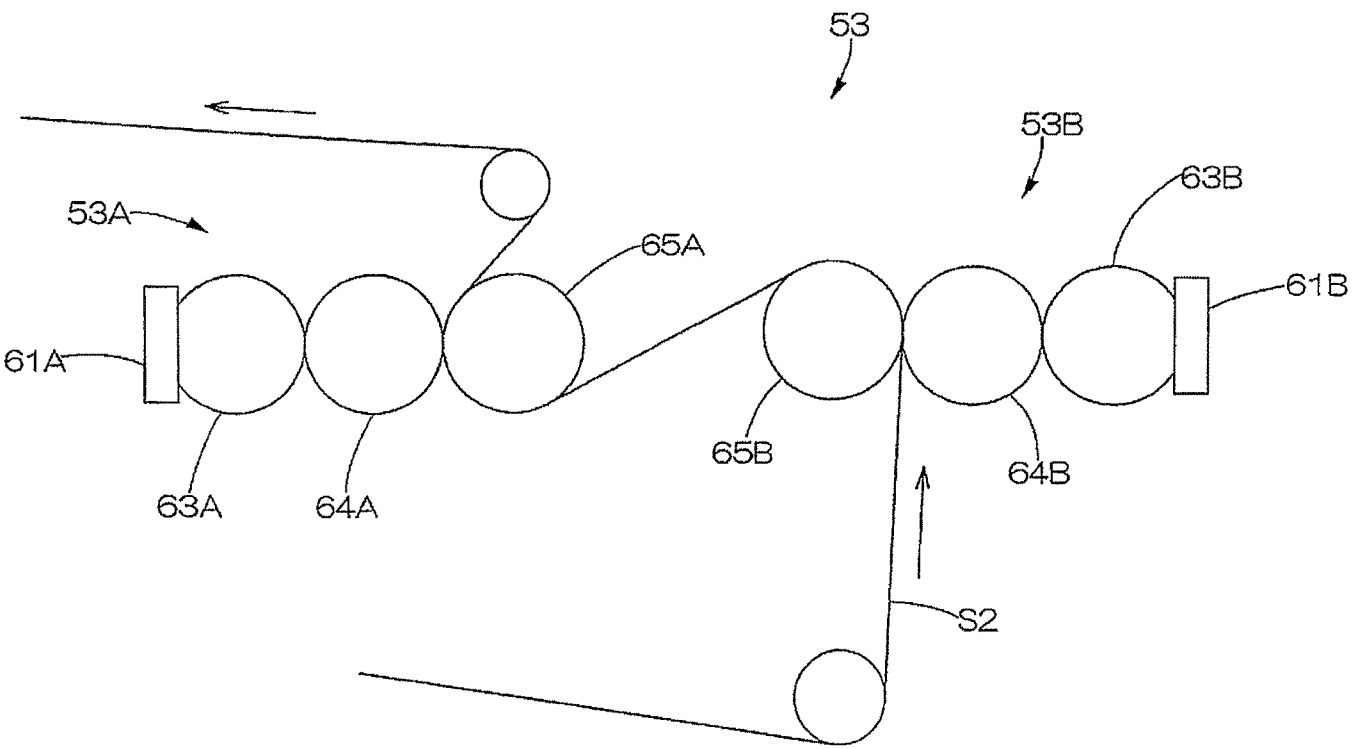
FIG. 12 is a main enlarged diagram illustrating the periphery of a chemicals applying unit illustrated in FIG. 11.

As illustrated in FIG. 12, one chemicals applying portion 53A of a doctor chamber type has a configuration in which a doctor chamber 61A storing chemicals therein is disposed so as to face a rotatable anilox roll 63A and the chemicals are transferred from the doctor chamber 61A to the anilox roll 63A. Further, a press plate roll 64A which comes into contact with not only the anilox roll 63A but also one surface of the multi-ply continuous sheet S2 is installed so as to be rotatable, and the chemicals are transferred from the anilox roll 63A to the press plate roll 64A. Furthermore, the chemicals are applied from the press plate roll 64A to the multi-ply continuous sheet S2 while a pressure is applied from an elastic roll 65A which faces the press plate roll 64A with the multi-ply continuous sheet S2 interposed therebetween to the multi-ply continuous sheet S2.

Then, in the embodiment, the chemicals applying portion 53A is positioned on the side of the surface of the multi-ply continuous sheet S2 so as to face a roll 54A of a ply bonding unit 54 to be described later and face a winding drum 56A described above. Furthermore, the doctor chamber 61A is provided with a supply pump (not shown) which applies the chemicals to the above-described doctor chamber 61A and a discharge supply pump (not shown) which returns the chemicals from the doctor chamber 61A.

On the other hand, as illustrated in FIG. 12, the other chemicals applying portion 53B of a doctor chamber type has a configuration in which a doctor chamber 61B storing chemicals is disposed so as to face a rotatable anilox roll 63B and the chemicals are transferred from the doctor chamber 61B to the anilox roll 63B. Further, a press plate roll 64B which comes into contact with not only the anilox roll 63B but also the other surface of the multi-ply continuous sheet S2 is installed so as to be rotatable, and the chemicals are transferred from the anilox roll 63B to the press plate roll 64B. Furthermore, the chemicals are applied from the press plate roll 64B to the multi-ply continuous sheet S2 while a pressure is applied from an elastic roll 65B which faces the press plate roll 64B with the multi-ply continuous sheet S2 interposed therebetween to the multi-ply continuous sheet S2.

Then, in the embodiment, the chemicals applying portion 53B is positioned on the side of the other surface of the multi-ply continuous sheet S2 so as not to face the roll 54A and the above-described winding drum 56A. Furthermore, the doctor chamber 61B is also provided with a supply pump (not shown) which applies the chemicals to the above-described doctor chamber 61B and a discharge supply pump (not shown) which returns the chemicals from the doctor chamber 61B.

Accordingly, the chemicals are respectively applied from the chemicals applying portion 53A and the chemicals applying portion 53B to both surfaces of the multi-ply continuous sheet S2. However, at this time, the chemicals may be applied from both surfaces of the multi-ply continuous sheet S2 to the respective multi-ply continuous sheets S2 while decreasing the application amount to the surface of the multi-ply continuous sheet S2 facing the roll 54A using the chemicals applying portion 53A with respect to the application amount of the other surface thereof using the chemicals applying portion 53B.

Here, as described above, in a case where the total application amount of both surfaces is set to 1.5 to 5 g/m$^2$ and the application amount of the secondary paper roll R as the ply paper roll is decreased more than the application amount of the inner peripheral surface of the secondary paper roll R, the application amount to the outer peripheral surface of the secondary paper roll R is desirably set to be equal to or more than 20% and less than 50% in the total application amount of the lotion with respect to both surfaces of the paper, but the specific value changes in the above-described range since the optimal condition becomes different due to the slippage and the quality balance of the secondary paper roll R, the thickness of the sheet or the permeability of the lotion thereto, and the metastatic property.

Specifically, a configuration may be supposed in which the application amount for each surface is changed, the lines per inch of the flexographic plate is set to 15 to 40 lines, and the peak area ratio is set to 20 to 40% or so as a rough extent in which the chemicals do not scatter. With such a configuration, the dot pattern immediately after the application is left, and an application portion and a non-application portion are instantly formed.

Accordingly, according to the embodiment, since the flexographic printing is used, the plate is resin and has elasticity. Accordingly, even when the sanitary tissue paper is slightly uneven, the unevenness may be adjusted by a printing pressure, whereby the multi-ply continuous sheet S2 is not easily wrinkled. On the other hand, since the flexographic printing is used, even when the processing speed is high, the application amount may be stabilized and the application may be stably performed in a wide range of viscosity of the chemicals using a single roll. Specifically, even when the lotion as the chemicals is applied with the application amount in the range to be described later while the multi-ply continuous sheet S2 is conveyed at the speed of 700 m/minute or more and desirably 900 m/minute or more, the application may be uniformly performed and the multi-ply continuous sheet S2 may be extracted without any meandering.

Further, the requirement of the chemicals applying unit 53 concerned with the embodiment may be considered as below.

In the chemicals applying unit of the double roll flexographic type, there is a need to install a filtering device for paper dust or air contained in the chemicals circulating inside an application device such as a chemicals tank. However, in a case of the chemicals applying unit 53 of the doctor chamber type of the embodiment, since paper dust and the like decrease, it may be considered that the load of the filtering device is reduced. Furthermore, there is a need to control the temperature of the chemicals inside the application device such as the doctor chambers 61A and 61B and stabilize the viscosity of the chemicals. However, a heater may be installed in the intermediate tank and the pipe connected to the doctor chambers 61A and 61B. On the other hand, there is a need to manage the application amount based on the moisture percentage of the multi-ply continuous sheet S2 in the width direction in operation. However, the moisture amount and the variation in the width direction may be managed at all times by, for example, an infrared inspection equipment or the like.

<Second Embodiment of Doctor Chamber Type>

Next, a specific structure of a second embodiment of a doctor chamber type will be described in detail below.

Furthermore, a chemicals supply device 100 will be described in detail below which has a structure obtained by selecting only one of the two chemicals applying portions 53A and 53B constituting the above-described chemicals applying unit 53 using the flexographic printing of the doctor chamber type. However, it is needless to mention that the other of the chemicals applying portions 53A and 53B also has the same structure. Furthermore, the horizontal direction of the chemicals supply device 100 illustrated in FIG. 14 is defined as the X direction, and the vertical direction is defined as the Y direction.

Figure 14:
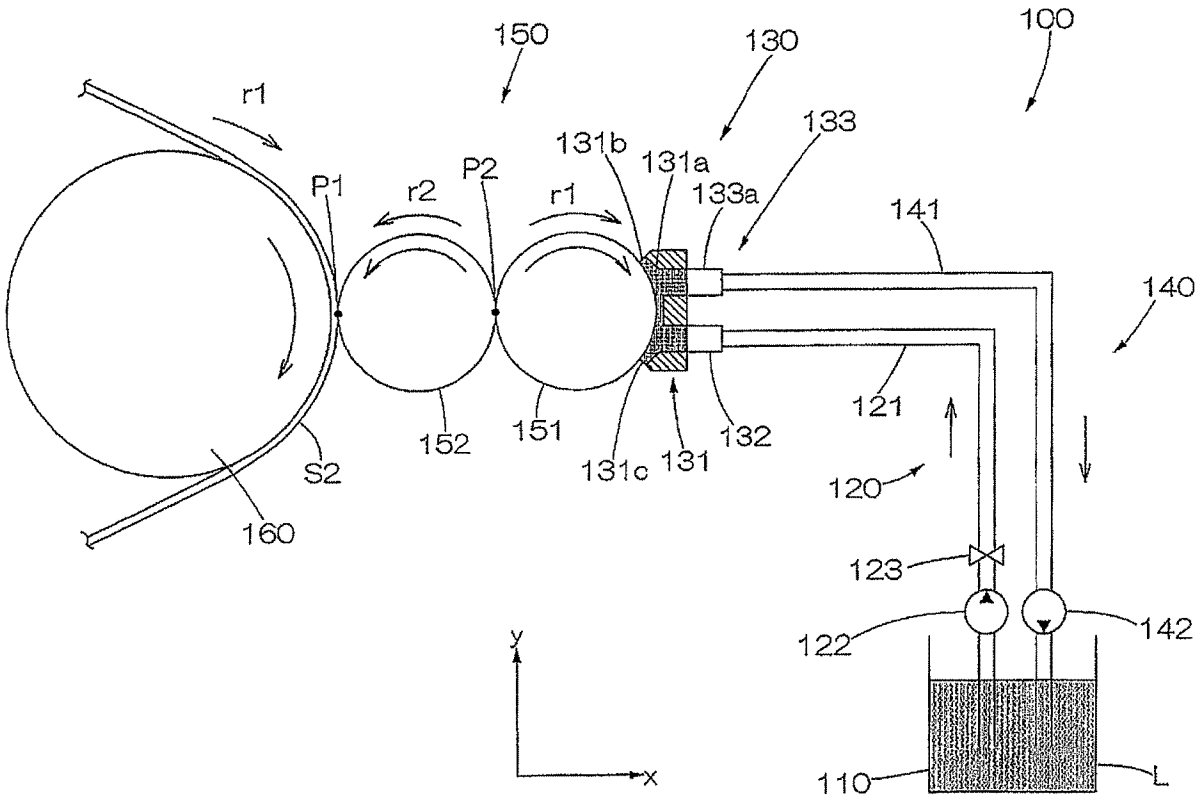
FIG. 14 is a schematic configuration diagram illustrating an example of a chemicals supply device.
Figure 15:
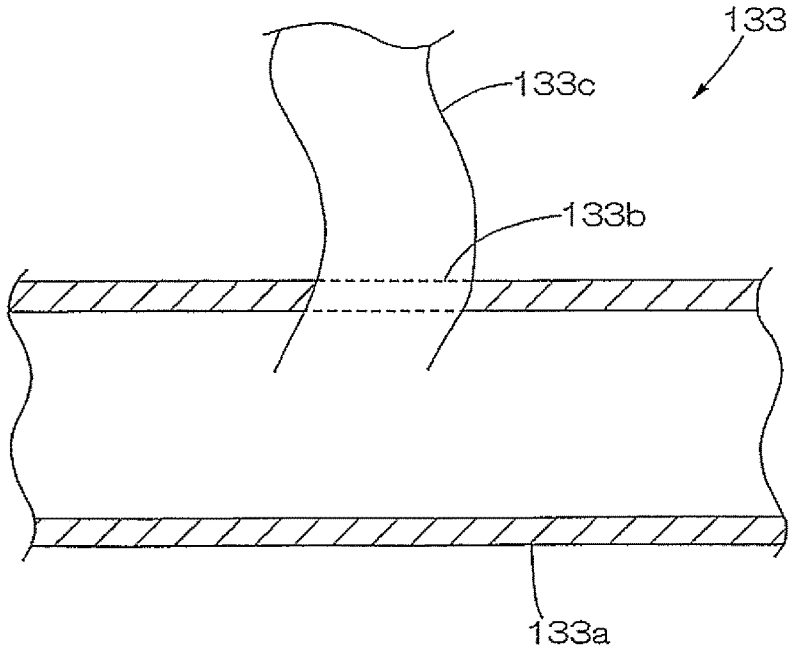
FIG. 15 is a schematic diagram illustrating a guide portion of the chemicals supply device of FIG. 14.

That is, as illustrated in FIGS. 14 and 15, the chemicals supply device 100 includes a storage tank 110 which stores chemicals L, an extruding unit 120 which extrudes the chemicals L inside the storage tank 110, a doctor chamber 130 which stores the chemicals L extruded from the extruding unit 120, a drawing unit 140 which draws a part of the chemicals L stored in the doctor chamber 130 into the tank 110, a chemicals transfer unit 150 which transfers the chemicals L supplied from the doctor chamber 130 onto the surface of the multi-ply continuous sheet S2, a rotation portion 160 which winds the multi-ply continuous sheet S2 on the peripheral surface thereof and rotates the multi-ply continuous sheet, and the like.

Accordingly, the above-described doctor chambers 61A and 61B are configured as the doctor chamber 130 in the embodiment, and the above-described elastic rolls 65A and 65B are configured as the rotation portion 160 in the embodiment.

The storage tank 110 is a tank which stores the chemicals L, and an extruding hose 121 of the extruding unit 120 and a drawing hose 141 of the drawing unit 140 to be described later are inserted into the liquid layer.

The extruding unit 120 includes, for example, the extruding hose 121 which is inserted into the storage tank 110, a supply pump 122 which extrudes the chemicals L stored in the storage tank 110 so as to supply the chemicals to the doctor chamber 130, and an adjusting valve 123 which adjusts the extrusion amount (flow rate) of the chemicals L using the supply pump 122. The extruding hose 121 is a hose of which one end is inserted into the storage tank 110 and the other end is connected to an introduction portion 132 of the doctor chamber 130, and serves as a flow path which conveys the chemicals L inside the storage tank 110. The supply pump 122 is attached to the extruding hose 121 and is driven by a drive motor (not shown) so that the chemicals L inside the storage tank 110 are pressure-fed to the doctor chamber 130. The adjusting valve 123 adjusts the flow rate of the chemicals L extruded by the supply pump 122 through the opening and closing of the valve.

The drawing unit 140 includes, for example, the drawing hose 141 which is inserted into the storage tank 110 and a suction pump 142 which suctions the chemicals L into the storage tank 110.

The drawing hose 141 is a hose of which one end is inserted into the storage tank 110 and the other end is connected to a guide portion 133 of the doctor chamber 130 to be described later, and serves as a flow path which conveys the chemicals L guided from the guide portion 133 into the storage tank 110.

The suction pump 142 is attached to the drawing hose 141 and is driven by a drive motor (not shown) so that the chemicals L guided from the guide portion 133 is suctioned and is discharged to the storage tank 110 (the outside thereof).

Accordingly, the supply pump which applies the chemicals to the above-described doctor chambers 61A and 61B is configured as the supply pump 122 which extrudes the chemicals L stored in the storage tank 110 so as to supply the chemicals to the doctor chamber 130 in the embodiment. Further, the discharge supply pump which returns the chemicals from the above-described doctor chambers 61A and 61B is configured as the suction pump 142 which draws the chemicals L to the storage tank 110 in the embodiment.

The doctor chamber 130 includes a body part 131 which is disposed adjacent to an anilox roll 151 to be described later and stores the chemicals L, the introduction portion 132 which connects the extruding unit 120 and the body part 131 to each other, and the guide portion 133 which connects the drawing unit 140 and the body part 131 to each other.

The body part 131 is a body portion of the doctor chamber 130, and includes a storage portion 131*a* and blades 131*b* and 131*c*.

As for the storage portion 131*a*, the end portion on the side of the anilox roll 151 is opened and the introduction portion 132 and the guide portion 133 are connected to each other through the storage portion, so that the chemicals L stored therein is supplied to the anilox roll 151. Then, the chemicals are circulated in a manner such that a part of the chemicals L introduced from the introduction portion 132 into the storage portion 131*a* is guided through the guide portion 133 so that the supply amount to the anilox roll 151 becomes constant.

Accordingly, the above-described anilox rolls 63A and 63B are configured as the anilox roll 151 in the embodiment.

The blades 131*b* and 131*c* are provided so as to come into contact with the anilox roll 151, and squeeze the chemicals L while being pressed against the anilox roll 151.

The introduction portion 132 is a tubular coupling of which one end is connected to the body part 131 and the other end is connected to the extruding hose 121 of the extruding unit 120 and which connects the extruding unit 120 and the body part 131 to each other, and may introduce the chemicals L supplied by the supply pump 122 into the storage portion 131*a* of the body part 131.

As illustrated in FIGS. 14 and 15, the guide portion 133 includes a coupling 133*a*, a hole portion 133*b*, and a tube 133*c*.

The coupling 133*a* is a tubular coupling of which one end is connected to the body part 131 and the other end is connected to the drawing hose 141 of the drawing unit 140 and which connects the drawing unit 140 and the body part 131 to each other.

The hole portion 133*b* is an opening portion which is formed in the upper surface of the coupling 133*a* and has a predetermined diameter.

That is, since the coupling 133*a* is provided with the hole portion 133*b*, the chemicals L inside the coupling 133*a* contacts the external air. For this reason, even when the chemicals L are suctioned by the suction pump 142 when circulating the chemicals L by discharging a part of the chemicals L introduced from the introduction portion 132 (by guiding the chemicals from the guide portion 133), the chemicals L may contact the external air by the hole portion 133*b* so that the internal pressure is appropriately equal to the external air pressure. Accordingly, a variation in the internal pressure inside the doctor chamber 130 may be suppressed.

Furthermore, the hole portion 133*b* may be formed in, for example, the upper surface of the body part 131 such that it communicates with the storage portion 131*a* since it is desirable that a variation in the internal pressure inside the doctor chamber 130 is suppressed.

The tube 133*c* is a transparent or translucent tubular member which is connected to the lower end of the hole portion 133*b* and extends upward. For this reason, it is possible to visually check whether the chemicals L flow into the tube 133*c* through the hole portion 133*b* when circulating the chemicals L by discharging a part of the chemicals L introduced from the introduction portion 132.

That is, when it is checked that the chemicals flow into the tube 133*c*, it is possible to check that the amount of the chemicals L stored in the storage portion 131*a* is excessively large (the chemicals L are excessively supplied to the anilox roll 151). Accordingly, a user which visually checks the excessively large state may solve the excessively large state by adjusting the extrusion amount (flow rate) through the operation of, for example, the adjusting valve 123.

Furthermore, since the tube 133*c* is hollow so that the upper end side contacts the external air, the effect of the hole portion 133*b* is not removed.

The chemicals transfer unit 150 includes, for example, the anilox roll 151 to which the chemicals L are supplied from the doctor chamber 130 and a press plate roll 152 which is provided between the anilox roll 151 and the rotation portion 160 to be described later.

That is, the above-described press plate rolls 64A and 64B are configured as the press plate roll 152 in the embodiment.

The anilox roll 151 is configured so as to come into contact with the blades 131*b* and 131*c* of the doctor chamber 130, and is configured so that the chemicals L supplied from the opening of the storage portion 131*a* of the doctor chamber 130 is adsorbed to the peripheral surface.

Furthermore, since the anilox roll 151 is formed in a columnar shape and is configured so as to be rotatable about the axis perpendicular to the XY plane, the chemicals L which are adsorbed to the peripheral surface as described above may be transferred to the press plate roll 152 by the rotation.

The press plate roll 152 is formed in a columnar shape which has a rubber peripheral surface, the peripheral surfaces of the left and right end portions (the point P1 and the point P2 illustrated in FIG. 14) are provided so as to come into contact with the peripheral surfaces of the anilox roll 151 and the rotation portion 160 (the multi-ply continuous sheet S2 wound thereon), and the press plate roll is configured to be rotatable about the axis perpendicular to the XY plane.

For this reason, the press plate roll 152 rotates in the direction r2 when the rotation portion 160 which comes into contact with the left end of the press plate roll rotates in the direction r1, and rotates the anilox roll 151 in the direction r1 through the contact at the right end. That is, the press plate roll 152 acquires the chemicals L adsorbed to the peripheral surface of the anilox roll 151 at the point P2, and conveys the chemicals to the point P1 by the rotation in the direction r2 so that the chemicals may be transferred onto the multi-ply continuous sheet S2.

For this reason, even when the chemicals L adsorbed onto the anilox roll 151 are non-uniformly left in laminae on the peripheral surface of the anilox roll 151, the chemicals L may be uniformly transferred to the multi-ply continuous sheet S2 by transferring the chemicals to the peripheral surface of the press plate roll 152.

The rotation portion 160 is a columnar member which is provided adjacent to the press plate roll 152 and rotates about the axis perpendicular to the XY plane (for example, the direction r1 of FIG. 14) through a driving force applied from a motor (not shown), and is configured to grip the multi-ply continuous sheet S2 on the peripheral surface. For this reason, when the rotation portion 160 rotates in the direction r1, the supplied multi-ply continuous sheet S2 is wound on the peripheral surface, and the press plate roll 152 and the anilox roll 151 are rotated, so that the chemicals L may be transferred from the press plate roll 152 at the time point in which the chemicals are conveyed to the point P1.

Furthermore, the rotation direction of the rotation portion 160 is set as the direction r1 in FIG. 14, but may be set as the direction r2. In this case, the anilox roll 151 and the press plate roll 152 rotate in the direction opposite to that of FIG. 14 (that is, the anilox roll 151: the direction r2 and the press plate roll 152: the direction r1).

Next, the operation of circulating the chemicals L using the chemicals supply device 100 according to the embodiment will be described.

First, a supply pump 122 is driven, so that the chemicals L are extruded from the storage tank 110, and is supplied to the storage portion 131*a* of the body part 131 through the extruding hose 121 and the introduction portion 132 of the doctor chamber 130.

Subsequently, the rotation portion 160 is rotated, so that the chemicals L of the storage portion 131*a* are supplied to the anilox roll 151, and the chemicals L are transferred onto the multi-ply continuous sheet S2 through the press plate roll 152.

Furthermore, the suction pump 142 is driven, so that a part of the chemicals L of the storage portion 131*a* is discharged toward the storage tank 110 through the guide portion 133 so as to be circulated. At this time, a variation in the internal pressure inside the doctor chamber 130 is suppressed by the contact with the external air through the hole portion 133*b* inside the coupling 133*a* of the guide portion 133.

Further, when it is checked that the chemicals L flow into the tube 133*c* during the circulation, the flow rate of the chemicals L is adjusted by the operation of the adjusting valve 123.

As described above, the chemicals supply device 100 according to the embodiment includes the storage tank 110 which stores the chemicals L, the supply pump 122 which supplies the chemicals L stored in the storage tank 110 to the body part 131 of the doctor chamber 130 through the extruding hose 121, and the suction pump 142 which suctions the chemicals L stored in the body part 131 of the doctor chamber 130 and discharges the chemicals to the storage tank 110 (the outside thereof) through the drawing hose 141. The doctor chamber 130 includes the introduction portion 132 which connects the extruding hose 121 and the body part 131 to each other and introduces the chemicals L supplied by the supply pump 122 into the body part 131 and the guide portion 133 which connects the drawing hose 141 and the body part 131 to each other and has the tubular coupling 133*a* guiding a part of the chemicals L introduced from the introduction portion 132 into the body part 131, where the hole portion 133*b* is provided in the upper surface of the coupling 133*a* of the guide portion 133.

That is, in the chemicals supply device 100, the hole portion 133*b* is provided in the upper surface of the coupling 133*a* of the guide portion 133. For this reason, since the chemicals L contact the external air by the hole portion 133*b* when a part of the chemicals L inside the body part 131 is discharged by using the suction pump 142, a variation in the internal pressure inside the doctor chamber 130 caused by the operation of the suction pump 142 is suppressed. Further, in the invention, since the suction pump 142 is used when a part of the chemicals L is discharged, there is no need to provide a flow path which naturally drops the chemicals L, and the installation position of the tank 110 is not particularly limited to the upside or the like of the doctor chamber 130.

Accordingly, the chemicals supply device 100 may be understood as the chemicals supply device 100 which may suppress a variation in the internal pressure inside the doctor chamber 130 when suctioning the chemicals L from the doctor chamber 130 and may be installed by saving the space as much as possible.

Further, the doctor chamber 130 includes the transparent or translucent tube 133*c* which is connected to the lower end of the hole portion 133*b* and extends upward.

That is, it is possible to visually check whether the chemicals L flow into the tube 133*c* through the hole portion 133*b* when a part of the chemicals L introduced from the introduction portion 132 is discharged so as to circulate the chemicals L. For this reason, when it is checked that the chemicals flow into the tube 133*c*, it is possible to check that the amount of the chemicals L stored in the storage portion 131*a* is excessively large (the chemicals L are excessively supplied to the anilox roll 151). Accordingly, a user which visually checks the excessively large state may solve the excessively large state by adjusting the extrusion amount of the chemicals L through the operation of, for example, the adjusting valve 123.

Further, since the upper end (free end) of the tube 133*c* is provided so as to face downward, it is possible to prevent foreign matter such as paper dust from intruding into the hole portion 133*b*.

<Third Embodiment of Doctor Chamber Type>

Next, a chemicals supply device 200 of a third embodiment of a doctor chamber type will be described by referring to FIG. 16.

In the chemicals supply device 100 of the second embodiment of the doctor chamber type, it is configured to check whether the chemicals L are excessively supplied to the anilox roll 151 by visually checking whether the chemicals L flow into the tube 133*c* connected to the hole portion 133*b*. However, in the chemicals supply device 200 of the embodiment, the arrival of the above-described state is automatically determined, and the determination result is notified to the user.

In the description of the chemicals supply device 200 below, a difference from the chemicals supply device 100 of the second embodiment of the doctor chamber type will be mainly described, and the same configuration will not be described by giving the same reference numeral thereto.

Figure 16:
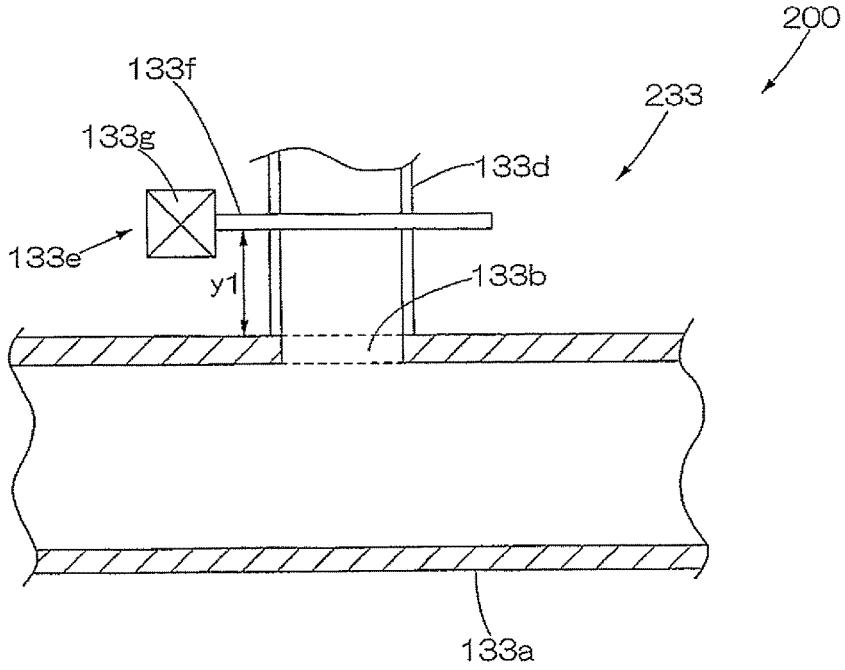
FIG. 16 is a schematic diagram illustrating the other guide portion of the chemicals supply device.

As illustrated in FIG. 16, a guide portion 233 of the embodiment includes the coupling 133*a*, the hole portion 133*b*, a cylindrical portion 133*d* which is provided above the hole portion 133*b*, and a sensor unit 133*e* which is attached to the cylindrical portion 133*d*.

The cylindrical portion 133*d* is a cylindrical member of which the lower end is fixed to the peripheral surface of the hole portion 133*b* by welding or the like and which extends upward.

The sensor unit 133*e* includes a sensor 133*f* which is provided in the cylindrical portion 133*d* and a notification unit 133*g* which is attached to the sensor 133*f* and notifies the detection result of the sensor 133*f*.

The sensor 133*f* is, for example, a sensor which includes a light emitting element (not illustrated) emitting light toward a detection subject and a light receiving element (not illustrated) receiving light reflected from the detection subject and which detects whether the height of the chemicals L flowing into the cylindrical portion 133*d* reaches the height position (y1 illustrated in FIG. 16) where the sensor 133*f* is provided based on the light receiving amount of the reflected light from the light receiving element.

The notification unit 133*g* is, for example, a speaker or the like, and is configured to notify the current state to the user in terms of a voice when the sensor 133*f* detects that the height of the chemicals L flowing into the cylindrical portion 133*d* reaches the height position where the sensor 133*f* is provided.

That is, it is possible to determine whether the amount of the chemicals L stored in the storage portion 131*a* is excessively large (the chemicals L are excessively supplied to the anilox roll 151) by detecting whether the chemicals L flowing into the cylindrical portion 133*d* reach the above-described height position using the sensor 133*f* when circulating the chemicals L by discharging a part of the chemicals L introduced from the introduction portion 132. Then, since the user may recognize the above-described excessively large state by the notification unit 133*g*, the excessively large state may be solved by adjusting the extrusion amount (flow rate) of the chemicals L through the operation of, for example, the adjusting valve 123.

Furthermore, since the cylindrical portion 133*d* is hollow so that the upper end side contacts the external air, the effect of the hole portion 133*b* is not removed.

Next, the operation of circulating the chemicals L using the chemicals supply device 200 according to the embodiment will be described.

First, the supply pump 122 is driven, so that the chemicals L are extruded from the storage tank 110 so as to be supplied to the storage portion 131*a* of the body part 131 through the extruding hose 121 and the introduction portion 132 of the doctor chamber 130.

Subsequently, the rotation portion 160 is rotated, so that the chemicals L of the storage portion 131*a* are supplied to the anilox roll 151 and the chemicals L are transferred onto the multi-ply continuous sheet S2 through the press plate roll 152.

Furthermore, the suction pump 142 is driven, so that a part of the chemicals L of the storage portion 131*a* is discharged toward the storage tank 110 through the guide portion 233 so as to be circulated. At this time, a variation in the internal pressure inside the doctor chamber 130 is suppressed by the contact with the external air through the hole portion 133*b* inside the coupling 133*a* of the guide portion 233.

Further, when it is checked that the height of the chemicals L flowing into the cylindrical portion 133*d* reaches the height position where the sensor 133*f* is provided during the circulation by the sensor 133*f* and the notification unit 133*g* notifies the detection result to the user, the flow rate of the chemicals L is adjusted by the operation of the adjusting valve 123.

As described above, in the chemicals supply device 200 according to the embodiment, the doctor chamber 130 includes the cylindrical portion 133*d* of which the lower end is connected to the peripheral surface of the hole portion 133*b* and which extends upward, the sensor 133*f* which is provided in the cylindrical portion 133*d* and detects whether the height of the chemicals L flowing into the cylindrical portion 133*d* reaches a predetermined height (the height position where the sensor 133*f* is provided), and the notification unit 133*g* which notifies the detection result obtained when the sensor 133*f* detects the case where the height of the chemicals L flowing into the cylindrical portion 133*d* reaches the above-described predetermined height position.

That is, according to the chemicals supply device 200, the same effect as that of the chemicals supply device 100 may be exhibited. Also, it is possible to automatically determine whether the chemicals L are excessively supplied to the anilox roll 151 by the sensor 133*f* and the notification unit 133*g* when circulating the chemicals L and to notify the determination result to the user. Accordingly, it is possible to reduce a burden generated when the determination is performed by the user.

<Fourth Embodiment of Doctor Chamber Type>

Next, a chemicals supply device 300 of a fourth embodiment of a doctor chamber type will be described by referring to FIG. 17.

In the chemicals supply device 100 of the second embodiment and the chemicals supply device 200 of the third embodiment of the doctor chamber type, it is configured that the opening amount of the hole portion 133*b* becomes a fixed value. However, in the chemicals supply device 300 of the embodiment, it is configured that the opening amount is adjusted.

In the description of the chemicals supply device 300 below, a difference from the chemicals supply device 100 of the second embodiment and the chemicals supply device 200 of the third embodiment of the doctor chamber type will be mainly described, and the same configuration will not be described by giving the same reference numeral thereto.

Figure 17:
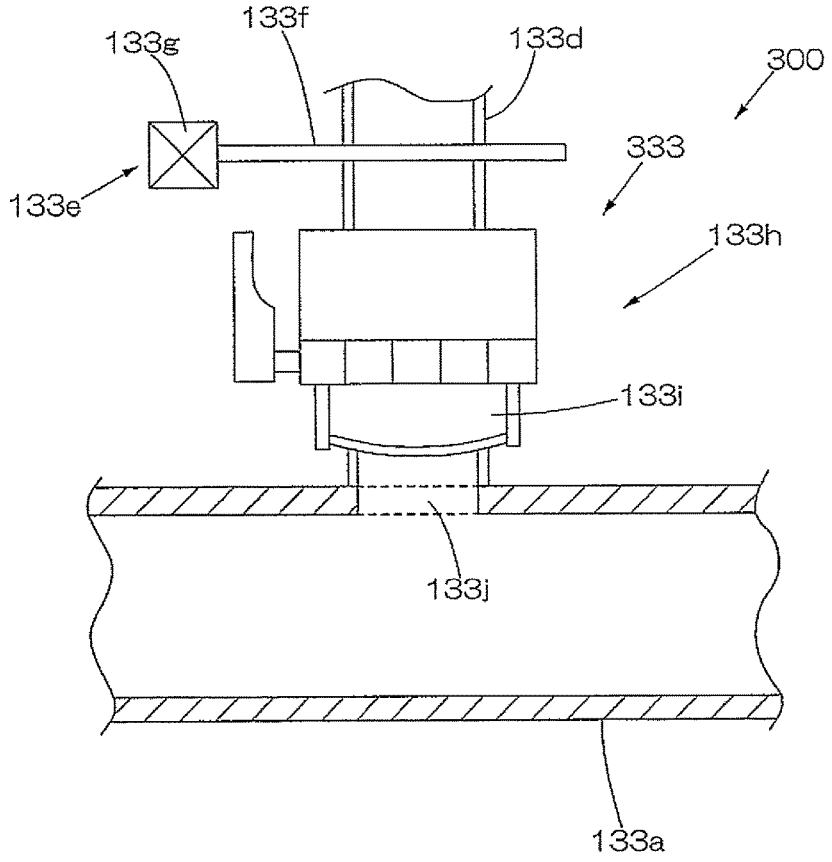
FIG. 17 is a schematic diagram illustrating the other guide portion of the chemicals supply device.

As illustrated in FIG. 17, a guide portion 333 of the embodiment includes the coupling 133*a*, the cylindrical portion 133*d*, the sensor unit 133*e*, and an adjusting portion 133*h* which is attached to the cylindrical portion 133*d*. The adjusting portion 133*h* is, for example, a needle valve, and includes a hole portion 133*j* which is an opening formed in the upper surface of the coupling 133*a* and a valve body 133*i* which adjusts the opening amount of the hole portion 133*j*.

The hole portion 133*j* is formed in a shape in which an opening having a predetermined diameter is surrounded by an orifice.

The valve body 133*i* is disposed above the opening of the hole portion 133*j*, and includes a needle shaft (not illustrated) which is formed in a tapered shape at the end portion and is movable up and down, and the opening amount of the hole portion 133*j* may be adjusted in accordance with the opening degree which is obtained when the needle shaft moves up and down so as to contact the hole of the hole portion 133*j*.

That is, since the opening amount of the hole portion 133*j* may be adjusted by the adjusting portion 133*h*, the opening amount of the hole portion 133*j* may be appropriately adjusted in accordance with a variation in the internal pressure amount inside the doctor chamber 131 when circulating the chemicals L. For this reason, for example, when the sensor unit 133*e* detects that the height of the chemicals L flowing into the cylindrical portion 133*d* reaches the height position where the sensor 133*f* is provided, it is possible to take a countermeasure by adjusting the extrusion amount of the chemicals L through the operation of the adjusting valve 123 and to take a countermeasure in which a variation in the internal pressure inside the doctor chamber 130 is suppressed by increasing an air releasing capability using the hole portion 133*j* (by increasing the contact area with the external air) through the adjustment of the opening amount of the hole portion 133*j* using the adjusting portion 133*h*.

That is, since it is possible to appropriately prevent the emission of the chemicals L inside the doctor chamber 130 caused by a variation in the internal pressure or the suction of the chemicals L on the anilox roll 151 toward the doctor chamber 130 by suppressing a variation in the internal pressure, the circulation of the chemicals L is promoted.

Next, the operation of circulating the chemicals L using the chemicals supply device 300 according to the embodiment will be described.

First, the supply pump 122 is driven, so that the chemicals L is extruded from the storage tank 110, and is supplied to the storage portion 131*a* of the body part 131 through the extruding hose 121 and the introduction portion 132 of the doctor chamber 130.

Subsequently, the rotation portion 160 is rotated, so that the chemicals L of the storage portion 131*a* are supplied to the anilox roll 151, and the chemicals L are transferred onto the multi-ply continuous sheet S2 through the press plate roll 152.

Furthermore, the suction pump 142 is driven, so that a part of the chemicals L of the storage portion 131*a* is discharged toward the storage tank 110 through the guide portion 333 so as to be circulated. When the sensor 133*f* detects that the height of the chemicals L flowing into the cylindrical portion 133*d* reaches the height position where the sensor 133*f* is provided in circulation and the notification unit 133*g* notifies the detection result to the user, it is possible to take a countermeasure through the operation of the adjusting valve 123 or the adjustment of the opening amount of the hole portion 133*j* using the adjusting portion 133*h*.

As described above, in the chemicals supply device 300 according to the embodiment, the doctor chamber 130 includes the adjusting portion 133*h* which adjusts the opening amount of the hole portion 133*j*.

That is, according to the chemicals supply device 300, the same effect as that of the chemicals supply device 100 may be obtained, and the opening amount of the hole portion 133*j* may be adjusted by the adjusting portion 133*h*. Accordingly, it is possible to further appropriately suppress a variation in the internal pressure inside the doctor chamber 130 by appropriately adjusting the opening amount of the hole portion 133*j* in accordance with a variation in the internal pressure amount inside the doctor chamber 131 when circulating the chemicals L.

Figure 18:
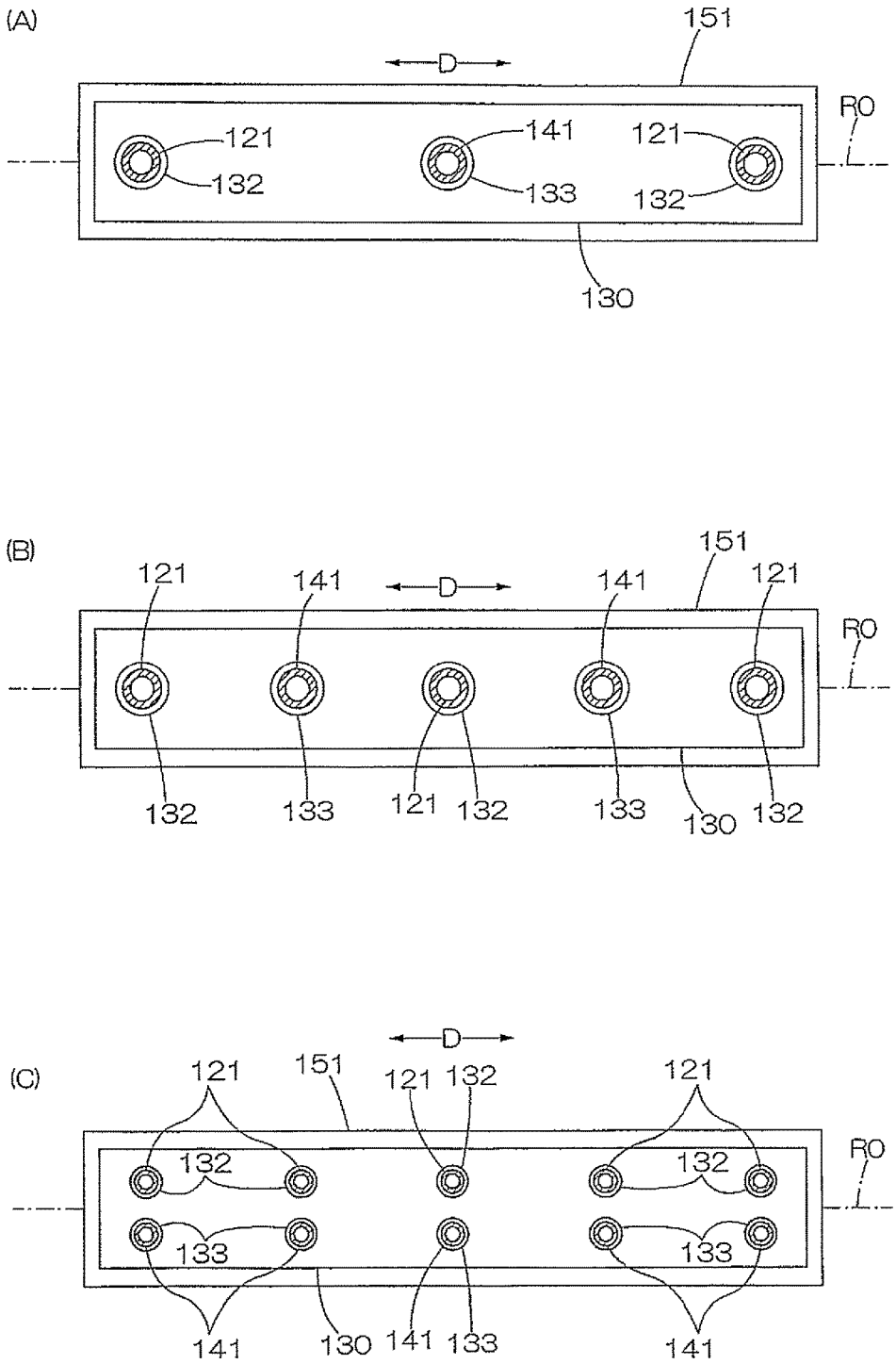
FIG. 18 is a diagram illustrating a structure of a doctor chamber which is used in the chemicals supply device of the embodiment illustrated in FIG. 14, where

On the other hand, in the chemicals supply devices of the above-described respective embodiments, a structure is illustrated in which one introduction portion 132 connected to the extruding hose 121 and one introduction portion 132 connected to the extruding hose 121 are provided in the doctor chamber 130. However, for example, the structures of the respective examples illustrated in FIG. 18 may be used.

For example, in FIG. 18(A), a structure is illustrated in which the introduction portions 132 respectively connected to the extruding hoses 121 are provided at the positions near the left and right ends in the width direction D of the doctor chamber 130 which forms a rectangular outer frame having a wide width in accordance with the anilox roll 151 which is formed so as to have a wide width and rotates about the rotational axis R0. Then, a structure is illustrated in which one guide portion 133 connected to the drawing hose 141 is present at the center portion of the doctor chamber 130.

That is, in the example illustrated in FIG. 18(A), since two extruding hoses 121 are respectively connected to two introduction portions 132 so as to supply the chemicals L from the vicinities of the left and right ends of the doctor chamber 130, the fresh chemicals L in the storage tank 110 may be averagely supplied into the doctor chamber 130, and the remaining chemicals L are further guided from the doctor chamber 130 through the guide portion 133 of the center portion.

Further, in FIG. 18(B), a structure is illustrated in which the introduction portions 132 respectively connected to the extruding hoses 121 are provided at the positions near the left and right ends and the center portion in the width direction D of the doctor chamber 130 which forms a rectangular outer frame having a wide width in accordance with the anilox roll 151 which is formed so as to have a wide width and rotates about the rotational axis R0. Then, a structure is illustrated in which two guide portions 133 respectively connected to the drawing hoses 141 are present at the positions on the left and right sides of the width direction D of the doctor chamber 130.

That is, in the example illustrated in FIG. 18(B), since two guide portions 133 are respectively disposed between three introduction portions 132 and three extruding hoses 121 are respectively connected to three introduction portions 132 so as to supply the chemicals L from the vicinities of the left and right ends of the doctor chamber 130 and the center portion thereof, the fresh chemicals L inside the storage tank 110 may be averagely supplied into the doctor chamber 130, and the remaining chemicals L may be further guided from the doctor chamber 130 through two guide portions 133.

On the other hand, in FIG. 18(C), a structure is illustrated in which the introduction portions 132 respectively connected to the extruding hoses 121 are provided at plural portions on the upper side of the drawing at equal intervals along the width direction D of the doctor chamber 130 which forms the rectangular outer frame having a wide width in accordance with the anilox roll 151 which is formed so as to have a wide width and rotates about the rotational axis R0. Then, a structure is illustrated in which plural guide portions 133 respectively connected to the drawing hoses 141 are present at the positions on the lower side of the drawing of the doctor chamber 130 so as to be adjacent to the respective introduction portions 132.

That is, in the example illustrated in FIG. 18(C), the chemicals L are respectively supplied from the extruding hoses 121 to the plural introduction portions 132 disposed along the width direction D of the doctor chamber 130, and the remaining chemicals L are guided from the doctor chamber 130 through the plural guide portions 133 adjacent to the respective introduction portions 132. Accordingly, even in this example, the fresh chemicals L inside the storage tank 110 may be averagely supplied into the doctor chamber 130, and the remaining chemicals L are further guided from the doctor chamber 130 through the guide portion 133.

Furthermore, the scope of the invention is not limited to the above-described embodiments, and various improvements and changes of design may be performed within the scope not departing from the spirit of the invention.

For example, in the chemicals supply device 100, when the tube 133*c* is not provided, a configuration may be adopted in which an air filter is provided in the upper portion of the hole portion 133*b* so as to prevent the intrusion of foreign matter such as paper dust to the hole portion 133*b*. Further, the hole portion 133*b* may be provided at the side surface of the body part 131 when the hole portion is above the liquid level of the chemicals L of the storage portion 131*a*.

<Embodiment of Flexographic Double Roll Transfer Type>

Here, an example of a double roll transfer type in a flexographic printing will be described.

Figure 23:
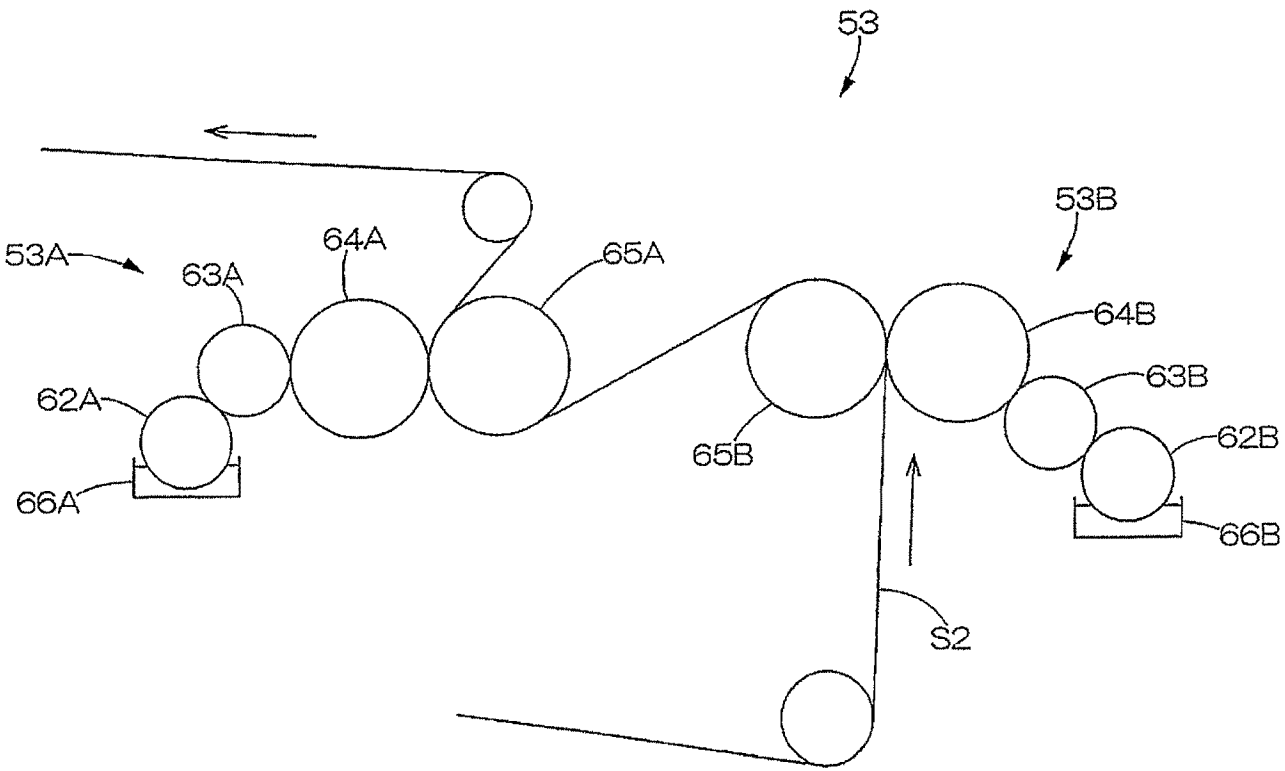
FIG. 23 is a diagram illustrating a state where the chemicals applying unit illustrated in FIG. 12 is replaced by another one.

As illustrated in FIGS. 11 and 23, one chemicals applying portion 53A configured as the flexographic printing has a configuration in which a squeezing roll 62A as a dipping roll is installed so as to be rotatable while being dipped into the chemicals tank 66A filled with the chemicals. Furthermore, the anilox roll 63A is installed so as to be rotatable while coming into contact with the squeezing roll 62A outside the chemicals tank 66A. Further, the press plate roll 64A which comes into contact with the anilox roll 63A and one surface of the multi-ply continuous sheet S2 is installed so as to be rotatable, and applies a pressure to the multi-ply continuous sheet S2 at the elastic roll 65A which faces the press plate roll with the multi-ply continuous sheet S2 interposed therebetween.

Then, in the embodiment, the chemicals applying portion 53A is positioned on the side of the surface of the multi-ply continuous sheet S2 so as to face the roll 54A of the ply bonding unit 54 to be described later and face the above-described winding drum 56A.

Further, as illustrated in FIGS. 11 and 23, the other chemicals applying portion 53B configured as the flexographic printing has a configuration in which a squeezing roll 62B as a dipping roll is installed so as to be rotatable while being dipped into the chemicals tank 66B filled with the chemicals. Furthermore, the anilox roll 63B is installed so as to be rotatable while coming into contact with the squeezing roll 62B outside the chemicals tank 66B. Further, the press plate roll 64B which comes into contact with the anilox roll 63B and the other surface of the multi-ply continuous sheet S2 is installed so as to be rotatable, and applies a pressure to the multi-ply continuous sheet S2 at the elastic roll 65B which faces the press plate roll with the multi-ply continuous sheet S2 interposed therebetween.

Then, in the embodiment, the chemicals applying portion 53B is positioned on the side of the other surface of the multi-ply continuous sheet S2 so as not to face the roll 54A and the above-described winding drum 56A.

Accordingly, the chemicals are respectively applied from the chemicals applying portion 53A and the chemicals applying portion 53B to both surfaces of the multi-ply continuous sheet S2. However, at this time, the chemicals may be applied from both surfaces of the multi-ply continuous sheet S2 to the respective multi-ply continuous sheets S2 while decreasing the application amount to the surface of the multi-ply continuous sheet S2 facing the roll 54A using the chemicals applying portion 53A with respect to the application amount of the other surface thereof using the chemicals applying portion 53B.

Here, in a case where the total application amount of both surfaces is set to 1.5 to 5 g/m$^2$ as described above and the application amount of the secondary paper roll R as the ply paper roll is decreased more than the application amount of the inner peripheral surface of the secondary paper roll R, the application amount to the outer peripheral surface of the secondary paper roll R is desirably set to be equal to or more than 20% and less than 50% in the total application amount of the lotion with respect to both surfaces of the paper, but the specific value changes in the above-described range since the optimal condition becomes different due to the slippage and the quality balance of the secondary paper roll R, the thickness of the sheet or the permeability of the lotion thereto, and the metastatic property.

Specifically, a configuration may be supposed in which the application amount for each surface is changed, the lines per inch of the flexographic plate is set to 15 to 40 lines, and the peak area ratio is set to 20 to 40% or so as a rough extent in which the chemicals do not scatter. With such a configuration, the dot pattern immediately after the application is left, and an application portion and a non-application portion are instantly formed.

Accordingly, according to the embodiment, since the flexographic printing is used, the plate is resin and has elasticity. Even when the multi-ply continuous sheet S2 is slightly uneven, the slight unevenness may be adjusted by the printing pressure. Accordingly, the multi-ply continuous sheet S2 is not easily wrinkled compared to the case of the application of the metal roll as in the gravure printing. On the other hand, since the flexographic printing is used, even when the processing speed is high, the application amount may be stabilized and the application may be stably performed in a wide range of viscosity of the chemicals using a single roll. Specifically, even when the lotion as the chemicals is applied by the application amount of 1.5 g to 5 $g/m^2$ while conveying the multi-ply continuous sheet S2 at the speed of 700 m/minute or more, the application may be uniformly performed and the multi-ply continuous sheet S2 may be extracted without any meandering.

Further, the requirement of the chemicals applying unit 53 concerned with the embodiment may be considered as below.

There is a need to install a filtering device for paper dust or air contained in the chemicals circulating inside an application device such as the chemicals tanks 66A and 66B, but as the filtering device, a filter may be used which removes paper dust. Furthermore, there is a need to control the temperature of the chemicals inside the application device such as the chemicals tanks 66A and 66B and to stabilize the viscosity of the chemicals. However, a heater may be installed in the intermediate tank and the pipe connected to the chemicals tanks 66A and 66B. On the other hand, there is a need to manage the application amount based on the moisture percentage of the multi-ply continuous sheet S2 in the width direction in operation. However, the moisture amount and the variation in the width direction may be managed at all times by, for example, an infrared detector or the like.

Furthermore, in the embodiment, a doctor blade (not illustrated) may be provided for the anilox rolls 63A and 63B. In this case, there is a merit that the chemicals may be prevented from scattering from the anilox rolls 63A and 63B capable of uniformly applying the chemicals. In contrast, there is a demerit that the doctor blade needs to be repaired or replaced.

<Embodiment of Flexographic Single Roll Transfer Type>

A single roll transfer type in flexographic printing indicates that the squeezing rolls 62A and 62B are removed from the above-described flexographic double roll transfer type. In this case, the anilox rolls 63A and 63B are installed so as to be rotatable while being respectively dipped into the chemicals tanks 66A and 66B. Further, in the anilox rolls 63A and 63B, a doctor blade (not illustrated) may be installed which scrapes the chemicals on the surfaces of the anilox rolls 63A and 63B. Such a flexographic single roll transfer type has a merit that the maintenance is comparatively easy or a merit that the abrasion of the blade or the mixture state of foreign matter such as paper dust inside the chemicals may be easily and visually observed.

(Chemicals)

With regard to the chemicals to be applied, the viscosity is set to 1 to 700 mPa·s at 40° C. from the viewpoint of a high-speed processing. More desirably, the viscosity is set to 50 to 400 mPa·s (40° C.). When the viscosity is smaller than 1 mPa·s, the chemicals easily scatter from a roll such as the anilox roll, the press plate roll, and the gravure roll. In contrast, when the viscosity is larger than 700 mPa·s, it is difficult to control the application amount to each roll or the continuous sheet. As the constituents, polyol is contained by 70 to 90%, moisture is contained by 1 to 15%, and a functional chemical agent is contained by 0.01 to 22%.

Polyol contains polyalcohol such as glycerin, diglycerin, propylene glycol, 1,3-butylene glycol, polyethylene glycol, and derivative thereof, and contains a sugar group such as sorbitol, glucose, xylitol, maltose, maltitol, mannitol, and trehalose.

As the functional chemical agent, a softening agent, a surface acting agent, inorganic and organic molecular powder, an oily component, and the like may be exemplified. The softening agent and the surface acting agent are effective for softening the tissue or calendering the surface thereof, and adopt an anionic surface acting agent, a cationic surface acting agent, and an amphoteric ion surface acting agent. The inorganic and organic molecular powder makes the surface soft. The oily component serves to improve the lubricating property, and may adopt high-quality alcohol such as liquid paraffin, cetanol, stearyl alcohol, and oleyl alcohol.

Further, as the functional chemical agent, a moisturizing agent having an arbitrary combination of one or more of hydrophilic high molecular gelatinizing agent, collagen, hydrolytic collagen, hydrolytic keratin, hydrolytic silk, hyaluronic acid or salt thereof, ceramide, and the like may be added as a chemical agent which helps or maintains the moisture-retaining property of polyol.

Further, as the functional chemical agent, aroma chemicals, an emollient agent such as various natural essences, a vitamin group, an emulsifying agent which stabilizes mixed components, an antifoaming agent which stabilizes the application by suppressing the foaming of the chemicals, an antimold agent, and a freshener such as organic acid may be appropriately mixed. Further, an antioxidant agent of vitamin C and vitamin E may be contained.

Among the components, it is desirable to use polyalcohol such as glycerin and propylene glycol as a main component from the viewpoint in which the viscosity of the chemicals and the application amount are stabilized.

The chemicals application temperature is 30° C. to 60° C. and desirably 35° C. to 55° C.

(Ply Bonding Unit)

In a facility X1 for manufacturing a secondary paper roll for tissue paper products, a ply bonding unit 54 may be provided which applies ply bonding to the multi-ply continuous sheet S2.

Figure 13:
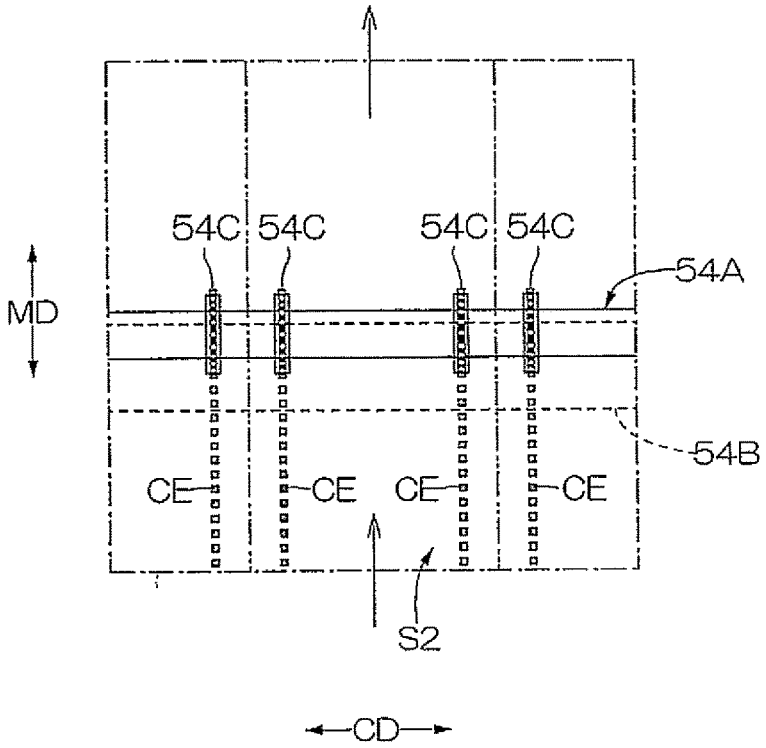
FIG. 13 is a diagram illustrating a state where a multi-ply continuous sheet is ply bonded by a ply bonding unit.

Here, as illustrated in FIG. 13, the ply bonding unit 54 has a configuration in which a receiving roll 54B configured as a metal roll or a elastic roll and a rigid metal roll 54A having minute convex portions 54C formed on the surface thereof are installed so as to be rotatable while the outer peripheral surfaces thereof come into contact with each other with a predetermined pressure. Then, when the multi-ply continuous sheet S2 is conveyed while being interposed between the receiving roll 54B and the convex portions 54C which are provided as many as two on the left and right sides of the portion corresponding to the center in the width direction of the tissue paper products in the multi-ply continuous sheet S2, a linear ply bonding (contact emboss) CE which prevents the interlayer peeling is performed on the multi-ply continuous sheet S2 along the continuous direction of the multi-ply continuous sheet S2.

Furthermore, the above-described winding unit 56 winds the multi-ply continuous sheet S2 so that the surface facing the roll 54A performing the ply bonding CE becomes the outer peripheral side.

When the ply bonding CE is applied in this way, it is possible to prevent the interlayer peeling of the multi-ply continuous sheet S2 which is formed by multi-ply forming plural single-sheets (S11 and S12 in the example illustrated in the drawings) from the primary paper rolls. Furthermore, it is desirable that the ply bonding CE be formed at both side portions in the width direction of the tissue paper products so that the end portion of the tissue paper products is not easily peeled into layers.

Furthermore, although the installation position of the ply bonding unit 54 is not particularly limited, the ply bonding unit may be installed at the rear stage of the chemicals applying unit 53 and the front stage of the slitting unit 55 or the rear stage of the calender unit 52 and the front stage of the chemicals applying unit 53. That is, the ply bonding unit may be installed at any position of the rear stage of the calender unit 52 and the front stage of the slitting unit 55.

In a case where the ply bonding unit 54 applies the ply bonding CE, a configuration may be proposed in which the chemicals are applied to the multi-ply continuous sheet S2 and the ply bonding CE is applied within 0.3 to 2.5 seconds and desirably 0.3 to 1.0 seconds. In a case of less than 0.3 seconds, the chemicals are not sufficiently absorbed to the base paper. For this reason, the chemicals are attached to the receiving roll 54B or the roll 54A so as to chip the paper or dirt is attached to the receiving roll 54B or the roll 54A. In a case of more than 2.5 seconds, the multi-ply continuous sheet S2 coated with the chemicals is stretched. For this reason, wrinkles are not easily formed thereon in the subsequent process, so that bulky tissue paper products are not easily obtained. Further, when the multi-ply continuous sheet S2 is stretched, the stretching capable of handling a variation in the drawing operation is removed. Further, since the tensile strength is degraded due to the absorption of moisture and water, there are problems that the paper is easily chipped and the workability is degraded.

Further, in this bonding step, the embodiment uses the rigid metal roll 54A having the minute convex portions 54C formed on the surface thereof as the roll. However, a linear bonded portion for preventing the interlayer peeling in the multi-ply continuous sheet S2 may be formed, and for example, instead of the roll 54A, a roller having a minute needle-like member formed on a surface may be used as a roll.

Furthermore, a unit for bonding is not limited to the above-described example, and a roll of which a front end of a convex portion is formed in a shape such as a dot shape, a square shape, a rectangular shape, a circular shape, and an oval shape or a roll of which a front end of a convex portion is formed in a thin and linear shape or a thin and obliquely extending linear shape may be used as a roll.

On the other hand, the convex portions may be arranged at equal intervals, but may be arranged at a zigzag shape or may not be arranged at equal intervals. Further, instead of the convex portions which are arranged in a row so as to continuously apply the ply bonding, the convex portions may be arranged in plural rows equal to or more than two rows. Then, plural ply bonding groups may be applied by arranging plural groups having convex portions arranged so as to densely apply plural rows of ply bonding. Furthermore, as the bonding step, the bonding may be performed by the other method using an ultrasonic wave other than the above-described method using a mechanical pressure.

Figure 19:
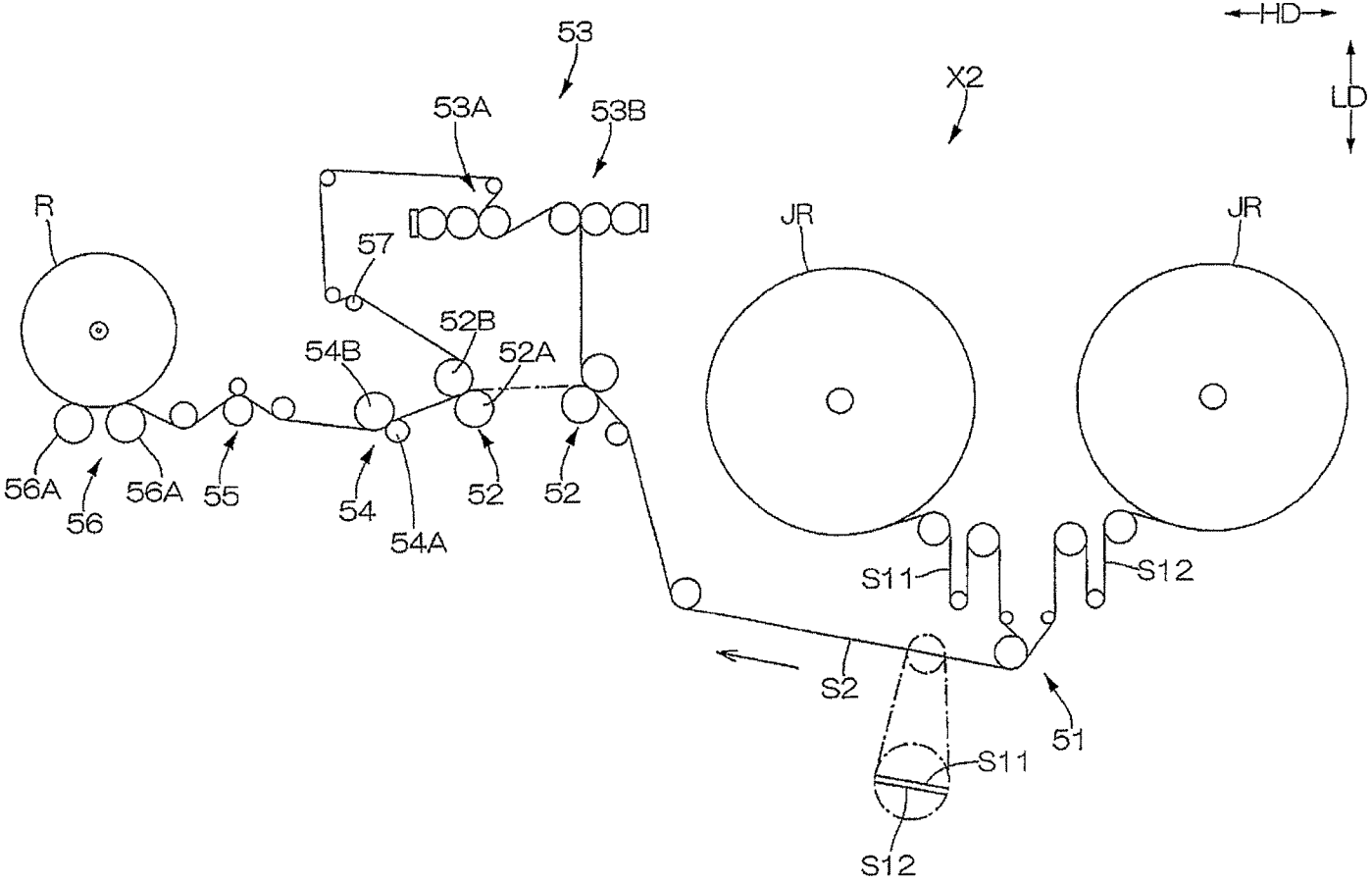
FIG. 19 is a schematic diagram illustrating another facility and another method of manufacturing a secondary paper roll.

As illustrated in FIG. 19, a tension control unit 57 which controls the tension of the multi-ply continuous sheet S2 may be provided between the chemicals applying unit 53 and the ply bonding unit 54. The tension control unit 57 is formed from a columnar roll, and is configured to be movable up and down in accordance with the bent state of the multi-ply continuous sheet S2.

Further, in a case where the tension control unit 57 is provided as illustrated in FIG. 19, the calender unit 52 may be disposed at the front stage of the chemicals applying unit 53 and the rear stage of the tension control unit 57. In this case, during the application of the chemicals, the calender unit 52 which is disposed at the rear stage of the tension control unit 57 may separate the calender roll 52A from the receiving roll 52B by a distance equal to or longer than the paper thickness of the multi-ply continuous sheet S2 so that the multi-ply continuous sheet S2 is passed without any calendering process performed thereon (a second facility and a second method of manufacturing a secondary paper roll for tissue paper products).

(Single-Sheet from a Primary Paper Roll)

Raw material pulp of the single sheets S11 and S12 from the primary paper rolls is not particularly limited, and appropriate raw material pulp may be used in accordance with the purpose of the tissue paper products. As the raw material pulp, for example, one or plural kinds may be appropriately selected and used from wood pulp, non-wood pulp, synthetic pulp, recycled pulp, and the like, more specifically, mechanical pulp (MP) such as ground pulp (GP), stone ground pulp (SGP), refiner ground pulp (RGP), pressure ground wood pulp (PGW), thermomechanical pulp (TMP), chemi-thermomechanical pulp (CTMP), and bleached chemi-thermomechanical pulp (BCTMP), chemi-mechanical pulp (CGP), semi-chemical pulp (SCP), kraft pulp (KP) such as broadleaf tree bleached kraft pulp (LBKP) and needle-leaf tree bleached kraft pulp (NBKP), chemical pulp (CP) such as soda pulp (AP), sulfite pulp (SP), and dissolved pulp (DP), synthetic pump made from nylon, rayon, polyester, polyvinyl alcohol (PVA), and the like, deinking pulp (DIP), recycled pump such as waste pulp (WP), tailings pulp (TP), rag pulp made of cotton, linum, hemp, jute, Manila hemp, ramie, and the like, straw pulp, esparto pulp, baggasse pulp, bamboo pulp, culm pulp such as kenaf pulp, assisting pulp such as bast pulp, and the like.

In particular, it is desirable that the raw material pulp be formed by the mixture of NBKP and LBKP. The recycled pulp may be appropriately mixed. However, from the viewpoint of the sensation of touch or the like, only the combination of NBKP and LBKP is desirable. As the mixture ratio (JIS P 8120) in this case, NBKP:LBKP=20:80 to 80:20 is desirable and NBKP:LBKP=30:70 to 60:40 is particularly desirable.

As for the single sheets S11 and S12 from the primary paper rolls, the basis weight according to JIS P 8124 is 10 to 25 g/m$^2$, desirably 12 to 20 g/m$^2$, and more desirably 13 to 16 g/m$^2$. It is desirable that the basis weight is less than 10 g/m$^2$ from the viewpoint of the softness, but the appropriate strength may not be ensured. On the other hand, when the basis weight becomes more than 25 g/m$^2$, the sheet is too solid, which degrades the sensation of touch.

Further, the paper thickness (which is measured by Peacock manufactured by Ozaki. Co., Ltd.) is 80 to 250 μm, desirably 100 to 200 μm, and more desirably 130 to 180 μm in one ply.

As for the single sheets S11 and S12 from the primary paper rolls, the crepe ratio is desirably 10 to 30%, more desirably 12 to 25%, and particularly desirably 13 to 20%. When the crepe ratio is less than 10%, the tissue paper is easily chipped during the process and the tissue paper products are stretched to some degree with low stiffness. On the other hand, when the crepe ratio becomes more than 30%, the tension control of the sheet is difficult and the tissue paper is easily chipped during the process. Further, the tissue paper products having poor appearance are obtained due to the wrinkles after the manufacturing.

As for the single sheets S11 and S12 from the primary paper rolls, the dry tensile strength (hereinafter, referred to as a dry paper strength) according to JIS P 8113 in the longitudinal direction is 200 to 700 cN/25 mm, desirably 250 to 600 cN/25 mm, and particularly desirably 300 to 600 cN/25 mm in two plies. On the other hand, the dry tensile strength in the transverse direction is 100 to 300 cN/25 mm, desirably 130 to 270 cN/25 mm, and particularly desirably 150 to 250 cN/25 mm in two plies. When the dry tensile strength of the base paper is too low, a trouble such as chipped paper or stretching easily occurs during the manufacture and use. When the dry tensile strength is too high, the sensation of touch in use is rough.

The paper strength may be adjusted by the known method. For example, a method of adding a dry paper strengthening agent (a step before the dryer part, and for example, the addition into the pulp slurry), a method of decreasing the freeness of the pulp (for example, by 30 to 40 mL), and a method of increasing the mixture ratio of NBKP (for example, by 50% or more) may be appropriately combined with each other.

As the dry paper strengthening agent, starch, polyacrylamide, carboxymethyl cellulose (CMC) or carboxymethyl cellulose natrium as the salt thereof, carboxymethyl cellulose calcium, carboxymethyl cellulose zinc, and the like may be used. As the wet paper strengthening agent, polyamide-epichlorohydrin resin, urea resin, acid colloid-melamine resin, thermal cross-linking PAM, and the like may be used. When the wet paper strengthening agent is added, the addition amount may be set to 5 to 20 kg/t or so by the weight ratio with respect to the pulp slurry. Further, when the dry paper strengthening agent is added, the addition amount may be set to 0.5 to 1.0 kg/t or so by the weight ratio with respect to the pulp slurry.

[Method of Manufacturing Secondary Paper Roll for Tissue Paper Products]

Next, an example of the method of manufacturing the secondary paper roll for the tissue paper products according to the invention will be described. The method of manufacturing the secondary paper roll for the tissue paper products according to the embodiment may be performed by using, for example, the above-described facility X1 for manufacturing the secondary paper roll for the tissue paper products.

As illustrated in FIG. 11, in the method of manufacturing the secondary paper roll for the tissue paper products according to the invention, the single sheets (S11 and S12 in the example illustrated in the drawing) from the primary paper rolls, reeled out from the plural primary paper rolls are multi-ply formed by the ply unit 51 in the continuous direction so as to form the multi-ply continuous sheet S2 (the multi-ply forming step), the chemicals are applied to the multi-ply continuous sheet S2 by the pair of chemicals applying units 53 (the chemicals applying step), the multi-ply continuous sheet S2 is slit into each product width of the tissue paper products or several fold widths thereof by the slitting unit 55 (the slitting step), and then the multi-ply continuous sheets S2 slit in the slitting step are coaxially wound by the winding unit 56 so as to form plural secondary paper rolls R of each product width of the tissue paper products or several fold widths thereof.

Furthermore, in the method of manufacturing the secondary paper roll for the tissue paper products according to the embodiment, as in the above-described facility X1 for manufacturing the secondary paper roll for the tissue paper products, a calendering step of performing a calendering process on the multi-ply continuous sheet S2 using the pair of calender units 52 may be provided at the rear stage of the multi-ply forming step and the front stage of the chemicals applying step. Further, a ply bonding step of performing linear ply bonding for preventing the interlayer peeling on the multi-ply continuous sheet S2 using the ply bonding unit 54 may be provided at the rear stage of the chemicals applying step and the front stage of the slitting step.

In the facility or the method of manufacturing the secondary paper roll for the tissue paper products according to the embodiment, the processing speed is 100 to 1100 m/minutes, desirably 350 to 1050 m/minutes, and more desirably 450 to 1000 m/minutes. In a case of less than 100 m/minutes, the productivity is low. On the other hand, in a case of more than 1100 m/minutes, the frequency of the occurrence of the chipping of the multi-ply continuous sheet S2 increases. Then, in the chemicals applying step, a variation in the application may occur since the transfer of the chemicals of the press plate roll or the anilox roll becomes unstable.

[Multi-Stand Type Interfolder]

Plural secondary paper rolls R manufactured by the facility and the method of manufacturing the secondary paper roll for the tissue paper products are set on the multi-stand type interfolder, and the multi-ply-sheet from the secondary paper roll, is reeled out from the set secondary paper roll R so as to overlap in a multi-ply formed state, thereby manufacturing the tissue paper bundle. Hereinafter, an example of the multi-stand type interfolder will be described.

Figure 2:
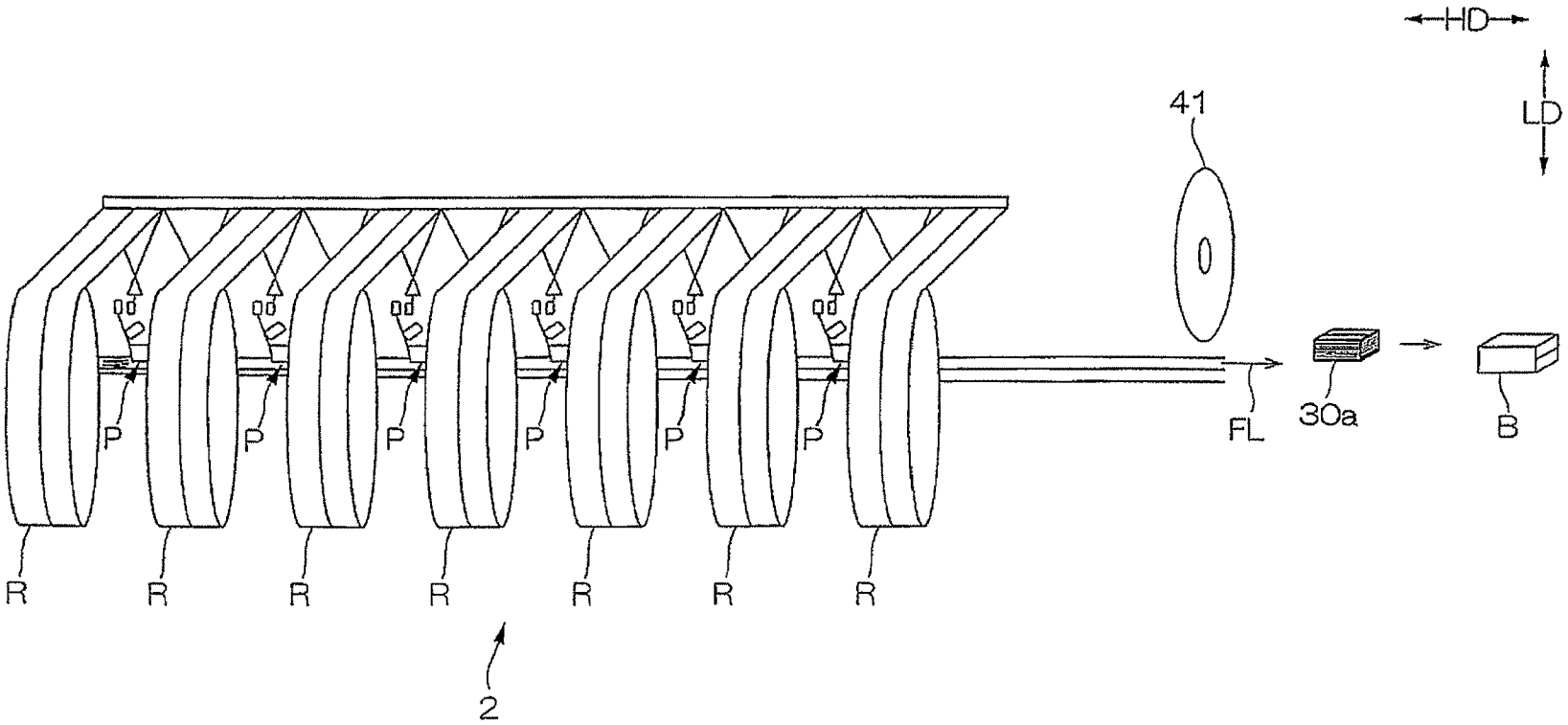
FIG. 2 is a schematic diagram illustrating an example of a multi-stand type interfolder, which is seen from the front side thereof.
Figure 3:
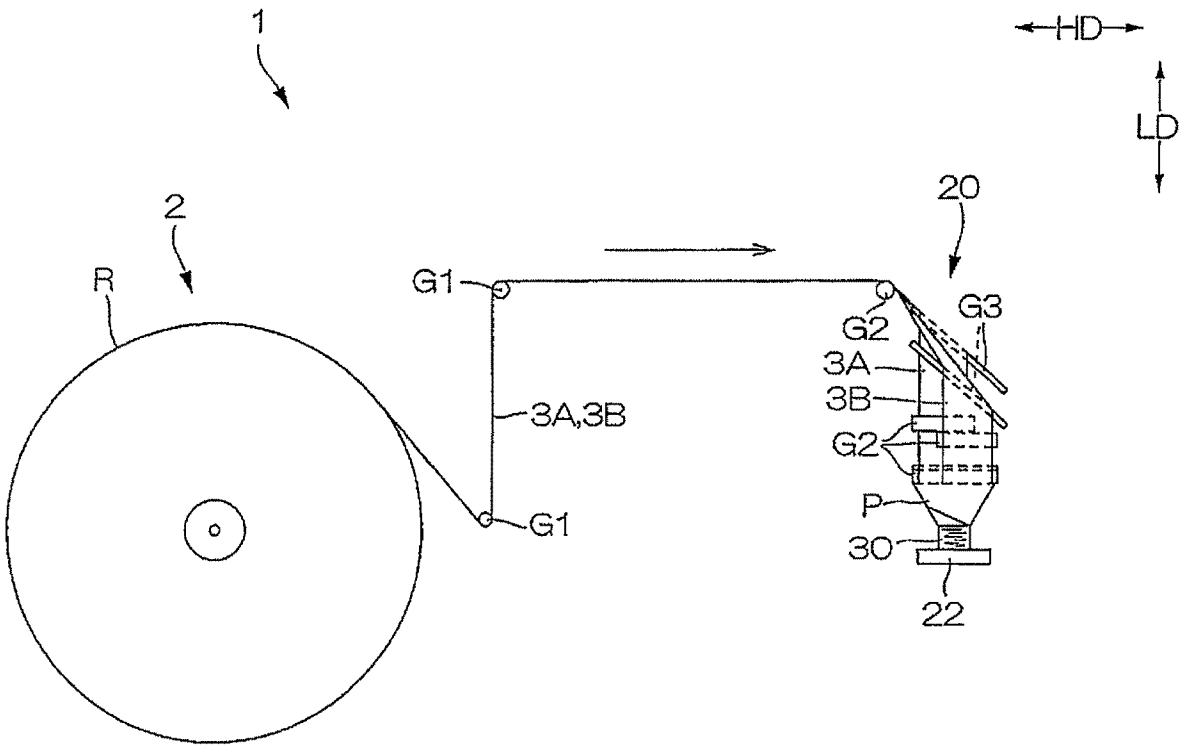
FIG. 3 is a schematic diagram illustrating an example of a multi-stand type interfolder, which is seen from the side thereof.

FIGS. 2 and 3 illustrate an example of the multi-stand type interfolder. The reference numeral 2 of the drawing indicates the secondary paper rolls R, R . . . set on a secondary paper roll support portion (not illustrated) of the multi-stand type interfolder 1. The secondary paper rolls R, R . . . are set together as many as the necessary number in a direction perpendicular to the plane illustrated in the drawing (the horizontal direction of FIG. 2 and the forward and backward directions with respect to the drawing paper of FIG. 3). The respective secondary paper rolls R are slit into the tissue paper products width by the facility and the method of manufacturing the secondary paper roll for the tissue paper products, and are set in a wound state in several fold widths of the tissue paper products and double fold widths in the example illustrated in the drawing.

Figure 4:
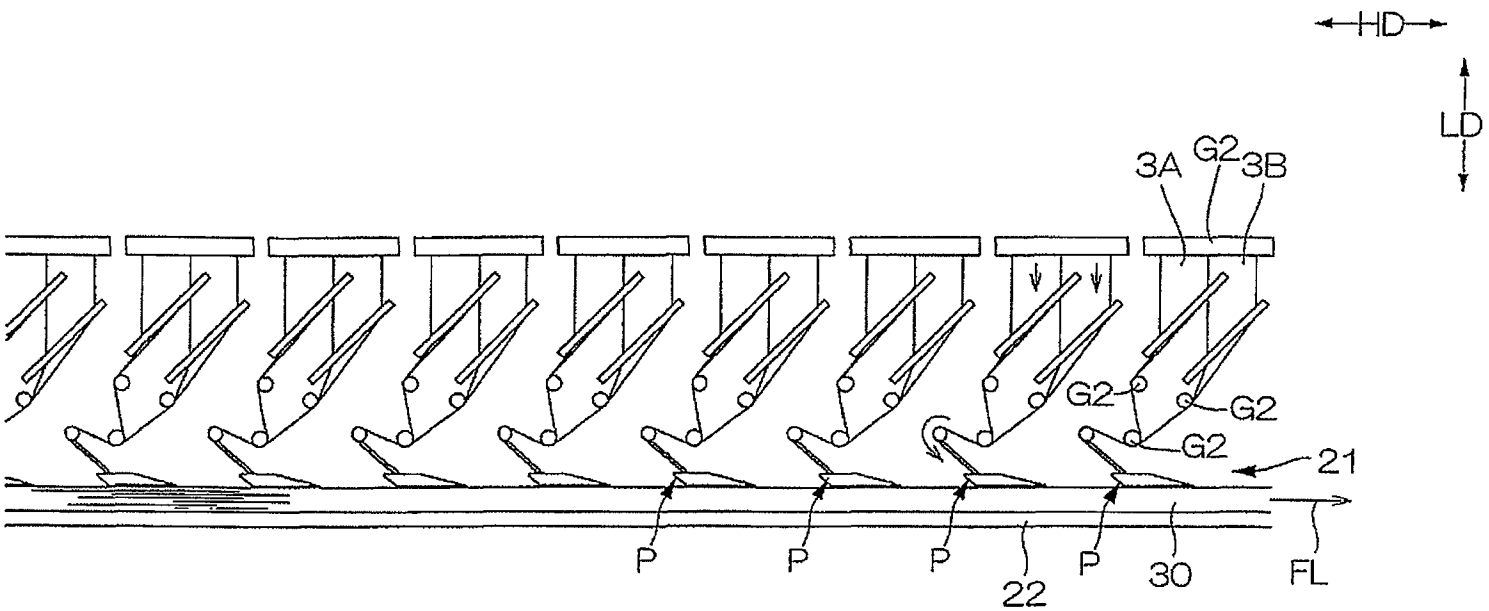
FIG. 4 is a schematic diagram illustrating an example of a multi-stand type interfolder, which is seen from the front side thereof.

The belt-like multi-ply-sheets 3A and 3B from the secondary paper rolls, reeled out from the secondary paper roll R are guided by a guide unit such as guide rollers G1 and G1 so as to be transferred to a folding mechanism unit 20. Further, as illustrated in FIG. 4, the folding mechanism unit 20 is provided with a folding plate group 21 in which the folding plates P, P . . . are arranged as many as the necessary number. As for the respective folding plates P, guide rollers G2 and G2 or guide round bar members G3 and G3 are provided at the appropriate positions so as to guide the pair of multi-ply-sheet 3A or 3B from the secondary paper roll. Furthermore, a conveyor 22 is provided below the folding plates P, P . . . so as to convey a multi-ply formed belt 30 which overlap in a folded state.

Figure 5:
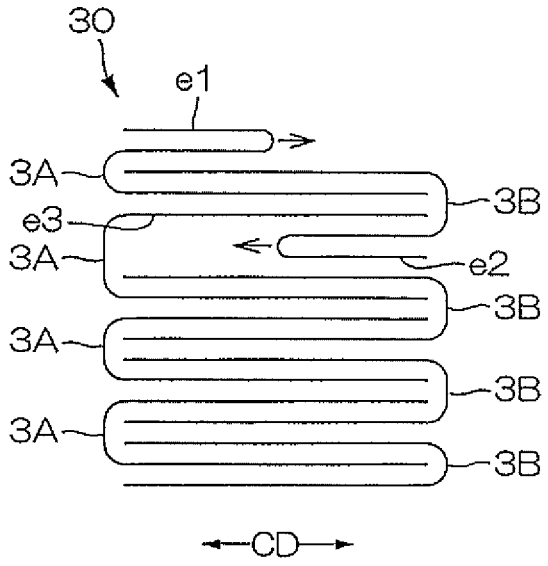
FIG. 5 is a longitudinal cross-sectional view of a folded tissue paper.

This kind of folding mechanism using the folding plates P, P . . . is, for example, a mechanism known in U.S. Pat. No. 4,052,048. As illustrated in FIG. 5, this kind of folding mechanism stacks the respective multi-ply-sheets 3A, 3B . . . from the secondary paper rolls so as to be folded in a Z shape while the side end portions of the adjacent multi-ply-sheets 3A, 3B . . . from the secondary paper rolls cross each other.

FIGS. 7 to 10 specifically illustrate the portion particularly relating to the folding plate P of the folding mechanism unit 20. In the folding mechanism unit 20, the pair of multi-ply-sheets 3A and 3B from the secondary paper rolls, are guided with respect to the respective folding plates P. At this time, the multi-ply-sheets 3A and 3B from the secondary paper rolls, are guided by the guide round bar members G3 and G3 so that the side end portions are deviated from each other so as not to overlap each other.

Figure 8:
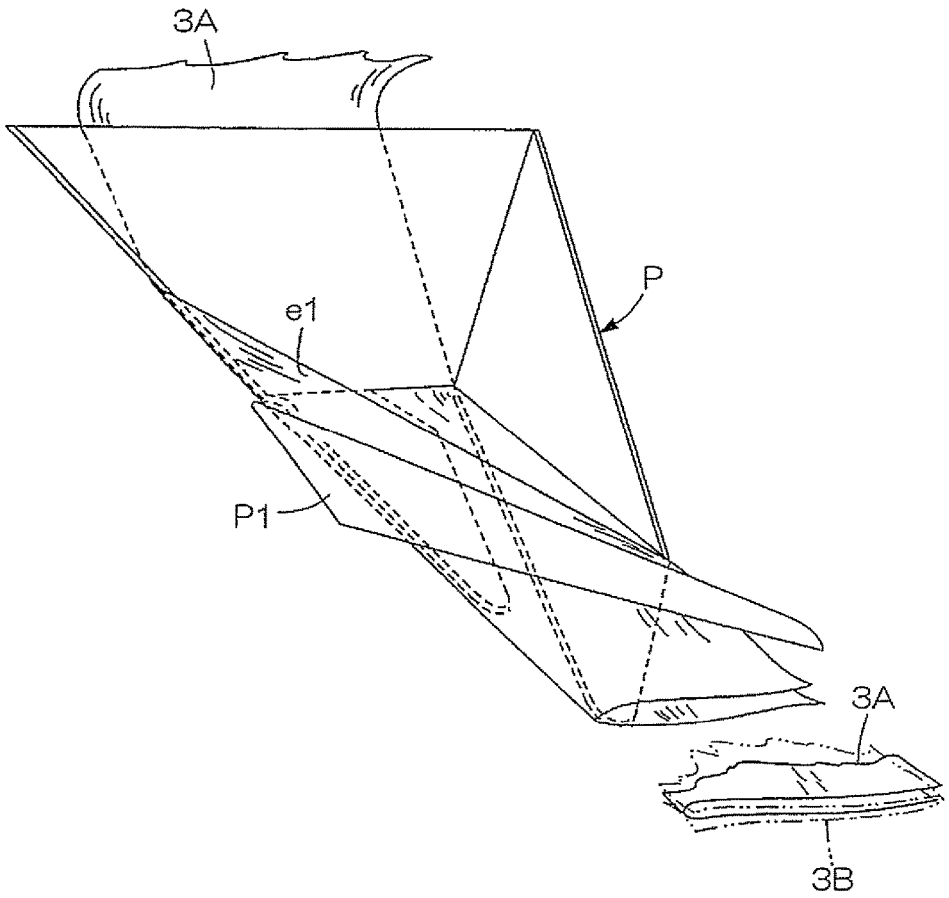
FIG. 8 is a main enlarged perspective view illustrating a method of folding a multi-ply-sheet from a secondary paper roll (tissue paper).
Figure 9:
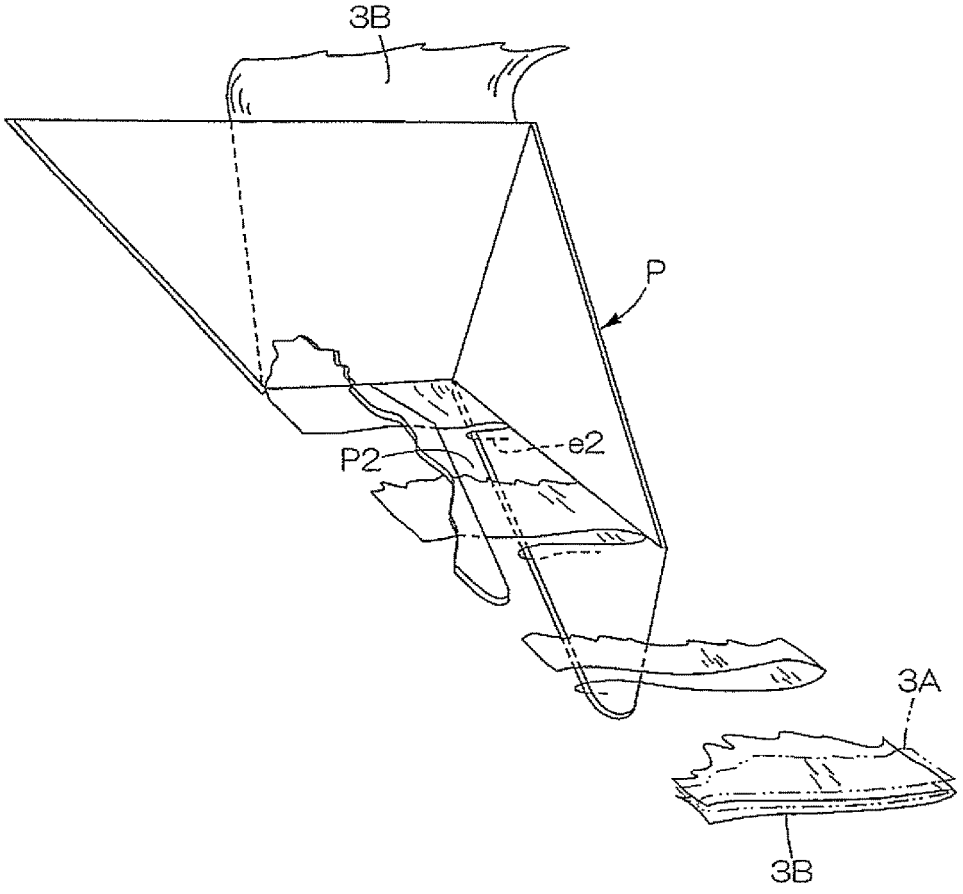
FIG. 9 is a main enlarged perspective view illustrating a method of folding a multi-ply-sheet from a secondary paper roll (tissue paper).
Figure 10:
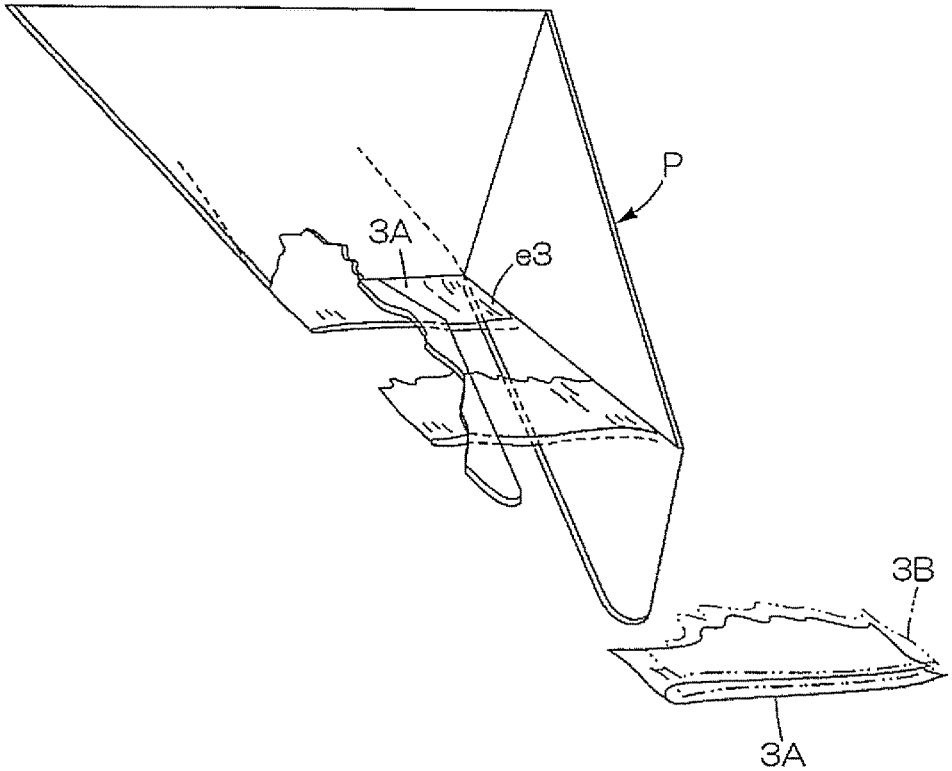
FIG. 10 is a main enlarged perspective view illustrating a method of folding a multi-ply-sheet from a secondary paper roll (tissue paper).

When the multi-ply-sheets from the secondary paper rolls overlapping so as to be continuous to the downside are defined as the first multi-ply-sheets 3A from the secondary paper rolls and the multi-ply-sheets from the secondary paper rolls overlapping so as to be continuous to the upside are defined as the second multi-ply-sheets 3B from the secondary paper rolls at the time point at which the multi-ply-sheets from the secondary paper rolls, are guided by the folding plate P, in the multi-ply-sheets 3A and 3B from the secondary paper rolls, which are continuous to each other, the side end portion e1 of the first multi-ply-sheet 3A from the secondary paper roll, which does not overlap the second multi-ply-sheet 3B from the secondary paper roll as illustrated in FIGS. 5 and 8, is folded back to the upside of the multi-ply-sheet 3B from the secondary paper roll by the side plate P1 of the folding plate P, and the side end portion e2 of the second multi-ply-sheet 3B from the secondary paper roll, which does not overlap the first multi-ply-sheet 3A from the secondary paper roll as illustrated in FIGS. 5 and 9, is folded back to the downside so as to be drawn to the downside of the folding plate P from the slit P2 of the folding plate P. At this time, as illustrated in FIGS. 5 and 10, the side end portion e3 (e1) of the first multi-ply-sheet 3A from the secondary paper roll, which overlaps in a folded state at the upstream folding plate P, is guided from the slit P2 of the folding plate P into the gap between the portions folded back in the second multi-ply-sheet 3B from the secondary paper roll. In this way, the respective multi-ply-sheets 3A, 3B . . . from the secondary paper rolls, are folded in a Z shape, and the side end portions of the adjacent multi-ply-sheets 3A and 3B from the secondary paper rolls, cross each other. Accordingly, when the uppermost tissue paper is taken out when using the products, the side end portion of the next tissue paper appears.

Figure 6:
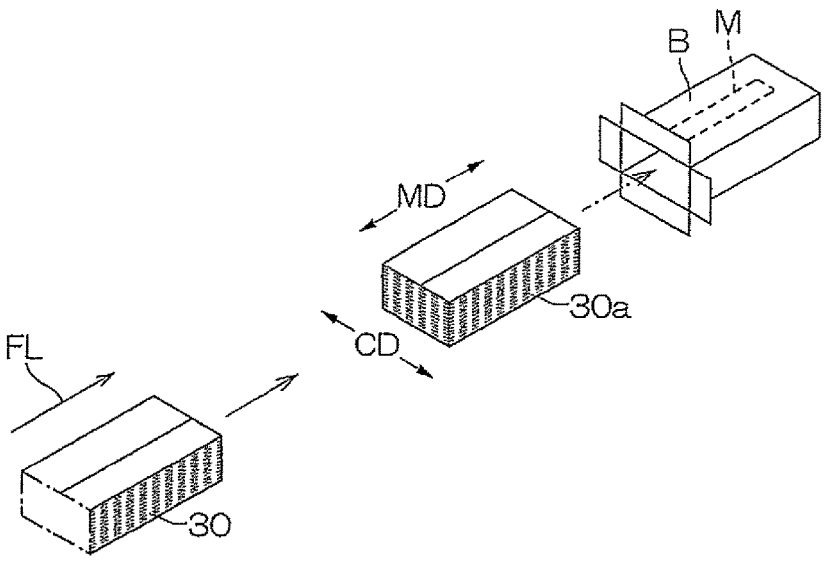
FIG. 6(*a*) is a diagram illustrating a state where a tissue paper bundle is received in a storage box.
Figure 6:
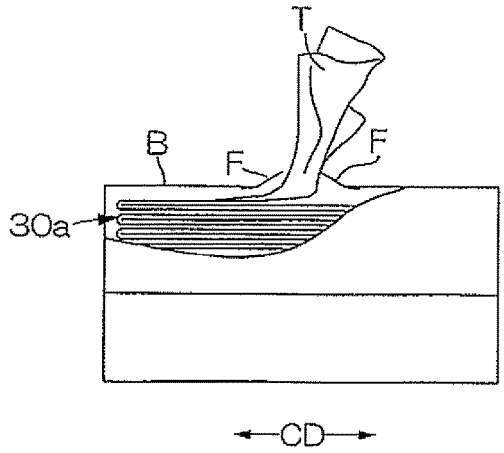
Figure 7:
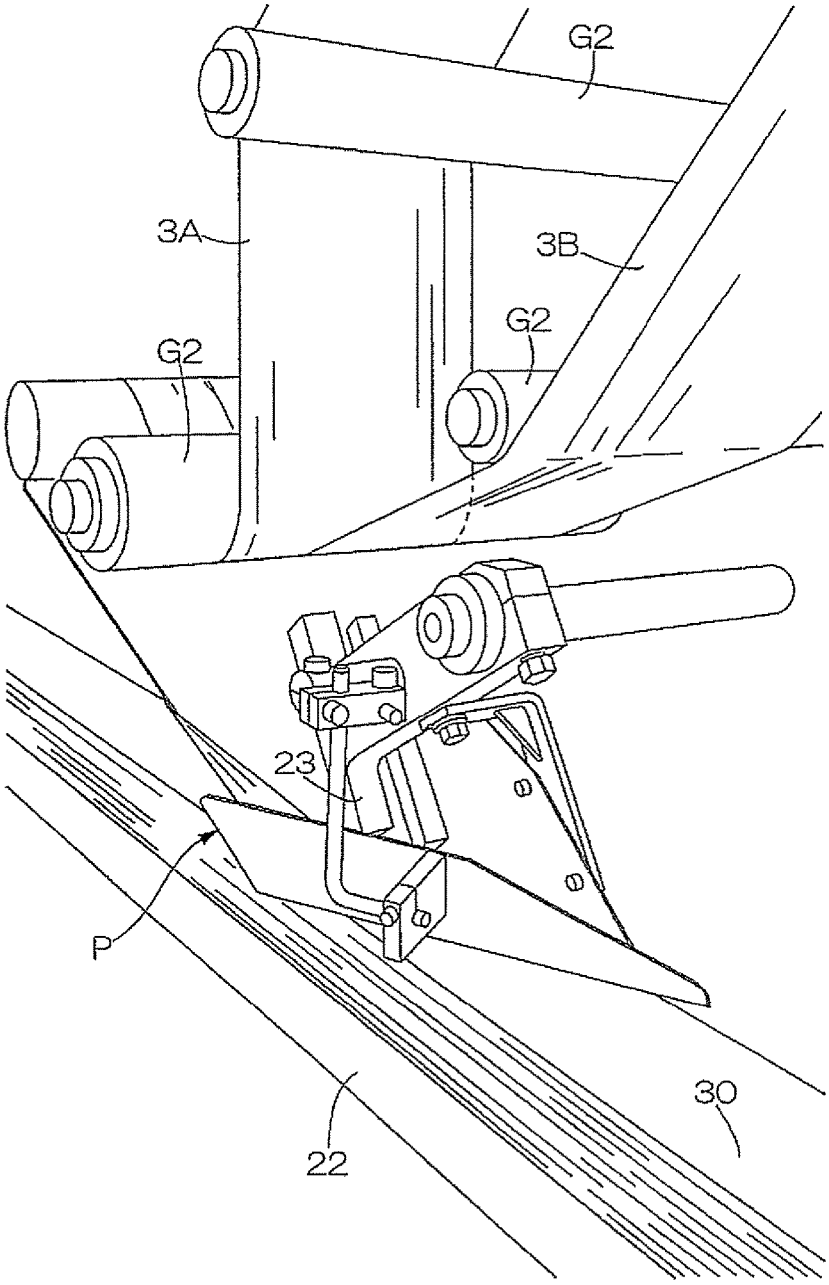
FIG. 7 is a main enlarged perspective view of a portion concerned with a folding plate.

In this way, as illustrated in FIG. 2, the multi-ply formed belt 30 which is obtained in the multi-stand type interfolder 1 is cut in a predetermined interval in the flow direction FL by a cutting unit 41 at the rear stage so as to form a tissue paper bundle 30*a*. Then, as illustrated in FIG. 6(*a*), the tissue paper bundle 30*a* is further accommodated in the storage box B by the facility at the rear stage. Furthermore, in the multi-stand type interfolder 1 with the above-described configuration, the direction of the paper of the multi-ply formed belt 30 is set such that the longitudinal direction (the direction MD) is set along the flow direction FL and the transverse direction (the direction CD) is set along the direction perpendicular to the flow direction. For this reason, as for the direction of the paper of the tissue paper forming the tissue paper bundle 30*a* obtained by cutting the multi-ply formed belt 30 into a predetermined length, as illustrated in FIG. 6(*a*), the longitudinal direction (the direction MD) is set along the extension direction of the folded portion of the tissue paper, and the transverse direction (the direction CD) is set along the direction perpendicular to the extension direction of the folded portion of the tissue paper.

FIG. 6(*b*) illustrates an example of products which are obtained by accommodating a tissue paper bundle 30*a* in the storage box B. A perforated line M is formed on the upper surface of the storage box B, and when a part of the upper surface of the storage box B is cut away through the perforated line M, the upper surface of the storage box B is opened. The opening is covered with a film F having a slit formed at the center thereof, and the tissue paper T may be taken out through the slit formed in the film F.

Incidentally, as described above, since the direction of the tissue paper forming the tissue paper bundle 30*a* is set such that the transverse direction (the direction CD) is set along the direction perpendicular to the extension direction of the folded portion of the tissue paper, the drawing direction is set along the transverse direction (the direction CD) of the tissue paper T when taking the tissue paper T out from the storage box B as illustrated in FIG. 6(*b*).

Next, the other embodiments of the facility and the method of manufacturing the secondary paper roll for the tissue paper products will be described.

[Third Facility and Method of Manufacturing Secondary Paper Roll for Tissue Paper Products]

Figure 20:
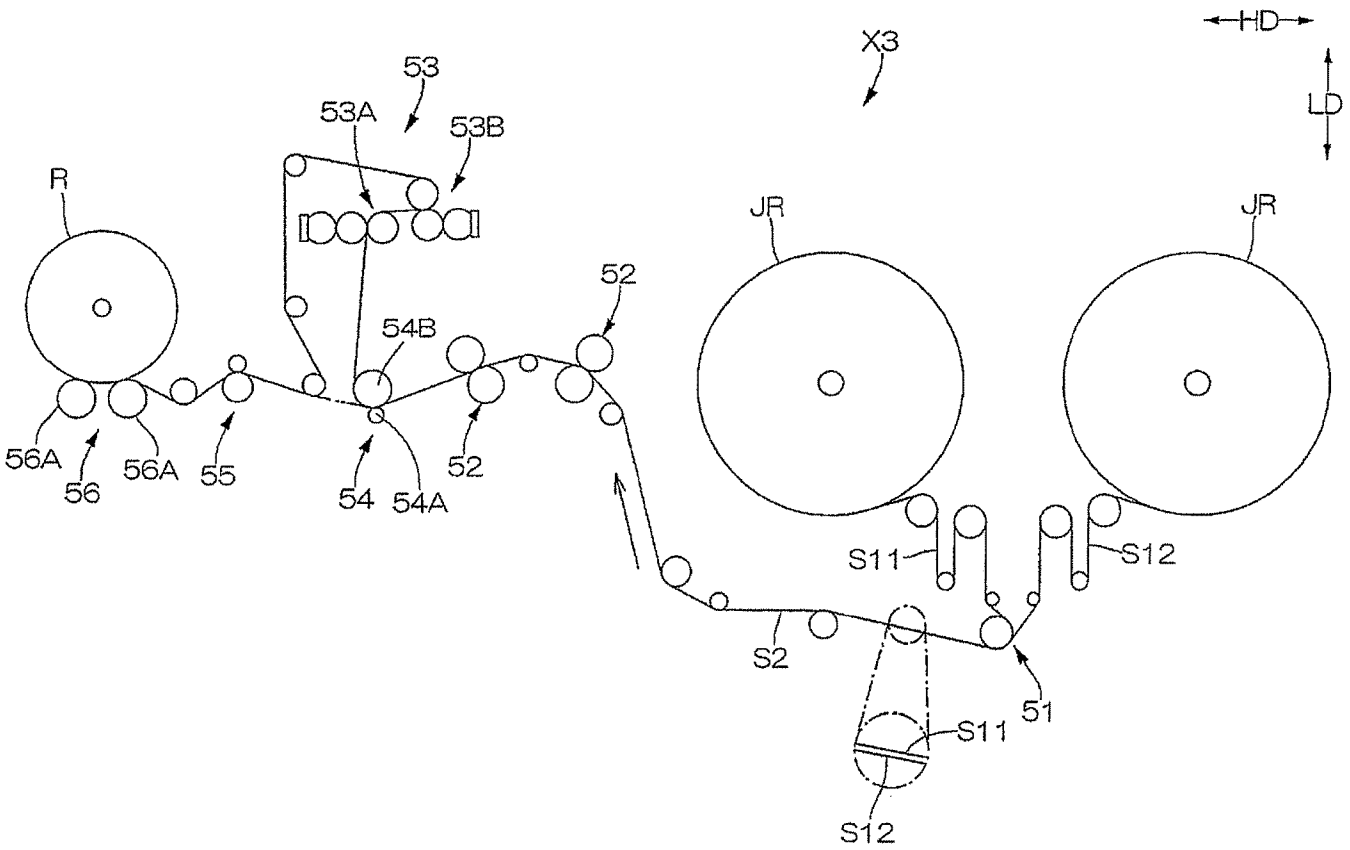
FIG. 20 is a schematic diagram illustrating another facility and another method of manufacturing a secondary paper roll.

As illustrated in FIG. 20, the ply bonding unit 54 may be provided between the calender unit 52 and the chemicals applying unit 53. A method of manufacturing a secondary paper roll for tissue paper products using a facility X3 for manufacturing the secondary paper roll for tissue paper products is as below.

As illustrated in FIG. 20, in the method of manufacturing the secondary paper roll for the tissue paper products according to the embodiment, the single-sheets (S11 and S12 in the example illustrated in the drawing) from the primary paper rolls, reeled out from the plural primary paper rolls are multi-ply formed by the ply unit 51 in the continuous direction so as to form the multi-ply continuous sheet S2 (the multi-ply forming step), a calendering process is performed on the multi-ply continuous sheet S2 by the pair of calender units 52 (the calendering step), the ply bonding is applied to the calendered multi-ply continuous sheet S2 by the ply bonding unit 54 (the ply bonding step), the chemicals are applied to the multi-ply continuous sheet S2 having the ply bonding by the pair of chemicals applying units 53 (the chemicals applying step), the multi-ply continuous sheet S2 is slit by the slitting unit 55 into each product width of the tissue paper products or several fold widths thereof (the slitting step), and the multi-ply continuous sheet S2 slit in the slitting step is coaxially wound by the winding unit 56 so as to form plural secondary paper rolls R of each product width of the tissue paper products or several fold widths thereof.

Furthermore, in a case where the tissue paper products coated with no chemicals are manufactured by the facility X3 for manufacturing the secondary paper roll for the tissue paper products, the multi-ply continuous sheet S2 may be directly conveyed from the ply bonding unit 54 to the slitting unit 55 as depicted by the two-dotted chain line of FIG. 20, so that the multi-ply continuous sheet S2 may flow without passing through the chemicals applying unit 53.

[Fourth Facility and Method of Manufacturing Secondary Paper Roll for Tissue Paper Products]

Figure 21:
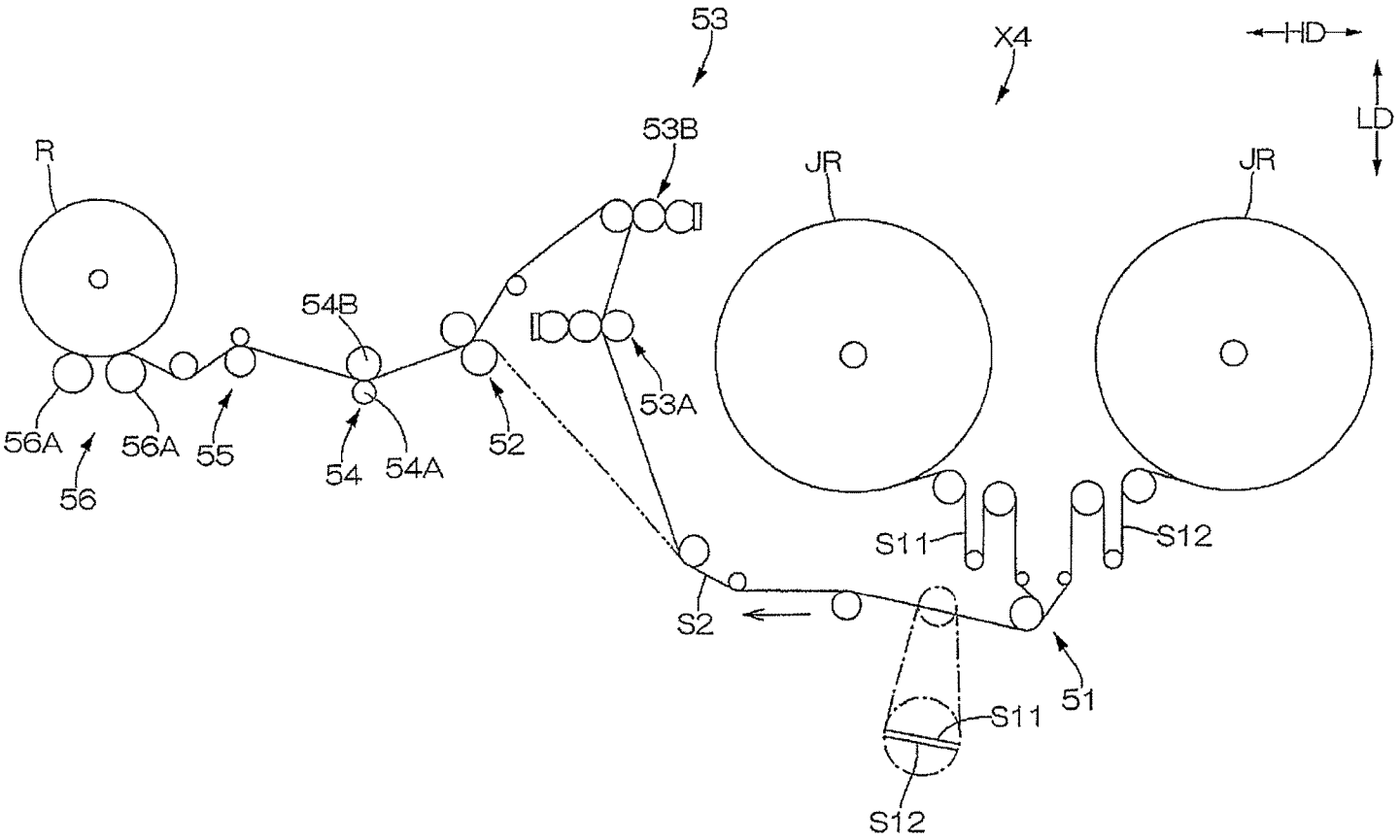
FIG. 21 is a schematic diagram illustrating another facility and another method of manufacturing a secondary paper roll.

As illustrated in FIG. 21, in the chemicals applying step 53, the ply bonding unit 54 may be provided between the ply unit 51 and the calender unit 52, and the calender unit 52 may be provided as a single step between the chemicals applying unit 53 and the ply bonding unit 54. A method of manufacturing a secondary paper roll for tissue paper products using a facility X4 for manufacturing the secondary paper roll for tissue paper products is as below.

As illustrated in FIG. 21, in the method of manufacturing the secondary paper roll for the tissue paper products according to the embodiment, the single-sheets (S11 and S12 in the example illustrated in the drawing) from the primary paper rolls, reeled out from the plural primary paper rolls are multi-ply formed by the ply unit 51 along the continuous direction so as to form the multi-ply continuous sheet S2 (the multi-ply forming step), the chemicals are applied to the multi-ply formed continuous sheet S2 by the pair of chemicals applying units 53 provided in parallel in the vertical direction (the chemicals applying step), the calendering process is performed by the pair of calender units 52 (the calendering step), the ply bonding is applied to the calendered multi-ply continuous sheet S2 by the ply bonding unit 54 (the ply bonding step), the multi-ply continuous sheet S2 is slit by the slitting unit 55 into each product width of the tissue paper products or several fold widths thereof (the slitting step), and then the multi-ply continuous sheets S2 slit in the slitting step are coaxially wound by the winding unit 56 so as to form plural secondary paper rolls R of each product width of the tissue paper products or several fold widths thereof.

Furthermore, in a case where the tissue paper products coated with no chemicals are manufactured by the facility X4 for manufacturing the secondary paper roll for the tissue paper products, the multi-ply continuous sheet S2 may be conveyed from the calender unit 52 to the ply bonding unit 54 as depicted by the two-dotted chain line of FIG. 21, so that the multi-ply continuous sheet S2 may flow without passing through the chemicals applying unit 53.

[Fifth Facility and Method of Manufacturing Secondary Paper Roll for Tissue Paper Products]

Figure 22:
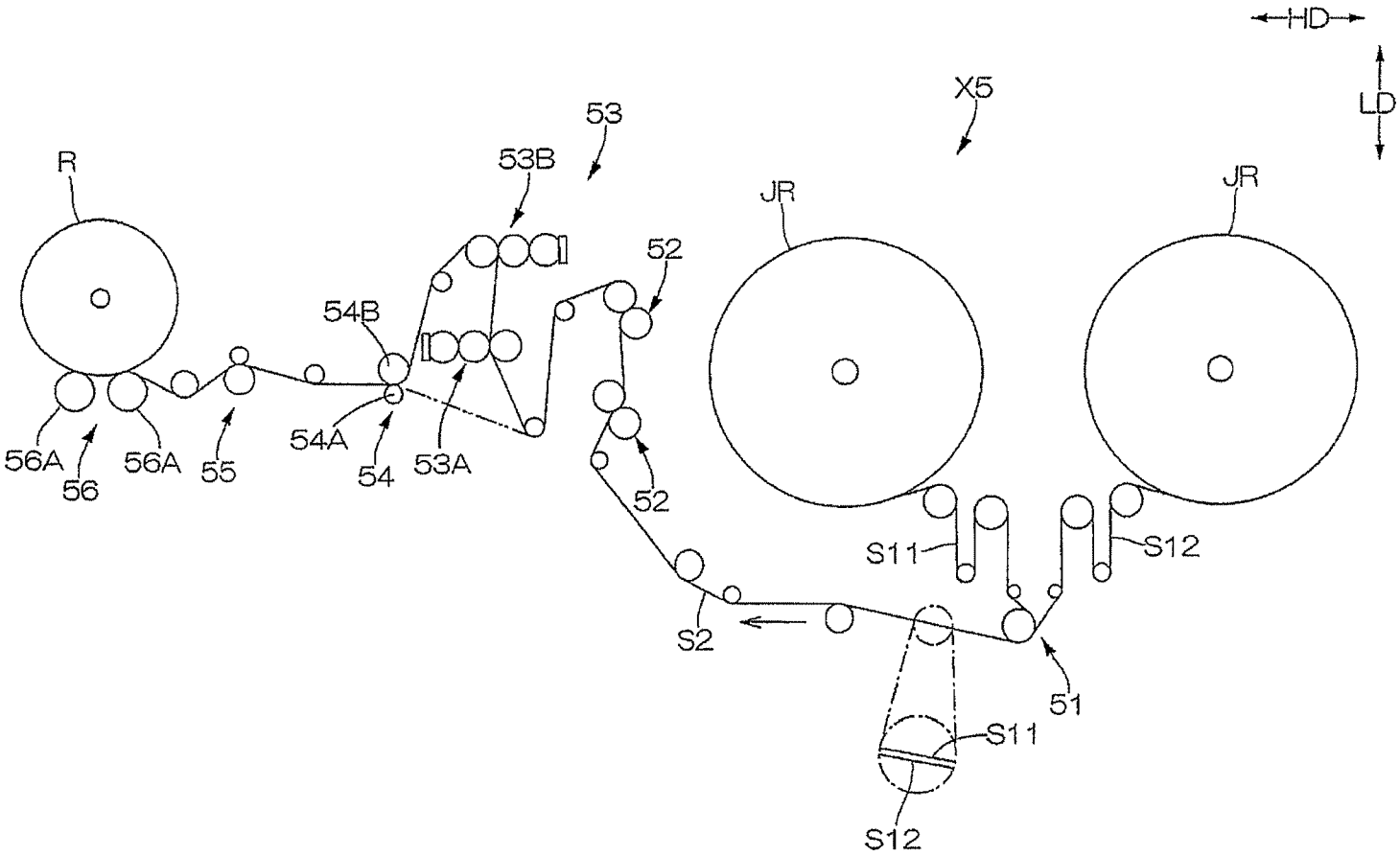
FIG. 22 is a schematic diagram illustrating another facility and another method of manufacturing a secondary paper roll.

As illustrated in FIG. 22, the pair of calender units 52 may be arranged along the vertical direction, and the pair of chemicals applying units 53 may be arranged along the vertical direction.

A method of manufacturing a secondary paper roll for tissue paper products using a facility X5 for manufacturing the secondary paper roll for tissue paper products is as below.

As illustrated in FIG. 22, in the method of manufacturing the secondary paper roll for the tissue paper products according to the embodiment, the single-sheets (S11 and S12 in the example illustrated in the drawing) from the primary paper rolls, reeled out from the plural primary paper rolls are multi-ply formed by the ply unit 51 along the continuous direction so as to form the multi-ply formed continuous sheet S2 (the multi-ply forming step), the calendering process is performed on the multi-ply continuous sheet S2 by the pair of calender units 52 (the calendering step), the chemicals are applied to the multi-ply continuous sheet S2 by the pair of chemicals applying units 53 (the chemicals applying step), the ply bonding is applied to the multi-ply continuous sheet S2 by the ply bonding unit 54 (the ply bonding step), the multi-ply continuous sheet S2 is slit by the slitting unit 55 into each product width of the tissue paper products or several fold widths thereof (the slitting step), and then the multi-ply continuous sheets S2 slit in the slitting step are coaxially wound by the winding unit 56 so as to form plural secondary paper rolls R of each product width of the tissue paper products or several fold widths thereof.

Furthermore, in a case where the tissue paper products coated with no chemicals are manufactured by the facility X5 for manufacturing the secondary paper roll for the tissue paper products, the multi-ply continuous sheet S2 may be directly conveyed from the calender unit 52 to the ply bonding unit 54 as depicted by the two-dotted chain line of FIG. 22, so that the multi-ply continuous sheet S2 may flow without passing through the chemicals applying unit 53.

[Sixth Facility and Method of Manufacturing Secondary Paper Roll for Tissue Paper Products]

Figure 28:
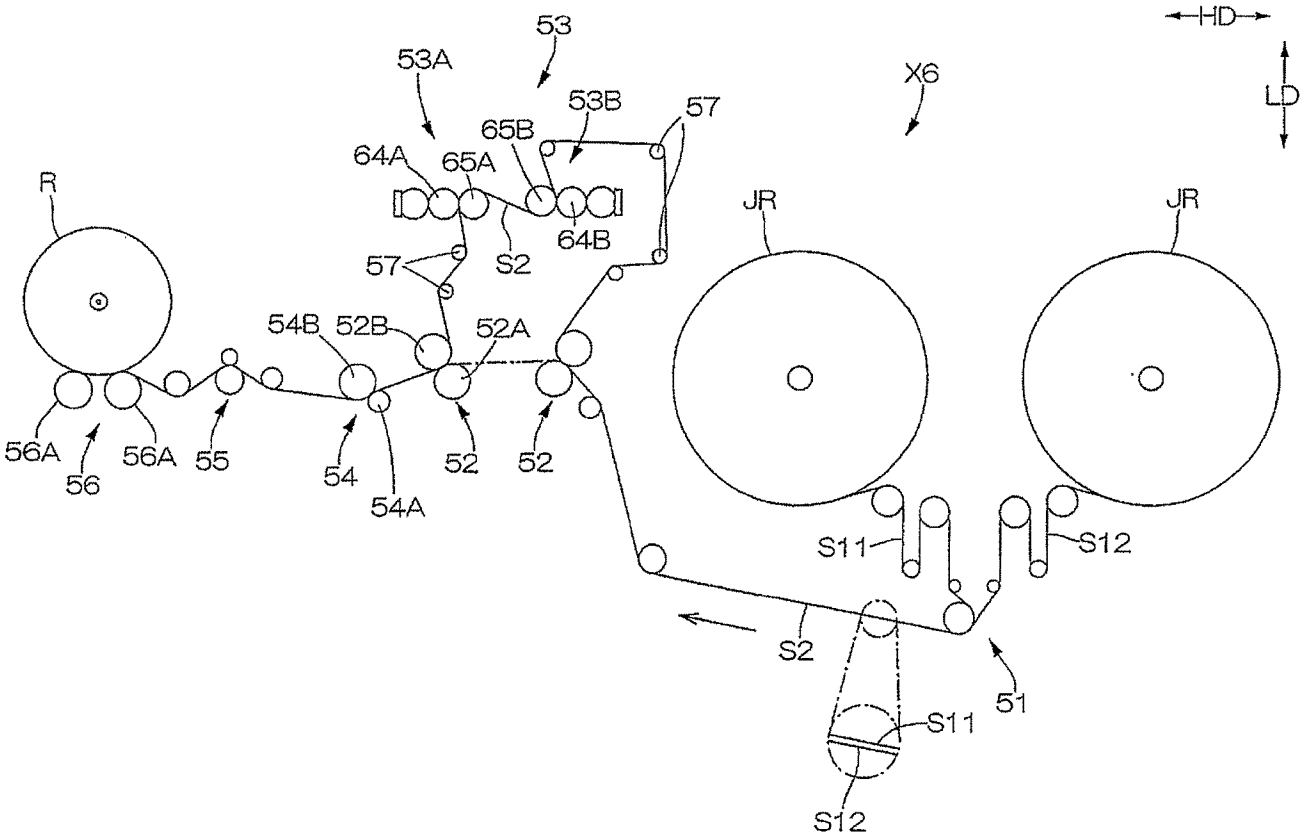
FIG. 28 is a schematic diagram illustrating another facility and another method of manufacturing a secondary paper roll.

As illustrated in FIG. 28, the facility for manufacturing the secondary paper roll for the tissue paper products of the invention has a configuration in which two calender units 52 are arranged in parallel in the horizontal direction and a pair of chamber type flexographic press machines disposed in the horizontal direction is disposed above the calender units.

A method of manufacturing a secondary paper roll for tissue paper products using a facility X6 for manufacturing a secondary paper roll for tissue paper products is as below.

First, the single-sheets (S11 and S12 in the example illustrated in the drawing) from the primary paper rolls, reeled out from the plural primary paper rolls are multi-ply formed by the ply unit 51 along the continuous direction so as to form the multi-ply continuous sheet S2 (the multi-ply forming step), and the calendering process is performed on the multi-ply continuous sheet S2 at the first step by the calender unit 52 (the calendering step). Next, the multi-ply continuous sheet S2 passing through the calender unit 52 is made to reach the upside of the flexographic press machine by appropriately installing a tension control unit such as an expander roll and a guide unit 57 such as a guide roll. Then, the multi-ply continuous sheet S2 passes between the press plate roll 64B and the elastic roll 65B of the upstream flexographic press machine 53B in the pair of flexographic press machines in the direction from the upside to the downside, so that the chemicals are applied to one surface thereof. Next, the multi-ply continuous sheet S2 coated with the chemicals at one surface is guided upward along the elastic roll 65B, and is made to reach the upside of the downstream flexographic press machine 53A through the guide unit 57 such as the guide roll. Then, the multi-ply continuous sheet S2 passes between the elastic roll 65A and the press plate roll 65B of the downstream flexographic press machine 53A in a direction from the upside to the downside, so that the chemicals is completely applied to both surfaces thereof.

When the chemicals are applied to the multi-ply continuous sheet S2 by the pair of flexographic press machines, the ply bonding is applied to the multi-ply continuous sheet S2 by the ply bonding unit 54 (the ply bonding step), the multi-ply continuous sheet S2 is slit by the slitting unit 55 into each product width of the tissue paper products or several fold widths thereof (the slitting step), and then the multi-ply continuous sheets S2 slit in the slitting step are coaxially wound by the winding unit 56 so as to form plural secondary paper rolls R of each product width of the tissue paper products or several fold widths thereof.

Furthermore, in a case where the tissue paper products coated with no chemicals are manufactured by the facility X6 for manufacturing the secondary paper roll for the tissue paper products, the multi-ply continuous sheet S2 may be directly conveyed from the calender unit 52 to the ply bonding unit 54 as depicted by the two-dotted chain line of FIG. 28, so that the multi-ply continuous sheet S2 may flow without passing through the chemicals applying unit 53.

Furthermore, in the embodiment, the chamber type flexographic press machine is exemplified as the chemicals applying unit, but the invention is not limited thereto. The embodiment discloses a configuration in which the multi-ply continuous sheet passes between the press plate roll and the elastic roll from the upside toward the downside.

Further, in the embodiment, there is a merit that paper dust is less produced.

Example

Next, tissue paper products (example) were manufactured by the multi-stand type interfolder using the secondary paper roll manufactured by the method of manufacturing the secondary paper roll X1 for the tissue paper products illustrated in FIG. 11, and was compared with comparative examples.

(With Regard to Table 1 and Table 2)

All comparative examples of Table 1 and Table 2 are commercially available products, where the comparative example A1 indicates a non-moisturizing general tissue paper, the comparative examples A2 to A4 indicate moisturizing lotion type tissue paper, and the comparative examples A5 and A6 indicate non-moisturizing high-quality tissue paper having high square meter basis weight and large paper thickness.

The respective parameters illustrated in Table 1 and Table 2 are as below.

Square meter basis weight (basis weight) . . . the measurement was performed according to JIS P 8124 (1998). In a case of double-ply tissue paper products, the average square meter basis weight of the double-ply sheet was recorded.

Paper thickness . . . the measurement was performed by a dial thickness gauge (thickness measurement unit) 'PEACOCK G type' (manufactured by Ozaki. Co., Ltd.) under the condition of JIS P 8111 (1998).

Product density . . . the density of the products is a value which is obtained by dividing a value (C) in which the square meter basis weight of the tissue paper products humidified under the condition of JIS P 8111 becomes twice by a paper thickness (D) in the tissue paper (two plies) of 'PEACOCK G type', is expressed by the unit of g/cm$^3$, and is expressed as three decimal places.

Dry tensile strength . . . the measurement is performed according to the tensile test of JIS P 8113 (1998). Specifically, a plunger is moved down on a measurement table by checking whether dirt or sediment is present between the plunger and the measurement table, and the memory of the dial thickness gauge is moved to the zero point. Subsequently, the plunger is moved up to place a specimen on a test table, and the plunger is gradually moved down so as to read the gauge at this time. At this time, the plunger is just loaded thereon. The terminal of the plunger is formed of metal so that the circular plane having a diameter of 10 mm is perpendicular to the plane of the paper, and the load during the measurement of the paper thickness is about 70 gf. Furthermore, the paper thickness is set to an average value obtained from the measurement performed ten times.

Wet tensile strength . . . the measurement is performed according to JIS P 8135 (1998).

Extension rate . . . the measurement is performed by the 'tensile and compression testing machine TG-200 N' manufactured by Minebea Co., Ltd.

Softness . . . the measurement is performed based on the Handle-O-Meter according to JIS L1096 E. However, the test piece is set to the size of 100 mm×100 mm, and the clearance is 5 mm. One ply was measured five times for each of the longitudinal direction and the transverse direction, the average value of the total measurement performed ten times is expressed by one decimal, and is expressed by the unit of cN/100 mm.

Static friction coefficient . . . the measurement is performed by the following method according to JIS P 8147 (1998). The tissue paper which is peeled out as one ply is attached to the acrylate plate so that the outer surface of the paper faces the outside. The tissue paper as two plies is wounded on the tender of 100 g, and the tissue is loaded on the acrylate plate. The acrylate plate is inclined so as to measure an angle at which the tender slides to drop therefrom. The angle is measured four times in the direction MD, and is performed four times in the direction CD, which is eight times in total. Then, the average angle is calculated, and the tangent value is set to the static friction coefficient.

Figure 27:
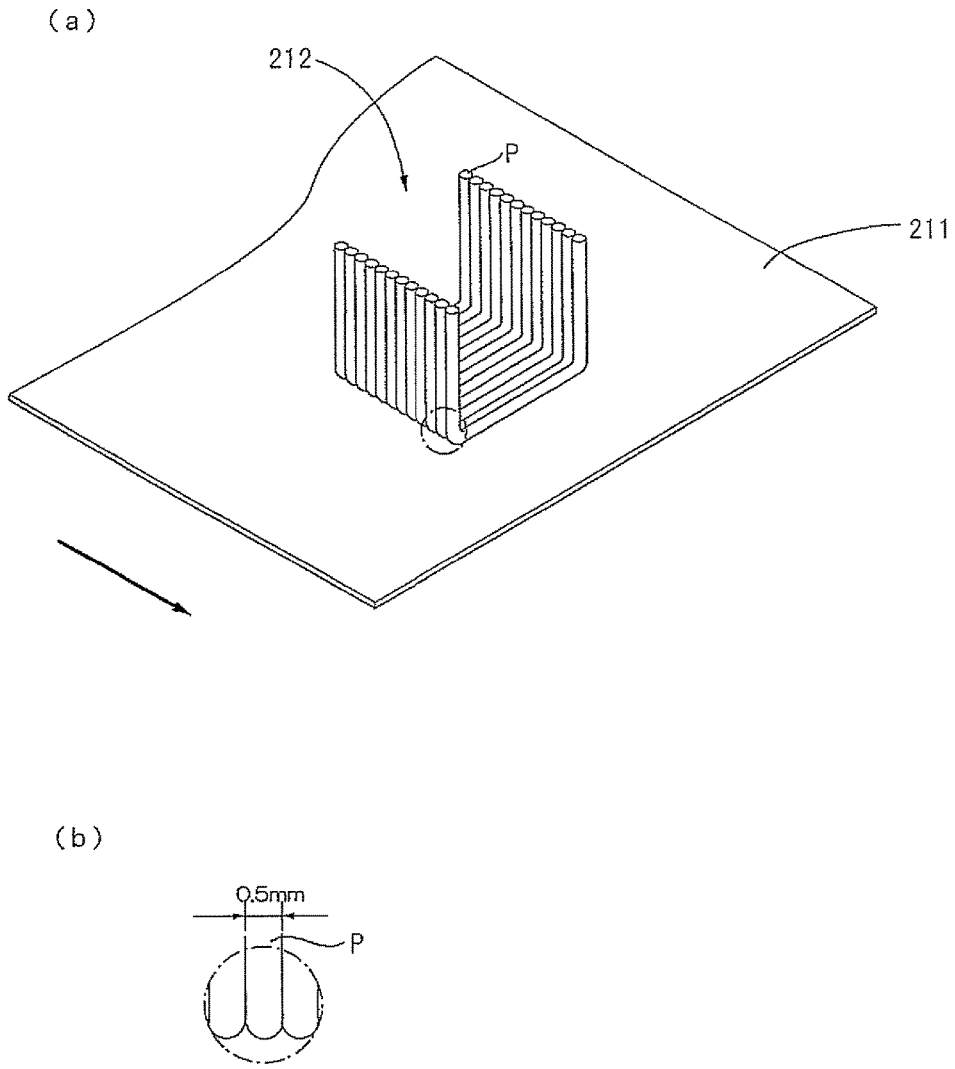
FIG. 27 is a diagram illustrating a method of measuring a value MMD of tissue paper.

MMD . . . It is an average deviation MMD of the static friction coefficient. MMD is one of indexes of smoothness, and it is considered that the subject is smooth as the numeral value decreases and the subject is not smooth as the numeral value increases. Furthermore, as the method of measuring the value MMD, as illustrated in FIG. 27(*a*), a contact surface of a friction member 212 contacts the surface of the tissue paper 211 as the measurement specimen which is tensioned by 20 g/cm in a predetermined direction (the rightward inclined down direction of FIG. 27(*a*)) at the contact pressure of 25 g, and is moved by 2 cm at the speed of 0.1 cm/s in the same direction as the direction in which the tension is applied. At this time, the friction coefficient is measured by a friction tester KES-SE (manufactured by Kato Tech Co., Ltd.), and a value obtained by dividing the friction coefficient by the friction distance (the movement distance=2 cm) is set to the value MMD. Furthermore, the friction member 212 is formed by disposing twenty piano lines P having a diameter of 0.5 mm so as to be adjacent to each other, and has a contact surface of which the length and the width are all 10 mm. The contact surface is provided with a unit swollen portion of which the front end is formed by twenty piano lines P (having a curvature radius of 0.25 mm). Furthermore, FIG. 27(*a*) schematically illustrates the friction member 212, and FIG. 27(*b*) is an enlarged view of the portion encircled by the one-dotted chain line of FIG. 27(*a*).

Moisture percentage . . . the measurement is performed according to JIS P 8111 (1998).

Chemicals containing amount . . . the chemicals application amount indicates the chemicals component containing amount in which the chemicals are contained in a dried state (absolutely dried) for each unit area of the tissue paper in the standard state of JIS P 8111, and specifically, indicates the component containing amount other than the moisture in the applied chemicals. The unit area of the tissue paper is an area in which the plied sheet is seen along the line perpendicular to the plane, and does not indicate the total area of the respective plied sheets and the front and rear surfaces.

Chemicals containing ratio . . . the chemicals application ratio indicates the ratio (%) obtained by dividing (B) by (A), where a predetermined mass of tissue paper products humidified under the condition of JIS P 8111 is defined as the denominator (A) (g) and the mass (B) (g) obtained by excluding the moisture in the chemicals contained in a predetermined mass of the tissue paper products.

$$(\text{chemicals containing ratio } \%)=(B)\div(A)\times 100(\%)$$

Organoleptic evaluation . . . the organoleptic evaluation based on the following standard for the softness, the smoothness, the thickness, and the moisture was performed on the example A1 and the comparative examples A1, A2, A5, and A6 by the subject of eighty seven consumers (Table 1). Further, the organoleptic evaluation was performed on the examples A1 to A3 and the comparative examples A1 to A4 by the subject of twelve separate persons (Table 2). Furthermore, the evaluation standard is set such that the score of the non-moisturizing general tissue paper coated with no chemicals is set to '3', the sensation of 'very excellent' is set to '5', the sensation of 'excellent' is set to '4', the sensation of 'equal to the standard' is set to '3', the sensation of 'poor' is set to '2', and the sensation of 'very poor' is set to '1'. Furthermore, as for the tissue paper coated with the chemicals, the presence of stickiness was performed, and the evaluation standard is set such that 'little stickiness' is indicated by '○' and 'obvious stickiness' is indicated by 'x'.

TABLE 1

| | | | EXAMPLE A1 | EXAMPLE A2 | EXAMPLE A3 | EXAMPLE A4 | EXAMPLE A5 |
|---|---|---|---|---|---|---|---|
| BASE PAPER CONDITION | PULP MIXTURE RATIO | — | N:L = 3:7 | N:L = 3:7 | N:L = 3:7 | N:L = 3:7 | N:L = 3:7 |
| | CREPE RATIO | % | 20.5 | 19.0 | 20.5 | 19.0 | 19.0 |
| | SOFTENER | % | — | — | — | — | — |
| | STARCH | % | — | — | — | — | — |
| | WET PAPER STRENGTHENING AGENT | kg/t | 11.0 | 11.0 | 11.0 | 11.0 | 11.0 |
| APPLICATION OF CHEMICALS | APPLICATION OF CHEMICALS | YES/NO | YES | YES | YES | YES | YES |
| | MOISTURE CONTAINING AMOUNT | MASS % | 12 | 21 | 12 | 12 | 12 |
| | VISCOSITY (40° C.) | mPa · s | 110 | 110 | 110 | 110 | 110 |
| | APPLICATION TYPE | | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER |
| | APPLICATION SPEED | m/minute | 250 | 250 | 250 | 800 | 950 |
| CHEMICALS CONTAINING AMOUNT (ABSOLUTELY DRYED) | SUM OF CONTAINING AMOUNTS OF BOTH SURFACES | $g/m^2$ | 3.6 | 1.4 | 4.4 | 4.0 | 4.4 |
| | FIRST COATED SURFACE | $g/m^2$ | 1.8 | 0.7 | 2.2 | 2.0 | 2.2 |
| | SECOND COATED SURFACE | $g/m^2$ | 1.8 | 0.7 | 2.2 | 2.0 | 2.2 |
| | RATIO (FIRST SURFACE:SECOND SURFACE) | — | 50:50 | 50:50 | 50:50 | 50:50 | 50:50 |
| | CHEMICALS CONTAINING RATIO | MASS % | 12.1 | 5.8 | 13.9 | 13.0 | 13.8 |
| PRODUCTS | SQUARE METER BASIS WEIGHT (1P) | $g/m^2$ | 14.9 | 12.0 | 15.8 | 15.4 | 15.9 |
| | PAPER THICKNESS (2P) | μm | 113 | 95 | 137 | 123 | 135 |
| | DENSITY | g/cm3 | 0.264 | 0.253 | 0.231 | 0.250 | 0.236 |
| 2P | LONGITUDINAL DRY TENSILE STRENGTH | cN/25 mm | 231 | 237 | 247 | 240 | 242 |
| 2P | TRANSVERSE DRY TENSILE STRENGTH | cN/25 mm | 81 | 78 | 87 | 83 | 85 |
| 2P | LONGITUDINAL WET TENSILE STRENGTH | cN/25 mm | 96 | 91 | 101 | 98 | 100 |
| 2P | TRANSVERSE WET TENSILE STRENGTH | cN/25 mm | 38 | 34 | 45 | 40 | 43 |
| 2P | EXTENSION RATE (LONGITUDINAL) | % | 13.7 | 12.9 | 14.2 | 13.7 | 14.0 |
| 1P | SOFTNESS | cN/100 mm | 1.12 | 0.98 | 1.37 | 1.35 | 1.36 |
| 1P | MMD (UPPER SIDE) | 1/100 | 8.0 | 7.4 | 8.2 | 8.1 | 8.1 |
| 2P | STATIC FRICTION COEFFICIENT | — | 0.62 | 0.67 | 0.65 | 0.66 | 0.64 |
| | MOISTURE CONTAINING RATIO | % | 8.3 | 7.6 | 8.9 | 8.6 | 9.0 |
| | SHEET EXTRACTION DIRECTION | — | CD | CD | CD | CD | CD |

TABLE 1-continued

| | | |
|---|---|---|
| ORGANO-LEPTIC EVALU-ATION | SOFTNESS | 5 |
| | SMOOTHNESS | 5 |
| | THICKNESS | 2 |
| | MOISTURE | 5 |
| | STICKINESS | o |

| | | | COM-PARA-TIVE EX-AMPLE A1 | COM-PARA-TIVE EX-AMPLE A2 | COM-PARA-TIVE EX-AMPLE A3 | COM-PARA-TIVE EX-AMPLE A4 | COM-PARA-TIVE EX-AMPLE A5 | COM-PARA-TIVE EX-AMPLE A6 |
|---|---|---|---|---|---|---|---|---|
| BASE PAPER CONDITION | PULP MIXTURE RATIO | — | N:L = 3:7 | N:L = 6:4 | — | — | — | — |
| | CREPE RATIO | % | 16.0 | 14.0 | — | — | — | — |
| | SOFTENER | % | 0.45 | 0.6 | — | — | — | — |
| | STARCH | % | 8.0 | 7.0 | — | — | — | — |
| | WET PAPER STRENGTHENING AGENT | kg/t | 7.0 | 17.0 | — | — | — | — |
| APPLICATION OF CHEMICALS | APPLICATION OF CHEMICALS | YES/NO | NO | YES | YES | YES | NO | NO |
| | MOISTURE CONTAINING | MASS % | | 12 | — | — | | |
| | AMOUNT | | | 110 | — | — | | |
| | VISCOSITY (40° C.) | mPa · s | | ROLL | — | — | | |
| | APPLICATION | — | | TRANSFER | — | — | | |
| | TYPE | | | TYPE | | | | |
| | | | | GRAVURE TRANSFER | — | — | | |
| | APPLICATION SPEED | m/minute | | 100 | — | — | | |
| CHEMICALS CONTAINING AMOUNT (ABSO-LUTELY DRYED) | SUM OF CONTAINING AMOUNTS OF BOTH SURFACES | $g/m^2$ | | 5.6 | — | — | — | — |
| | FIRST COATED SURFACE | $g/m^2$ | | 2.8 | — | — | — | — |
| | SECOND COATED SURFACE | $g/m^2$ | | 2.8 | — | — | — | — |
| | RATIO (FIRST SURFACE:SECOND SURFACE) | — | | 50:50 | — | — | — | — |
| | CHEMICALS CONTAINING RATIO | MASS % | | 17.2 | | | | |
| PRODUCTS | SQUARE METER BASIS WEIGHT (1P) | $g/m^2$ | 12.2 | 16.3 | 17.5 | 14.8 | 14.9 | 15.5 |
| | PAPER THICKNESS (2P) | μm | 144 | 143 | 159 | 140 | 170 | 205 |
| | DENSITY | g/cm3 | 0.169 | 0.228 | 0.220 | 0.211 | 0.175 | 0.151 |
| 2P | LONGITUDINAL DRY TENSILE STRENGTH | cN/25 mm | 287 | 259 | 283 | 251 | 261 | 291 |
| 2P | TRANSVERSE DRY TENSILE STRENGTH | cN/25 mm | 105 | 75 | 59 | 64 | 76 | 107 |
| 2P | LONGITUDINAL WET TENSILE STRENGTH | cN/25 mm | 90 | 137 | 119 | 84 | 115 | 121 |
| 2P | TRANSVERSE WET TENSILE STRENGTH | cN/25 mm | 28 | 40 | 32 | 29 | 37 | 34 |
| 2P | EXTENSION RATE (LONGITUDINAL) | % | 8.4 | 12.0 | 11.2 | 13.3 | 10.7 | 13.6 |
| 1P | SOFTNESS | cN/100 mm | 1.69 | 1.18 | 1.87 | 1.50 | 1.78 | 1.78 |
| 1P | MMD (UPPER SIDE) | 1/100 | 9.0 | 7.1 | 6.4 | 6.5 | 7.5 | 7.3 |
| 2P | STATIC FRICTION COEFFICIENT | — | 0.83 | 0.70 | 0.80 | 0.75 | 0.75 | 0.87 |
| | MOISTURE CONTAINING RATIO | % | 6.5 | 10.5 | 9.3 | 10.0 | 6.5 | 6.9 |
| | SHEET EXTRACTION DIRECTION | — | CD | MD | MD | MD | MD | MD |
| ORGANO-LEPTIC EVALU-ATION | SOFTNESS | | 3 | 5 | | | 3 | 3 |
| | SMOOTHNESS | | 3 | 4 | | | 3 | 3 |
| | THICKNESS | | 3 | 3 | | | 5 | 4 |
| | MOISTURE | | 3 | 5 | | | 3 | 3 |
| | STICKINESS | | — | x | | | — | — |

TABLE 2

| | | | EXAMPLE A1 | EXAMPLE A2 | EXAMPLE A3 | EXAMPLE A4 | EXAMPLE A5 |
|---|---|---|---|---|---|---|---|
| PRODUCTS | SQUARE METER BASIS WEIGHT (1P) | $g/m^2$ | 14.9 | 12.0 | 15.8 | 15.4 | 15.9 |
| | PAPER THICKNESS (2P) | μm | 113 | 95 | 137 | 123 | 135 |
| | DENSITY | $g/cm^3$ | 0.264 | 0.253 | 0.231 | 0.250 | 0.236 |
| 2P | LONGITUDINAL DRY TENSILE STRENGTH | cN/25 mm | 231 | 237 | 247 | 240 | 242 |
| 2P | TRANSVERSE DRY TENSILE STRENGTH | cN/25 mm | 81 | 78 | 87 | 81 | 85 |
| 2P | LONGITUDINAL WET TENSILE STRENGTH | cN/25 mm | 96 | 91 | 101 | 98 | 100 |
| 2P | TRANSVERSE WET TENSILE STRENGTH | cN/25 mm | 38 | 34 | 45 | 40 | 43 |
| 2P | EXTENSION RATE (LONGITUDINAL) | % | 13.7 | 12.9 | 14.2 | 13.7 | 14.0 |
| 1P | SOFTNESS | cN/100 mm | 1.12 | 0.98 | 1.37 | 1.35 | 1.36 |
| 1P | MMD (UPPER SIDE) | 1/100 | 8.0 | 7.4 | 8.2 | 8.1 | 8.1 |
| 2P | STATIC FRICTION COEFFICIENT | — | 0.62 | 0.67 | 0.65 | 0.66 | 0.64 |
| | MOISTURE CONTAINING RATIO | % | 8.3 | 7.6 | 8.9 | 8.9 | 9.0 |
| | SHEET EXTRACTION DIRECTION | — | CD | CD | CD | CD | CD |
| ORGANOLEPTIC EVALUATION | SOFTNESS | | 4 | 4 | 4 | 4 | 4 |
| | SMOOTHNESS | | 5 | 4 | 4 | 4 | 4 |
| | THICKNESS | | 3 | 3 | 4 | 4 | 4 |
| | MOISTURE | | 4 | 4 | 4 | 4 | 4 |
| | STICKINESS | | o | o | o | o | o |

| | | | COMPARATIVE EXAMPLE Al | COMPARATIVE EXAMPLE A2 | COMPARATIVE EXAMPLE A3 | COMPARATIVE EXAMPLE A4 |
|---|---|---|---|---|---|---|
| PRODUCTS | SQUARE METER BASIS WEIGHT (1P) | $g/m^2$ | 12.2 | 16.3 | 17.5 | 14.8 |
| | PAPER THICKNESS (2P) | μm | 144 | 143 | 159 | 140 |
| | DENSITY | $g/cm^3$ | 0.169 | 0.228 | 0.220 | 0.211 |
| 2P | LONGITUDINAL DRY TENSILE STRENGTH | cN/25 mm | 287 | 259 | 283 | 251 |
| 2P | TRANSVERSE DRY TENSILE STRENGTH | cN/25 mm | 105 | 75 | 59 | 64 |
| 2P | LONGITUDINAL WET TENSILE STRENGTH | cN/25 mm | 90 | 137 | 119 | 84 |
| 2P | TRANSVERSE WET TENSILE STRENGTH | cN/25 mm | 28 | 40 | 32 | 29 |
| 2P | EXTENSION RATE (LONGITUDINAL) | % | 8.4 | 12.0 | 11.2 | 13.3 |
| 1P | SOFTNESS | cN/100 mm | 1.69 | 1.18 | 1.87 | 1.50 |
| 1P | MMD (UPPER SIDE) | 1/100 | 9.0 | 7.1 | 6.4 | 6.5 |
| 2P | STATIC FRICTION COEFFICIENT | — | 0.83 | 0.70 | 0.80 | 0.75 |
| | MOISTURE CONTAINING RATIO | % | 6.5 | 10.5 | 9.3 | 10.0 |
| | SHEET EXTRACTION DIRECTION | — | CD | MD | MD | MD |

TABLE 2-continued

| | | | | | |
|---|---|---|---|---|---|
| ORGANOLEPTIC EVALUATION | SOFTNESS | 3 | 5 | 4 | 5 |
| | SMOOTHNESS | 3 | 5 | 4 | 4 |
| | THICKNESS | 3 | 4 | 4 | 4 |
| | MOISTURE | 3 | 5 | 4 | 4 |
| | STICKINESS | — | x | x | x |

As understood from the results of Table 1 and Table 2, in the tissue paper products which are manufactured by the multi-stand type interfolder using the secondary paper roll manufactured by using the method of manufacturing the secondary paper roll for the tissue paper products, the dry tensile strength and the wet tensile strength in the direction CD are higher than that of the commercially available moisturizing tissue. Further, the wet tensile strength in the direction CD is higher than that of the existing general tissue paper. Further, the softness and the static friction coefficient are lower than the other products, and the paper is smooth and soft.

In the organoleptic evaluation, in the tissue paper according to the invention, the thickness is not excellent, but the softness, the smoothness, and the moisture are equal to or larger than those of the moisturizing tissue. Furthermore, the stickiness appearing in the moisturizing tissue is reduced.

Particularly, the satisfactory slippage may be obtained by the following factor. Although it is different according to the permeability of the chemicals applied to the tissue paper, in a case where the chemicals containing both hydrophilic and lipophilic components are applied, the hydrophilic component is absorbed into the pulp and the lipophilic component easily remains on the surface of the paper, which reduces the friction of the surface. However, when the chemicals application amount increases as in the existing moisturizing tissue, the hydrophilic component is not sufficiently absorbed into the pulp, but remains on the surface thereof. Accordingly, the friction reducing effect of the lipophilic component may decrease, and the slippage may be degraded due to the viscosity of the hydrophilic component (glycerin or the like).

Further, as understood from the examples 4 and 5, in the invention, even when the application speed is set to 800 m/minutes and 950 m/minutes, it is found that the tissue paper products having sufficiently excellent quality are obtained with high productivity.

(With Regard to Table 3 and Table 4)

The comparative examples in Table 3 and Table 4 are all commercialized products, where the comparative example B1 indicates a non-moisturizing general tissue paper, the comparative examples B2, B5, and B6 indicate a moisturizing tissue paper, and the comparative examples B7 and B8 indicate the non-moisturizing high quality tissue paper having a high square meter basis weight and a large paper thickness. The comparative example B3 indicates a tissue paper specimen in which the content of the lipophilic component in the chemicals increases, and the comparative example B4 indicates a tissue paper specimen in which the silicon containing ratio in the chemicals is larger than the specific amount.

The respective parameters illustrated in Table 3 and Table 4 are the same as the respective parameters illustrated in Table 1 and Table 2. Furthermore, the water absorbency indicates the 'water absorbency' according to JIS S-3104, and is obtained by measuring the number of seconds taken for absorbing a predetermined amount of moisture from the surface of the tissue. Both surfaces of the tissue are respectively measured five times, and the average value obtained by the measurement performed ten times is expressed by the number of seconds.

In the organoleptic evaluation, the organoleptic evaluation based on the following standard for the softness, the smoothness, the thickness, and the moisture was performed on the examples B1 and B3 and the comparative examples B1 to B4, B7, and B8 by the subject of eighty seven consumers (Table 3). Further, the organoleptic evaluation was performed on the examples B1 to B4 and the comparative examples B1, B2, B5, and B6 by the subject of separate twelve persons (Table 4). Furthermore, the evaluation standard is set such that the score of the non-moisturizing general tissue paper coated with no chemicals is set to '3', the sensation of 'very excellent' is set to '5', the sensation of 'excellent' is set to '4', the sensation of 'equal to the standard' is set to '3', the sensation of 'poor' is set to '2', and the sensation of 'very poor' is set to '1'. Furthermore, as for the tissue paper coated with the chemicals, the presence of stickiness was performed, and the evaluation standard is set such that 'little stickiness' is indicated by '○' and 'obvious stickiness' is indicated by 'x'.

TABLE 3

| | | | EXAMPLE B1 | EXAMPLE B2 | EXAMPLE B3 | EXAMPLE B4 | EXAMPLE B5 | EXAMPLE B6 | COMPARATIVE EXAMPLE B1 | COMPARATIVE EXAMPLE B2 |
|---|---|---|---|---|---|---|---|---|---|---|
| BASE PAPER CONDITION | PULP MIXTURE RATIO | — | N:L = 3:7 | N:L = 3:7 | N:L = 3:7 | N:L = 3:7 | N:L = 3:7 | N:L = 3:7 | N:L = 3:7 | N:L = 6:4 |
| | CREPE RATIO | % | 20.5 | 19.0 | 21.0 | 20.5 | 19.0 | 19.0 | 16.0 | 14.0 |
| | SOFTENER | % | — | — | — | — | — | — | 0.45 | 0.6 |
| | STARCH | % | — | — | — | — | — | — | 8.0 | 7.0 |
| | WET PAPER STRENGTHENING AGENT | Kg/t | 11.0 | 11.0 | 11.0 | 11.0 | 11.0 | 11.0 | 7.0 | 17.0 |
| APPLICATION OF CHEMICALS | APPLICATION OF CHEMICALS | YES/NO | YES | YES | YES | YES | YES | YES | NO | YES |
| | MOISTURE CONTAINING AMOUNT | MASS % | 12 | 12 | 12 | 12 | 12 | 12 | | 12 |
| | VISCOSITY (40° C.) | mPa - S | 110 | 110 | 110 | 110 | 110 | 110 | | 110 |
| | APPLICATION TYPE | — | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | DOCTOR CHAMBER TYPE FLEXO-GRAPHIC TRANSFER | | ROLL TRANSFER TYPE GRAVURE TRANSFER |
| | APPLICATION SPEED | m/minute | 250 | 250 | 250 | 250 | 800 | 950 | | 100 |
| CHEMICALS AGENT COMPONENT CONTAINING RATIO | OILY COMPONENT | MASS % | 3 | 3 | 3 | 3 | 3 | 3 | | 3 |
| | SILICON CONTAINING AMOUNT | MASS % | 0.05 | 0.05 | 0.05 | 0.05 | 0.5 | 0.5 | | 0.05 |
| CHEMICALS CONTAINING AMOUNT (ABSOLUTELY DRYED) | SUM OF CONTAINING AMOUNTS OF BOTH SURFACES | $g/m^2$ | 3.6 | 1.4 | 4.0 | 4.4 | 4.0 | 4.4 | | 5.6 |
| | FIRST COATED SURFACE | $g/m^2$ | 1.8 | 0.7 | 2.0 | 2.2 | 2.0 | 2.2 | | 2.8 |
| | SECOND COATED SURFACE | $g/m^2$ | 1.8 | 0.7 | 2.0 | 2.2 | 2.0 | 2.2 | | 2.8 |
| | RATIO (FIRST: SECOND) | — | 50:50 | 50:50 | 50:50 | 50:50 | 50:50 | 50:50 | | 50:50 |
| | CHEMICALS COTAINING RATIO | MASS % | 12.1 | 5.8 | 13.4 | 13.9 | 13.0 | 13.8 | | 17.2 |
| PRODUCTS | SQUARE METER BASIS WEIGHT (1P) | $g/m^2$ | 14.9 | 12.0 | 15.5 | 15.8 | 15.4 | 15.9 | 12.2 | 16.3 |
| | PAPER THICKNESS (2P) | μm | 113 | 95 | 162 | 137 | 123 | 135 | 144 | 143 |
| | DENSITY | g/cm3 | 0.264 | 0.253 | 0.191 | 0.231 | 0.250 | 0.236 | 0.169 | 0.228 |

TABLE 3-continued

| | | | | | | | | | | |
|---|---|---|---|---|---|---|---|---|---|---|
| 2P | LONGITUDINAL DRY TENSILE STRENGTH | cN/25 mm | 231 | 237 | 279 | 247 | 240 | 242 | 287 | 259 |
| 2P | TRANSVERSE DRY TENSILE STRENGTH | cN/25 mm | 81 | 78 | 107 | 87 | 83 | 85 | 105 | 75 |
| 2P | LONGITUDINAL WET TENSILE STRENGTH | cN/25 mm | 96 | 91 | 110 | 101 | 98 | 100 | 90 | 137 |
| 2P | TRANSVERSE WET TENSILE STRENGTH | cN/25 mm | 38 | 34 | 53 | 45 | 40 | 43 | 28 | 40 |
| 2P | EXTENSION RATE (LONGITUDINAL) | % | 13.7 | 12.9 | 13.0 | 14.2 | 13.7 | 14.0 | 8.4 | 12.0 |
| 1P | SOFTNESS | cN/100 mm | 1.12 | 0.98 | 1.51 | 1.37 | 1.35 | 1.36 | 1.69 | 1.18 |
| 1P | MMD (UPPER SIDE) | 1/100 | 8.0 | 7.4 | 9.2 | 8.2 | 8.1 | 8.1 | 9.0 | 7.1 |
| 1P | STATIC FRICTION COEFFICIENT | s | 4.3 | 5.2 | 3.9 | 4.7 | 3.9 | 4.6 | 3.6 | 12.6 |
| | MOISTURE CONTAINING RATIO | % | 8.3 | 7.6 | 8.6 | 8.9 | 8.6 | 9.0 | 6.5 | 10.5 |
| | SHEET EXTRACTION DIRECTION | — | CD | CD | CD | CD | CD | CD | CD | MD |
| ORGANO-LEPTIC EVALUATION | SOFTNESS | | 5 | | 4 | | 5 | 5 | 3 | 5 |
| | SMOOTHNESS | | 5 | | 4 | | 5 | 5 | 3 | 4 |
| | THICKNESS | | 2 | | 5 | | 4 | 5 | 3 | 3 |
| | MOISTURE | | 5 | | 4 | | 5 | 4 | 3 | 5 |
| | STICKINESS | | ○ | | ○ | | ○ | ○ | — | x |

| | | | | COMPARATIVE EXAMPLE B3 | COMPARATIVE EXAMPLE B4 | COMPARATIVE EXAMPLE B5 | COMPARATIVE EXAMPLE B6 | COMPARATIVE EXAMPLE B7 | COMPARATIVE EXAMPLE B8 |
|---|---|---|---|---|---|---|---|---|---|
| | BASE PAPER CONDITION | PULP MIXTURE RATIO | — | N:L = 3:7 | N:L = 3:7 | N.D. | N.D. | N.D. | N.D. |
| | | CREPE RATIO | % | 21.0 | 21.0 | N.D. | N.D. | N.D. | N.D. |
| | | SOFTENER | % | — | — | N.D. | N.D. | N.D. | N.D. |
| | | STARCH | % | — | — | N.D. | N.D. | N.D. | N.D. |
| | | WET PAPER STRENGTHENING AGENT | Kg/t | 11.0 | 11.0 | N.D. | N.D. | N.D. | N.D. |
| | APPLICATION OF CHEMICALS | APPLICATION OF CHEMICALS | YES/NO | YES | YES | YES | YES | NO | NO |
| | | MOISTURE CONTAINING AMOUNT | MASS % | 12 | 12 | N.D. | N.D. | | |
| | | VISCOSITY (40° C.) | mPa - S | 110 | 110 | N.D. | N.D. | | |

TABLE 3-continued

| | | | | | | | | |
|---|---|---|---|---|---|---|---|---|
| | APPLICATION TYPE | — | DOCTOR CHAMBER TYPE FLEXO-GRAPHIC TRANSFER | DOCTOR CHAMBER TYPE FLEXO-GRAPHIC TRANSFER | N.D. N.D. | N.D. N.D. | | |
| | APPLICATION SPEED | m/minute | 250 | 250 | N.D. | N.D. | | |
| CHEMICALS AGENT COMPONENT CONTAINING RATIO | OILY COMPONENT | MASS % | 9.5 | 3 | N.D. | N.D. | | |
| | SILICON CONTAINING AMOUNT | MASS % | 0.05 | 0.3 | N.D. | N.D. | | |
| CHEMICALS CONTAINING AMOUNT (ABSOLUTELY DRYED) | SUM OF CONTAINING AMOUNTS OF BOTH SURFACES | $g/m^2$ | 4.0 | 4.0 | N.D. | N.D. | | |
| | FIRST COATED SURFACE | $g/m^2$ | 2.0 | 2.0 | N.D. | N.D. | | |
| | SECOND COATED SURFACE | $g/m^2$ | 2.0 | 2.0 | N.D. | N.D. | | |
| | RATIO (FIRST: SECOND) | — | 50:50 | 50:50 | N.D. | N.D. | | |
| | CHEMICALS COTAINING RATIO | MASS % | 13.4 | 13.4 | 16.6 | 14.1 | | |
| PRODUCTS | SQUARE METER BASIS WEIGHT (1P) | $g/m^2$ | 15.6 | 15.7 | 17.5 | 14.8 | 14.9 | 15.5 |
| | PAPER THICKNESS (2P) | μm | 149 | 152 | 159 | 140 | 170 | 205 |
| | DENSITY | g/cm3 | 0.209 | 0.207 | 0.220 | 0.211 | 0.175 | 0.151 |
| 2P | LONGITUDINAL DRY TENSILE STRENGTH | cN/25 mm | 285 | 271 | 283 | 251 | 261 | 271 |
| 2P | TRANSVERSE DRY TENSILE STRENGTH | cN/25 mm | 99 | 100 | 59 | 64 | 76 | 107 |
| 2P | LONGITUDINAL WET TENSILE STRENGTH | cN/25 mm | 108 | 106 | 119 | 84 | 115 | 121 |
| 2P | TRANSVERSE WET TENSILE STRENGTH | cN/25 mm | 55 | 54 | 32 | 29 | 37 | 34 |
| 2P | EXTENSION RATE (LONGITUDINAL) | % | 15.9 | 15.2 | 11.2 | 13.3 | 10.7 | 13.6 |
| 1P | SOFTNESS | cN/100 mm | 1.43 | 1.44 | 1.87 | 1.50 | 1.78 | 1.78 |
| 1P | MMD (UPPER SIDE) | 1/100 | 8.5 | 8.4 | 6.4 | 6.5 | 7.5 | 7.3 |
| 1P | STATIC FRICTION COEFFICIENT | s | 7.7 | 10.2 | 20.3 | 7.6 | 3.7 | 2.2 |

TABLE 3-continued

| | | | | | | | | |
|---|---|---|---|---|---|---|---|---|
| | MOISTURE CONTAINING RATIO | % | 8.6 | 8.4 | 9.3 | 10.0 | 6.5 | 6.9 |
| | SHEET EXTRACTION DIRECTION | — | CD | CD | MD | MD | MD | MD |
| ORGANO-LEPTIC EVALUATION | SOFTNESS | | 4 | 4 | | | 3 | 3 |
| | SMOOTHNESS | | 4 | 4 | | | 3 | 3 |
| | THICKNESS | | 4 | 4 | | | 5 | 4 |
| | MOISTURE | | 4 | 4 | | | 3 | 3 |
| | STICKINESS | | ○ | ○ | | | — | — |

TABLE 4

| | | | EXAMPLE B1 | EXAMPLE B2 | EXAMPLE B3 | EXAMPLE B4 | EXAMPLE B5 | EXAMPLE B6 |
|---|---|---|---|---|---|---|---|---|
| PRODUCTS | SQUARE METER BASIS WEIGHT(1P) | $g/m^2$ | 14.9 | 12.0 | 15.5 | 15.8 | 15.4 | 15.9 |
| | PAPER THICKNESS (2P) | μm | 113 | 95 | 162 | 137 | 123 | 135 |
| | DENSITY | $g/cm^3$ | 0.264 | 0.253 | 0.191 | 0.231 | 0.250 | 0.236 |
| 2P | LONGITUDINAL DRY TENSILE STRENGTH | cN/25 mm | 231 | 237 | 279 | 247 | 240 | 242 |
| 2P | TRANSVERSE DRY TENSILE STRENGTH | cN/25 mm | 81 | 78 | 107 | 87 | 83 | 85 |
| 2P | LONGITUDINAL WET TENSILE STRENGTH | cN/25 mm | 96 | 91 | 110 | 101 | 98 | 100 |
| 2P | TRANSVERSE WET TENSILE STRENGTH | cN/25 mm | 38 | 34 | 53 | 45 | 40 | 43 |
| 2P | EXTENSION RATE (LONGITUDINAL) | % | 13.7 | 12.9 | 13.0 | 14.2 | 13.7 | 14.0 |
| 1P | SOFTNESS | cN/100 mm | 1.12 | 0.98 | 1.51 | 1.37 | 1.35 | 1.36 |
| 1P | MMD (UPPER SIDE) | 1/100 | 8.0 | 7.4 | 9.2 | 8.2 | 8.1 | 8.1 |
| 1P | STATIC FRICTION COEFFICIENT | s | 4.3 | 5.2 | 3.9 | 4.7 | 3.9 | 4.6 |
| | MOISTURE CONTAINING RATIO | % | 8.3 | 7.6 | 8.6 | 8.9 | 8.6 | 9.0 |
| | SHEET EXTRACTION DIRECTION | — | CD | CD | CD | CD | CD | CD |
| ORGANO-LEPTIC EVALUA-TION | SOFTNESS | | 4 | 4 | 3 | 4 | 4 | 5 |
| | SMOOTHNESS | | 5 | 4 | 4 | 4 | 4 | 4 |
| | THICKNESS | | 3 | 3 | 5 | 4 | 4 | 5 |
| | MOISTURE | | 4 | 4 | 4 | 4 | 4 | 5 |
| | STICKINESS | | o | o | o | o | o | o |

| | | | COMPARA-TIVE EXAMPLE B1 | COMPARA-TIVE EXAMPLE B2 | COMPARA-TIVE EXAMPLE B5 | COMPARA-TIVE EXAMPLE B6 |
|---|---|---|---|---|---|---|
| PRODUCTS | SQUARE METER BASIS WEIGHT(1P) | $g/m^2$ | 12.2 | 16.3 | 17.5 | 14.8 |
| | PAPER THICKNESS (2P) | μm | 144 | 143 | 159 | 140 |
| | DENSITY | $g/cm^3$ | 0.169 | 0.228 | 0.220 | 0.211 |
| 2P | LONGITUDINAL DRY TENSILE STRENGTH | cN/25 mm | 287 | 259 | 283 | 251 |
| 2P | TRANSVERSE DRY TENSILE STRENGTH | cN/25 mm | 105 | 75 | 59 | 64 |
| 2P | LONGITUDINAL WET TENSILE STRENGTH | cN/25 mm | 90 | 137 | 119 | 84 |
| 2P | TRANSVERSE WET TENSILE STRENGTH | cN/25 mm | 28 | 40 | 32 | 29 |
| 2P | EXTENSION RATE (LONGITUDINAL) | % | 8.4 | 12.0 | 11.2 | 13.3 |
| 1P | SOFTNESS | cN/100 mm | 1.69 | 1.18 | 1.87 | 1.50 |
| 1P | MMD (UPPER SIDE) | 1/100 | 9.0 | 7.1 | 6.4 | 6.5 |
| 1P | STATIC FRICTION COEFFICIENT | s | 3.6 | 12.6 | 20.3 | 7.6 |
| | MOISTURE CONTAINING RATIO | % | 6.5 | 10.5 | 9.3 | 10.0 |
| | SHEET EXTRACTION DIRECTION | — | CD | MD | MD | MD |

TABLE 4-continued

| | | | | | |
|---|---|---|---|---|---|
| ORGANO-LEPTIC EVALUA-TION | SOFTNESS | 3 | 5 | 4 | 5 |
| | SMOOTHNESS | 3 | 5 | 4 | 4 |
| | THICKNESS | 3 | 4 | 4 | 4 |
| | MOISTURE | 3 | 5 | 4 | 4 |
| | STICKINESS | — | x | x | x |

As understood from the results of Table 3 and Table 4, in the tissue paper products which are manufactured by the multi-stand type interfolder using the secondary paper roll manufactured by using the method of manufacturing the secondary paper roll for the tissue paper products, the dry tensile strength and the wet tensile strength in the direction CD are higher than that of the commercial moisturizing tissue. Further, the wet tensile strength in the direction CD is higher than that of the existing general tissue paper. Further, the water absorbency is significantly lower than the comparative examples B3 and B4 having a large amount of a water repellent component of the chemicals or the commercial moisturizing tissue, which is a value close to that of the non-moisturizing tissue.

Further, as understood from the examples 4 and 5, in the invention, even when the application speed is set to 800 m/minutes and 950 m/minutes, it is found that the tissue paper products having sufficiently excellent quality is obtained with high productivity. Furthermore, it is found that the thickness tends to be excellent when the speed is fast.

In the organoleptic evaluation, the tissue paper according to the invention has softness and plump sensation equal to or larger than those of the existing moisturizing tissue paper. On the other hand, the stickiness appearing in the moisturizing tissue paper is reduced.

(With Regard to Table 5)

The base paper (the single-sheet from a primary paper roll) and the chemicals were manufactured by the following condition, the tensile test of the base paper (test 1), and the performance comparison test of the tissue paper products (test 2) were performed. Furthermore, among the respective parameters illustrated in Table 5, the same parameters as those of Table 1 and Table 2 will not be described.

Application amount . . . the application amount is calculated by a difference between each sheet square meter basis weight coated with no chemicals after plying in operation and each corresponding sheet square meter basis weight immediately after the application.

(application amount g/m$^2$)=(square meter basis weight g/m$^2$ immediately after application)−(square meter basis weight g/m$^2$ without any application)

The application amounts of both outer surfaces or the sum of the application amount of both surfaces indicates the sum of the application amount per unit area of the sheet of the plied tissue paper, and is obtained by adding the application amounts of respective sheets.

<Base Paper>

The pulp forming the base paper was formed by NBKP 50% and LBKP 50%. Further, as the base paper before the plying process, a base paper having a basis weight of 13.5 g/m$^2$, a thickness of 150 μm (one ply), and a crepe ratio of 19% was used.

<Chemicals>

The chemicals were prepared so that the viscosity was 300 mPa·s (40° C.).

<Comparison in Performance of Tissue Paper>

The performance test was performed on the example and the comparative example of the tissue paper manufactured by the following method.

Example: the continuous single-sheet made of the base paper was multi-ply formed in two layers, the chemicals were applied to one surface by 1.7 g/m$^2$ and to the other surface by 2.3 g/m$^2$, the ply bonding was applied onto the surfaces, and the single-sheet was kept in a wound state for twenty four hours.

Comparative example: the chemicals were applied to the continuous single-sheet by the off-line application device, the continuous single-sheet was overlapped into two layers after fifteen hours, and the ply bonding was applied thereto. The chemicals application amount was set to 4.0 g/m$^2$ at both surfaces.

The results of the performance evaluation and the organoleptic evaluation of the tissue paper of the example and the comparative example are illustrated in Table 5. The method of performing the performance evaluation and the organoleptic evaluation is as below.

<Web Thickness>

A plastic plate having a weight of 30 g and a size of 130 mm×250 mm was loaded on the bundle of the tissue paper, and the heights at four corners were averaged so as to obtain the web thickness.

<Softness>

The measurement was performed according to the Handle-O-Meter (JIS L 1096 E).

<Organoleptic Evaluation>

The organoleptic evaluation for the softness, the thickness, and the comprehensive evaluation was performed on the tissue paper according to the example and the comparative example. The organoleptic evaluation was performed at five steps, and the determination was performed based on the following standard. The value of the organoleptic evaluation illustrated in Table 1 is an average value of the organoleptic evaluation performed by fifteen examiners.

<Softness>

5 . . . It is very soft.

4 . . . It is softer than the average softness expected as the tissue paper coated with the chemicals.

3 . . . It is the average softness expected as the tissue paper coated with the chemicals.

2 . . . It is harder than the average softness expected as the tissue paper coated with the chemicals.

1 . . . It feels hard.

<Thickness>

5 . . . It feels a noticeable thickness.

4 . . . It feels thicker than the average thickness expected as the tissue paper coated with the chemicals.

3 . . . It is the average thickness expected as the tissue paper coated with the chemicals.

2 . . . It feels thinner than the average thickness expected as the tissue paper coated with the chemicals.

1 . . . It feels thin.

<Comprehensive Evaluation>

5 . . . The usability is very satisfactory.

4 . . . The usability is satisfactory.

3 . . . The usability is average usability expected as the tissue paper coated with the chemicals.

2 . . . The usability is slightly lower than the average usability expected as the tissue paper coated with the chemicals.

1 . . . The usability is poor.

TABLE 5

| | | EXAMPLE C1 | EXAMPLE C2 | EXAMPLE C3 | EXAMPLE C4 | EXAMPLE C5 | EXAMPLE C6 | EXAMPLE C7 | EXAMPLE C8 | EXAMPLE C9 | COMPARATIVE EXAMPLE C1 |
|---|---|---|---|---|---|---|---|---|---|---|---|
| SQUARE METER BASIS WEIGHT/1P ($g/m^2$) | | 15.0 | 15.0 | 14.9 | 15.1 | 15.8 | 15.0 | 15.1 | 15.0 | 14.9 | 14.9 |
| PAPER THICKNESS/2P (μm) | | 135 | 138 | 143 | 145 | 112 | 130 | 122 | 115 | 111 | 103 |
| WEB THICKNESS (180 SETS) (mm) | | 60 | 62 | 65 | 66 | 52 | 58 | 56 | 55 | 53 | 45 |
| SOFTNESS (cN/100 mm) | | 0.95 | 0.96 | 1.01 | 1.55 | 0.79 | 0.89 | 0.87 | 0.83 | 0.82 | 0.72 |
| MOISTURE CONTAINING RATIO OF CHEMICALS (%) | | 12.0 | 12.0 | 12.0 | 12.0 | 12.0 | 12.0 | 12.0 | 0.5 | 19.0 | 12 |
| APPLICATION AMOUNT ($g/m^2$) WITH RESPECT TO COATED SURFACE (1) | | 2.4 | 3.0 | 4.0 | 0.4 | 2.3 | 2.5 | 2.5 | 2.5 | 2.5 | 2.0 |
| APPLICATION AMOUNT ($g/m^2$) WITH RESPECT TO COATED SURFACE (2) | | 1.6 | 1.0 | 0 | 0.8 | 4.0 | 1.5 | 1.5 | 1.5 | 1.5 | 2.0 |
| SUM OF APPLICATION AMOUNTS BOTH SURFACES ($g/m^2$) | | 4.0 | 4.0 | 4.0 | 1.2 | 6.3 | 4.0 | 4.0 | 4.0 | 4.0 | 4.0 |
| TIME FROM APPLICATION OF CHEMICALS TO ply bonding | | 0.6 | 0.6 | 0.6 | 0.6 | 0.6 | 0.2 | 3.0 | 0.6 | 0.6 | 0.6 |
| ORGANOLEPTIC EVALUATION | SOFTNESS | 4.2 | 4.1 | 3.4 | 3.0 | 4.5 | 4.2 | 4.3 | 4.4 | 4.4 | 4.6 |
| | FLUFFY SENSATION | 4.4 | 4.4 | 4.5 | 3.1 | 3.2 | 3.9 | 3.7 | 3.4 | 3.3 | 2.7 |
| | COMPREHENSIVE EVALUATION | 4.3 | 4.2 | 3.9 | 3.5 | 3.5 | 4.1 | 4.0 | 3.8 | 3.7 | 3.3 |
| | SLIPPAGE | 3.8 | 3.9 | 3.6 | 3.4 | 4.3 | 3.8 | 3.9 | 3.9 | 3.8 | 3.9 |

As illustrated in Table 5, when the example as the double-ply tissue paper is compared with the comparative examples, although the square meter basis weights are almost equal to each other, the paper thickness and the web thickness are significantly high in the example. Furthermore, the example has the larger softness. Even in the organoleptic evaluation, the softness, the thickness, and the comprehensive evaluation are all high in the example compared to the comparative example.

[Others]

The invention also includes the following inventions.

(Invention A1)

A facility for manufacturing a secondary paper roll for tissue paper products, the facility continuously manufacturing a plurality of secondary paper rolls for tissue paper products from a primary paper roll, the facility including: a multi-ply forming unit for multi-ply forming single-sheets from primary paper rolls, reeled out from the plurality of primary paper rolls along the continuous direction so as to form a multi-ply continuous sheet; a chemicals applying unit for applying chemicals to the multi-ply continuous sheet; a slitting unit for slitting the multi-ply continuous sheet into each product width of the tissue paper products or several fold widths thereof; and a winding unit for coaxially winding the respective slit multi-ply continuous sheets so as to form a plurality of secondary paper rolls of each product width of the tissue paper products or several fold widths thereof.

(Invention A2)

The facility for manufacturing the secondary paper roll for the tissue paper products according to Invention A1, wherein the chemicals applying unit is provided at the rear stage of the multi-ply forming unit and the front stage of the slitting unit.

(Invention A3)

The facility for manufacturing the secondary paper roll for the tissue paper products according to Invention A2, wherein a calendering unit for performing a calendering process using a calender is provided between the multi-ply forming unit and the chemicals applying unit.

(Invention A4)

The facility for manufacturing the secondary paper roll for the tissue paper products according to Invention A2, wherein a ply bonding unit for performing linear ply bonding preventing interlayer peeling on the multi-ply continuous sheet is provided between the chemicals applying unit and the slitting unit.

(Invention A5)

The facility for manufacturing the secondary paper roll for the tissue paper products according to Invention A1, wherein the application of the chemicals is performed by flexographic printing.

(Invention B1)

A method of manufacturing tissue paper products including: a multi-ply forming step of multi-ply forming single-sheets from primary paper rolls, reeled out from the plurality of primary paper rolls along the continuous direction so as to form a multi-ply continuous sheet; a chemicals applying step of applying chemicals to the multi-ply continuous sheet; a slitting step of slitting the multi-ply continuous sheet into each product width of the tissue paper products or several fold widths thereof; a winding step of coaxially winding the respective slit multi-ply continuous sheets so as to form a plurality of secondary paper rolls of each product width of the tissue paper products or several fold widths thereof; and a step of conveying the plurality of multi-ply-sheets from the secondary paper rolls, reeled out from the plurality of secondary paper rolls along the continuous direction and overlapping the plurality of multi-ply-sheets from the secondary paper rolls, so as to be folded.

(Invention B2)

The method of manufacturing the tissue paper products according to Invention B1, wherein the chemicals applying step is performed after the multi-ply forming step and before the slitting step.

(Invention B3)

The method of manufacturing the tissue paper products according to Invention B2, wherein a calendering step of performing a calendering process using a calender is provided between the multi-ply forming step and the chemicals applying step.

(Invention B4)

The method of manufacturing the tissue paper products according to Invention B2, wherein a ply bonding step of performing linear ply bonding for preventing interlayer peeling on the multi-ply continuous sheet is provided between the chemicals applying step and the slitting step.

(Invention B5)

The method of manufacturing the tissue paper products according to Invention B1, wherein the application of the chemicals is performed by flexographic printing.

(Invention C1)

A facility for manufacturing tissue paper products including: a multi-ply forming unit for multi-ply forming single-sheets from primary paper rolls, reeled out from the plurality of primary paper rolls along the continuous direction so as to form a multi-ply continuous sheet; a chemicals applying unit for applying chemicals to the multi-ply continuous sheet; a slitting unit for slitting the multi-ply continuous sheet into each product width of the tissue paper products or several fold widths thereof; a winding unit of coaxially winding the respective slit multi-ply continuous sheets so as to form a plurality of secondary paper rolls of each product width of the tissue paper products or several fold widths thereof; and a unit for conveying the plurality of multi-ply-sheets from the secondary paper rolls, reeled out from the plurality of secondary paper rolls along the continuous direction and overlapping the plurality of multi-ply-sheets from the secondary paper rolls, so as to be folded.

(Invention C2)

The facility for manufacturing the tissue paper products according to Invention C1, wherein the chemicals applying unit is provided at the rear stage of the multi-ply forming unit and the front stage of the slitting unit.

(Invention C3)

The facility for manufacturing the tissue paper products according to Invention C2, wherein a calendering unit for performing a calendering process using a calender is provided between the multi-ply forming unit and the chemicals applying unit.

(Invention C4)

The facility for manufacturing the tissue paper products according to Invention C2, wherein a ply bonding unit for performing linear ply bonding preventing interlayer peeling on the multi-ply continuous sheet is provided between the chemicals applying unit and the slitting unit.

(Invention C5)

The facility for manufacturing the tissue paper products according to Invention C1, wherein the application of the chemicals is performed by flexographic printing.

INDUSTRIAL APPLICABILITY

The present invention may be applied to the manufacture of a secondary paper roll for tissue paper products used in a multi-stand type interfolder.

EXPLANATIONS OF LETTERS OR NUMERALS

51: ply unit (multi-ply forming step)
52: calender unit (calendering step)
53: chemicals applying unit (chemicals applying step)
54: ply bonding unit (ply bonding step)
55: slitting unit (slitting step)
56: winding unit (winding step)
S11, S12: single-sheet from a primary paper roll
S2: multi-ply continuous sheet
JR: primary paper roll
R: secondary paper roll

The invention claimed is:

1. A method of continuously manufacturing a secondary paper roll for tissue paper products from a primary roll comprising in order the following steps:

(1) a multi-ply forming step of multi-ply forming single sheets from primary paper rolls, reeled out from the plurality of primary paper rolls along the continuous direction so as to form a multi-ply continuous sheet having an upper surface comprising the outer surface of a top single sheet reeled out from one of said plurality of primary paper rolls and a lower surface comprising the outer surface of a bottom single sheet reeled out from another one of said plurality of primary paper rolls, wherein said top single sheet and said bottom single sheet have different crepe ratios;

(2) after the multi-ply forming step, a calendering step of performing a calendering process on the multi-ply continuous sheet using a calender unit, wherein said calender unit comprises a soft calender and/or a calender configured as a metal roll;

(3) after the calendering step, a chemicals applying step of applying chemicals comprising from about 70% to about 90% polyol, from 1% to 15% water, and from 0.01% to about 22% of a functional chemical agent to the multi-ply continuous sheet, wherein the application of the chemicals is performed by flexographic printing and more chemicals are applied to whichever of the top single sheet or bottom single sheet has the higher crepe ratio;

(4) after the chemicals applying step, a ply bonding step of performing linear ply bonding along the lateral edges of the multi-ply continuous sheet, wherein said ply bonding step is performed within from 0.3 to 2.5 seconds after the chemicals applying step has been completed;

(5) after the ply bonding step, a slitting step of slitting the multi-ply continuous sheet into each product width of the tissue paper products or several fold widths thereof; and (6) after the slitting step, a winding step of coaxially winding the respective slit multi-ply continuous sheets so as to form a plurality of secondary paper rolls of each product width of the tissue paper products or several fold widths thereof, and wherein the multi-ply continuous sheet is not peeled from the step of multi-ply forming step (1) to the winding step (6).

2. The method of manufacturing the secondary paper roll for the tissue paper products according to claim 1, wherein the conveying speed of the multi-ply continuous sheet when applying the chemicals using the flexographic printing is set to 700 m/minute or more.

* * * * *